US005628385A

United States Patent [19]

Yumura et al.

[11] Patent Number: 5,628,385

[45] Date of Patent: May 13, 1997

[54] ELEVATOR OVERSPEED PROTECTION APPARATUS

[75] Inventors: Takashi Yumura; Kazumasa Ito, both of Tokyo, Japan

[73] Assignee: Mitsubishi Denki Kabushiki Kaisha, Tokyo, Japan

[21] Appl. No.: 544,842

[22] Filed: Oct. 18, 1995

[30] Foreign Application Priority Data

Jul. 26, 1995 [JP] Japan ..... 7-190922

[51] Int. Cl.[6] ..... B66B 5/04

[52] U.S. Cl. ..... 187/373; 188/165

[58] Field of Search ..... 187/373, 374, 187/286, 288; 188/188, 189, 161, 164, 165

[56] References Cited

U.S. PATENT DOCUMENTS 5,301,773 4/1994 Jamieson et al. ..... 187/88

5,366,044 11/1994 Jamieson et al. ..... 187/88

5,467,850 11/1995 Skalski ..... 187/373

FOREIGN PATENT DOCUMENTS 5147852 6/1993 Japan .

*Primary Examiner*—Kenneth Noland

*Attorney, Agent, or Firm*—Sughrue, Mion, Zinn, Macpeak & Seas

[57] ABSTRACT

An elevator overspeed protection apparatus includes a brake apparatus which makes use of eddy currents. The brake apparatus includes a magnetic spring placed on a car in the proximity of a pickup of the elevator overspeed protection apparatus such that, when an arm of the brake apparatus is in a horizontal condition, a displacement of the pickup is prevented with a strong attracting force by the magnetic spring, but when the arm is inclined obliquely, the attracting force of the magnetic spring is prevented from acting upon the pickup. Due to the construction, the brake apparatus operates stably and with certainty and has an increased life.

15 Claims, 73 Drawing Sheets

(*) 1:RATE AT THE POSITION WHERE FLUX PASSES MOST EASILY (*) 1:RATE AT THE POSITION WHERE FLUX PASSES MOST EASILY

ELEVATOR OVERSPEED PROTECTION APPARATUS

BACKGROUND OF THE INVENTION

1. Field of the Invention

This invention relates to an elevator overspeed protection apparatus or in other words, an elevator governor, for operating an elevator for elevating people and/or loads with safety.

2. Description of the Prior Art

FIGS. 93(1) and 93(2) are a plan view (FIG. 93(1)) and a front elevational view (FIG. 93(2)), respectively, showing a conventional example of an elevator overspeed protection apparatus disclosed, for example, in Japanese Patent Laid-Open Application No. Heisei 5-147852. Referring to FIGS. 93(1) and 93(2), reference character 12 denotes a car of the elevator, 13 a base provided on the car 12, 14 an arm formed by a pair of parallel links, 15 a fulcrum provided on the base 13 for supporting the arm 14 for pivotal motion, 16 a pickup mounted for pivotal motion at an end of the arm 14 for detecting the speed of the car 12, **16*a* a pair of magnets provided in an opposing relationship to each other, 16*b* a yoke to which the magnets 16*a* are secured, 17 a balance weight mounted at the other end of the arm 14 so as to be balanced with the pickup 16, and 18 a conductor such as a guide rail provided fixedly alongside the car 12, and magnetic fluxes going out of the magnets 16*a* of the pickup 16 form a first magnetic circuit passing through a plate-formed portion extending from the center of the conductor 18 toward the car 12 and the yoke 16*b*. Meanwhile, reference character 19 denotes a elastic spring for providing a resisting force to a displacement of the balance weight 17 by pivotal motion of the arm 14. The arm 14, the fulcrum 15, the pickup 16, the balance weight 17 and the elastic spring 19 form a conversion apparatus which converts a force acting upon the magnets 16*a* by eddy currents generated in the conductor 18 when the car 12 runs into a displacement of the magnets 16*a* in the running direction of the car 12. Reference character 20 denotes a brake apparatus including a car stopping switch 20*a* which is actuated in response to a displacement or the balance weight 17** and an emergency stopping operation mechanism not shown.

Subsequently, operation will be described. The magnetic circuit formed by the magnets **16*a* and the yoke 16*b* makes a magnetic field perpendicular to the plane of a plate-formed portion of the conductor 18 present between the magnets 16*a*. When the car 12 moves upwardly or downwardly and the magnetic field moves in the plate-formed portion of the conductor 18, eddy currents to cancel a variation of the magnetic field are generated in the conductor 18, and in the pickup 16, a force (drag) in the direction opposite to the running direction of the car 12 which resists the movement of the car 12 is generated with a magnitude corresponding to the speed of the car 12. This force is converted into a displacement of the pickup 16 and the balance weight 17 in the upward or downward direction by the arm 14 and the elastic spring 19 as seen in FIG. 94**.

Then, when the moving down speed of the car 12 becomes equal to a first over speed (normally equal to approximately 1.3 times a rated speed which is an ordinary running speed) higher than a predetermined value, the pickup 16 is acted upon by an upward force corresponding to the speed to displace the balance weight 17 downwardly. Then, in response to the displacement, the car stopping switch **20*a* provided for the brake apparatus 20 is rendered operative to intercept the power source for the elevator driving apparatus to stop the car 12. Even when the car 12 reaches a second over speed (normally equal to approximately 1.4 times of the rated speed) by some cause, the balance weight 17 is further displaced in response to the speed so that an emergency stopping apparatus (not shown) provided for the car 12 is rendered operative by the emergency stopping operation mechanism provided for the brake apparatus 20 to stop the car 12** immediately.

Since the conventional safety apparatus for an elevator is constructed in such a manner as described above, when the magnetic field moves in the conductor 18, eddy currents are generated so as to cancel a variation of the magnetic field in the conductor 18 and a force (drag) in the direction to resist the movement of the car 12 is generated in the pickup 16 with a magnitude corresponding to the speed of the car 12. However, the conventional safety apparatus for an elevator has a subject to be solved in that, generally, due to the physical property of eddy currents generated in a metal conductor, the relationship between the speed V and the force f generated by the pickup 16 is such that, as seen in FIG. 95, when the speed is low, the variation rate of the generated force f is high, and as the speed V increases, the variation rate of the generated force f decreases. In particular, the conventional safety apparatus for an elevator has a subject to be solved in that, as the speed of the car 12 increases to the rated speed V0 (the displacement of the balance weight 17 then is P0) which is an ordinary running speed, to the first over speed V1 (the displacement of the balance weight 17 then is P1) and then to the second over speed V2 (the displacement of the balance weight 17 then is P2), the difference between the generated forces f0, f1 and f2 decreases and, although the danger increases, the difference in force to actuate the brake apparatus 20 decreases and also the set position of an operation point of the brake apparatus 20 becomes difficult, resulting in increase in occurrence of a malfunction, increase in dispersion of the operation speed and decrease in safety.

Further, since the characteristic of the spring force F2 of the elastic spring 19 relative to the displacement Z of the pickup 16 normally is such a linear relationship as illustrated in FIG. 96, the characteristic of the displacement of the pickup 16 relative to the speed V of the car 12 exhibits a higher variation rate of the displacement within a range of movement of the car 12 in an ordinary operation condition as seen in FIG. 97. Consequently, since the arm 14 is always pivoted over a great extent in an ordinary operation of the car 12, the conventional safety apparatus for an elevator has a subject to be solved in that a malfunction of the brake apparatus 20 sometimes occurs and the life of the fulcrum 15 which is a supporting portion for the pivotal motion is reduced.

Further, in the conventional elevator speed controller, when the car 12 is swung in a horizontal direction by a one-sided load upon movement of the car 12 or when passengers enter the car 12, the distances of the gaps (air gap portions) through which magnetic fluxes of the pickup 16 path are varied and the generated force by the pickup 16 is varied, and consequently, the conventional elevator overspeed protection apparatus has a subject to be solved in that also the displacement of the balance weight 17 is varied and detection of the operating speed of the car 12 becomes unstable, by which a malfunction of the brake apparatus 20 is sometimes caused.

Furthermore, the conventional elevator overspeed protection apparatus has a subject to be solved also in that detection for improving vibrations when the car 12 moves or when passengers enter the car 12 cannot be performed.

Besides, the conventional elevator overspeed protection apparatus has a subject to be solved in that, since it is placed on the car 12 and is heavy with a great number of mechanical sections which require a large space, the driving efficiency thereof is low and it cannot be carried readily.

In addition, the conventional elevator overspeed protection apparatus has a subject to be solved in that, since only a running speed of the car 12 is detected, when the car 12 is brought out of a controllable range and advances into a top pit section although it is running at a speed which is not a dangerous speed, the danger cannot be detected and emergency stopping does not operate, which is dangerous.

SUMMARY OF THE INVENTION

In view of the foregoing, it is an object of the present invention to provide an elevator overspeed protection apparatus wherein, also in a system which makes use of a force produced by eddy currents, a safety apparatus can perform a stabilized operation minimizing a malfunction, and which operates, when the speed rises abnormally, accurately and has a long life.

It is another object of the present invention to provide an elevator overspeed protection apparatus which can detect a running speed of an elevator accurately particularly when the elevator speed approaches a first over speed which is a dangerous speed.

It is a further object of the present invention to provide an elevator overspeed protection apparatus which is inexpensive and long in life and can detect a running speed accurately.

It is a yet further object of the present invention to provide an elevator overspeed protection apparatus wherein the number of components is comparatively small and a rotating section can be made simple in construction and light in weight while the pivotal displacement of a pivotal member is small upon running of a car at a low speed.

It is a yet further object of the present invention to provide an elevator overspeed protection apparatus wherein a pickup section can be constructed simply and is easy to manufacture and less liable to suffer from a trouble and besides also the pickup section and a counter section can have various constructions readily and are small in number of parts while a rotating section is simple in construction and light in weight.

It is a yet further object of the present invention to provide an elevator overspeed protection apparatus wherein an operation speed upon an emergency operation is stabilized and the safety is high.

It is a yet further object of the present invention to provide an elevator overspeed protection apparatus which is easy to design and to assemble and adjust.

It is a yet further object of the present invention to provide an elevator overspeed protection apparatus wherein a set position of a safety apparatus can be set readily and which suffers less likely from a malfunction and is high in accuracy and certainty in operation speed.

It is a yet further object of the present invention to provide an elevator overspeed protection apparatus wherein the relationship between a displacement of a pickup and a combined spring force can be set freely such that a long operation distance of a safety apparatus is taken.

It is a yet further object of the present invention to provide a stabilized elevator overspeed protection apparatus wherein conversion of a displacement can be performed readily In accordance with a force and which is high in reliability.

It is a yet further object of the present invention to provide an elevator overspeed protection apparatus wherein the speed of a car can be detected accurately and operate similarly to that in an ordinary condition even when the car is rocked in a horizontal direction by a one-sided load or the like when the car moves or when passengers enter the car.

It is a yet further object of the present invention to provide an elevator overspeed protection apparatus which can absorb, even if a car is rocked horizontally and exhibits a displacement from a pickup, such displacement.

It is a yet further object of the present invention to provide an elevator overspeed protection apparatus which can detect the speed of movement or vibrations of or a disturbance to a car and consequently can perform speed control or error correction or improvement in comfort in running.

It is a yet further object of the present invention to provide an elevator overspeed protection apparatus having an emergency stopping function which is certain in operation and small in number of parts and can be produced at a reduced cost and in a reduced size.

It is a yet further object of the present invention to provide an elevator overspeed protection apparatus which can be mounted readily on a car.

In order to attain the objects described above, according to a first aspect of the present invention, there is provided an elevator overspeed protection apparatus which comprises a conversion apparatus for converting a force acting upon a first magnetic circuit into a displacement of the first magnetic circuit such that it provides, when the speed of a car is low, a small or no displacement to the first magnetic circuit, but provides, when the speed of the car rises higher than a predetermined speed, a large displacement to the first magnetic circuit.

According to a second aspect of the present invention, there is provided an elevator overspeed protection apparatus wherein, whereas a large displacement is provided to the first magnetic circuit when the speed of the car rises higher than the predetermined speed, the predetermined speed is higher than a rated speed of the elevator but lower than a first over speed.

According to a third aspect of the present invention, there is provided an elevator overspeed protection apparatus wherein the conversion apparatus includes a second magnetic circuit provided on the car or a balance weight in the proximity of the first magnetic circuit and exerting a magnetic force in a direction to reduce the displacement of the first magnetic circuit when the displacement of the first magnetic circuit is small or zero.

According to a fourth aspect of the present invention, there is provided an elevator overspeed protection apparatus wherein the conversion apparatus includes a pivotal member holding at an end thereof a magnet or a yoke, which forms the first magnetic circuit, and supported on a fulcrum provided on the car or a balance weight for pivotal motion in the running direction of the car, and a yoke or a magnet provided on the car or the balance weight in the proximity of the first magnetic circuit such that the yoke or the magnet forms a component of the first magnetic circuit when the displacement of the first magnetic circuit is small or zero, but when the displacement of the first magnetic circuit is large, the yoke or the magnet is removed from the first magnetic circuit.

According to a fifth aspect of the present invention, there is provided an elevator overspeed protection apparatus wherein the conversion apparatus includes a pivotal member holding at an end thereof a magnet and/or a yoke, which form the first magnetic circuit, and supported on a fulcrum provided on the car or a balance weight for pivotal motion in the running direction of the car, and a second magnetic circuit having a portion located at another portion of the pivotal member and having another portion located on the car or the balance weight for exerting a magnetic force in a direction to control the pivotal motion of the pivotal member.

According to a sixth aspect of the present invention, there is provided an elevator overspeed protection apparatus wherein the conversion apparatus includes a fourth magnetic circuit provided on the car or a balance weight in the proximity of the first magnetic circuit for exerting, when the displacement of the first magnetic circuit becomes greater than a displacement of the first magnetic circuit exhibited when the running speed of the car reaches the predetermined speed, a magnetic force so as to promote the displacement.

According to a seventh aspect of the present invention, there is provided an elevator overspeed protection apparatus wherein the conversion apparatus includes a magnet or a yoke provided in the first magnetic circuit and so shaped that, when the displacement of the first magnetic circuit in the running direction of the car is small or zero, magnetic fluxes of the first magnetic circuit are less easy to pass, and as the displacement of the first magnetic circuit in the running direction of the car increases, magnetic fluxes of the first magnetic path become easier to pass.

According to an eighth aspect of the present invention, there is provided an elevator overspeed protection apparatus wherein the conversion apparatus includes a pivotal member holding at an end thereof a magnet and/or a yoke, which form the first magnetic circuit, and supported on a fulcrum provided on the car or a balance weight for pivotal motion in the running direction of the car, and a plane of the pivotal motion of the pivotal member is inclined relative to the running direction of the car.

According to a ninth aspect of the present invention, there is provided an elevator overspeed protection apparatus wherein the conversion apparatus includes a pivotal member holding at an end thereof a magnet and/or a yoke, which form the first magnetic circuit, and supported on a fulcrum provided on the car or a balance weight for pivotal motion in the running direction of the car, and the pivotal member includes a spring provided at the other end thereof and including a series combination of a spring having a high spring constant and an initially compressed spring having a low spring constant for limiting the displacement of the other end of the pivotal member.

According to a tenth aspect of the present invention, there is provided an elevator overspeed protection apparatus wherein the conversion apparatus includes a pivotal member holding at an end thereof a magnet and/or a yoke, which form the first magnetic circuit, and supported on a fulcrum provided on the car or a balance weight for pivotal motion in the running direction of the car, and a displacement conversion mechanism for providing a small displacement to the brake apparatus when an amount of the pivotal motion of the pivotal member is small but providing a large displacement to the brake apparatus sufficient to render the brake apparatus operative when the amount of pivotal motion of the pivotal member becomes greater than an amount of a pivotal motion exhibited when the speed of the car reaches the predetermined speed.

According to an eleventh aspect of the present invention, there is provided an elevator overspeed protection apparatus wherein the brake apparatus is formed integrally with the first magnetic circuit.

According to a twelfth aspect of the present invention, there is provided an elevator overspeed protection apparatus which comprises a keeping mechanism for keeping magnitudes of air gap portions of a first magnetic circuit on the opposite side faces of a conductor fixed, and a displacement absorption mechanism for absorbing a displacement of the first magnetic circuit in a horizontal direction with respect to a car or a balance weight on which the first magnetic circuit is provided.

According to a thirteenth aspect of the present invention, there is provided an elevator overspeed protection apparatus wherein the keeping mechanism includes a roller guide or roller guide.

According to a fourteenth aspect of the present invention, there is provided an elevator overspeed protection apparatus wherein the displacement absorption mechanism is formed by a elastic member, a slide mechanism, or the combination of them.

According to a fifteenth aspect of the present invention, there is provided an elevator overspeed protection apparatus wherein the conversion apparatus includes a detection element for detecting physical quantity such as forth, displacement, or magnetic flux, which may be changed in response to the movement of the car.

BRIEF DESCRIPTION OF THE DRAWINGS

The above and other objects, features and advantages of the present invention will become apparent from the following description, taken in conjunction with the accompanying drawings.

FIG. 1(2) is a front elevational view of the embodiment 1;

FIG. 6(2) is a front elevational view of the embodiment 2;

FIG. 7(2) is a front elevational view of the embodiment 3;

FIG. 8(2) is a front elevational view of the embodiment 4;

FIG. 9(2) is a front elevational view of the embodiment 5;

FIG. 10(2) is a front elevational view of the embodiment 6;

FIG. 11(2) is a front elevational view of the embodiment 7;

FIG. 12(2) is a front elevational view of the embodiment 8;

FIG. 13(2) is a front elevational view of an example of FIG. 13(1);

FIG. 14(2) is a front elevational view of the embodiment 9;

FIG. 15(2)is a front elevational view of the embodiment 10;

FIG. 16(2) is a front elevational view of the embodiment 11;

FIG. 16(3) is an enlarged plan view of a magnetic spring portion surrounded by a broken line C in FIG. 16(1) and FIG. 16(2);

FIG. 16(4) is an enlarged elevational view of the magnetic spring portion shown in FIG. 16(3);

FIG. 16(5) is an enlarged right side elevational view of the magnetic spring portion shown in FIG. 16(3);

FIG. 17(2) is an enlarged elevational view of the portion C shown in FIG. 17(1);

FIG. 17(3) is an enlarged right side elevational view of the portion C shown in FIG. 17(1);

FIG. 18(2) is an enlarged elevational view of the portion C shown in FIG. 18(1);

FIG. 18(3) is an enlarged right side elevational view of the portion C shown in FIG. 18(1);

FIG. 22(2) is a front elevational view of the embodiment 12;

FIG. 23(2) is a front elevational view of the embodiment 13;

FIG. 24(2) is a front elevational view of the embodiment 14;

FIG. 25(2) is a front elevational view showing a condition in which an arm of the embodiment 14 is pivoted counter-clockwise;

FIG. 29(2) is a front elevational view of the embodiment 15;

FIG. 30(2) is a front elevational view showing a condition in which an arm of the embodiment 15 is pivoted counter-clockwise;

FIG. 31(2) is a front elevational view of the embodiment 16;

FIG. 33(2) is a front elevational view of the embodiment 17;

FIG. 34(2) is a front elevational view of the embodiment 18;

FIG. 35(2) is a front elevational view of the embodiment 19;

FIG. 37(2) is a front elevational view of the embodiment 19;

FIG. 37(3) is a right side elevational view of the embodiment 19;

FIG. 38(2) is a front elevational view showing a flow of magnetic fluxes of a magnetic circuit portion the pickup when the arm is parallel in the embodiment 19;

FIG. 38(3) is a right side elevational view showing a flow of magnetic fluxes of a magnetic circuit portion of the pickup when the arm is parallel in the embodiment 19;

FIG. 39(2) is a front elevational view showing a flow of magnetic fluxes of a magnetic circuit portion of the pickup when the arm is inclined in the embodiment 19;

FIG. 39(3) is a right side elevational view showing a flow of magnetic fluxes of a magnetic circuit portion of the pickup when the arm is inclined in the embodiment 19;

FIG. 42(2) is a right side elevational view showing a further shape of a yoke of the embodiment 19;

FIG. 42(3) is a right side elevational view showing a still further shape of a yoke of the embodiment 19;

FIG. 46(2) is a front elevational view of the embodiment 20;

FIG. 46(3) is a right side elevational view of the embodiment 20;

FIG. 47(2) is a front elevational view showing the pickup portion when the arm in the embodiment 20 is inclined;

FIG. 47(3) is a right side elevational view showing the pickup portion when the arm in the embodiment 20 is inclined;

FIG. 48(2) is a front elevational view showing a pickup portion when the arm in the embodiment 21 is horizontal;

FIG. 48(3) is a right side elevational view showing the pickup portion when the arm in the embodiment 21 is horizontal;

FIG. 49(2) is a front elevational view of the embodiment 22;

FIG. 50(2) is a front elevational view of the embodiment 23;

FIG. 52(2) is a front elevational view showing the pickup portion when the arm in the embodiment 21 is parallel;

FIG. 52(3) is a right side elevational view showing the pickup portion when the arm in the embodiment 21 is parallel;

FIG. 53(2) is a front elevational view showing the pickup portion when the arm in the embodiment 21 is inclined rightwardly downwards;

FIG. 53(3) is a right side elevational view showing the pickup portion when the arm in the embodiment 21 is rightwardly downwards;

FIG. 54(2) is a perspective view showing schematically the pickup, the arm, and the balance weight when the arm in the embodiment 24 of the present invention is pivoted and inclined;

FIG. 55(2) is a right side elevational view showing a condition in which the arm in the embodiment 24 is inclined;

FIG. 58(2) is a perspective view showing schematically the pickup, the arm, and the balance weight when the arm in the embodiment 25 of the present invention is pivoted and inclined;

FIG. 59(2) is a perspective view showing schematically the pickup, the arm, and the balance weight when the arm in the embodiment 26 of the present invention is pivoted and inclined;

FIG. 60(2) is a front elevational view showing a construction of the embodiment 27;

FIG. 65(1) is a plan view showing a construction of an embodiment 28 of the present invention;

FIG. 65(2) is a front elevational view showing a construction of the embodiment 28;

Figure 66:
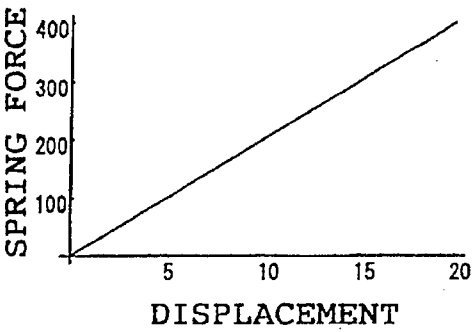
Figure 66:
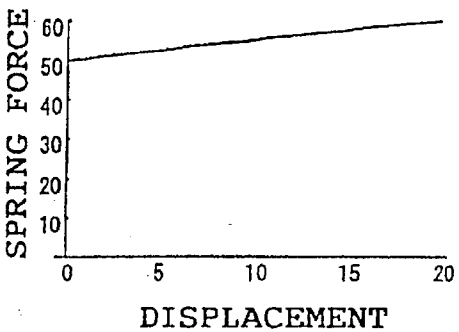
Figure 66:
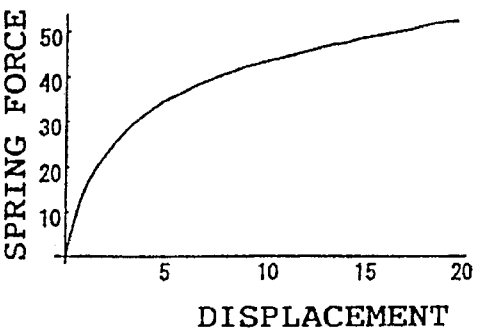
Figure 67:
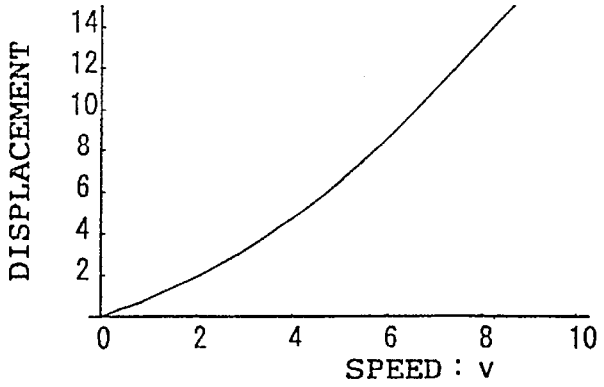
Figure 68:
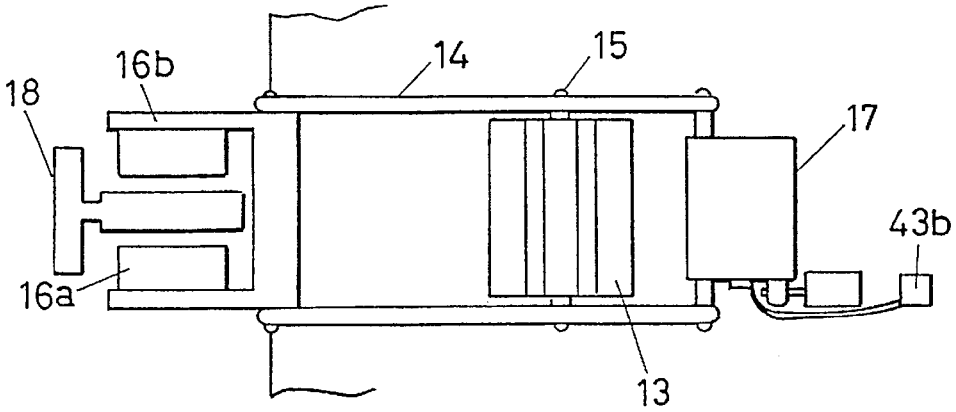
Figure 68:
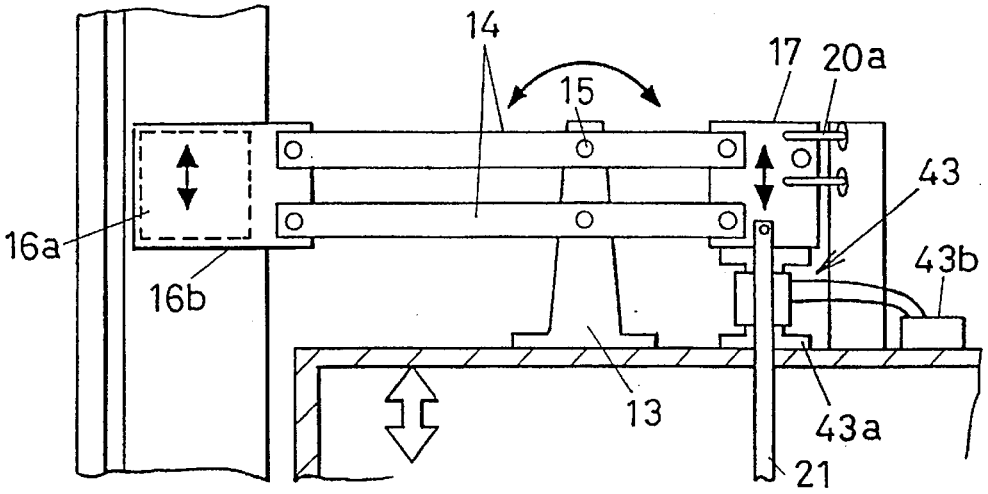
Figure 69:
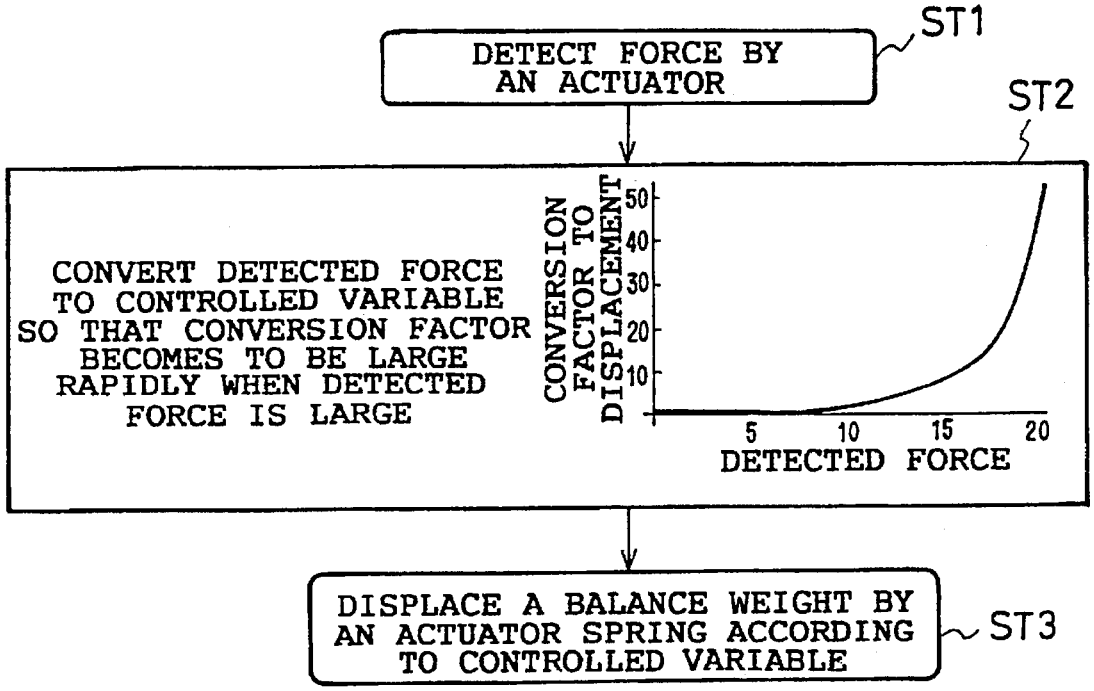
Figure 71:
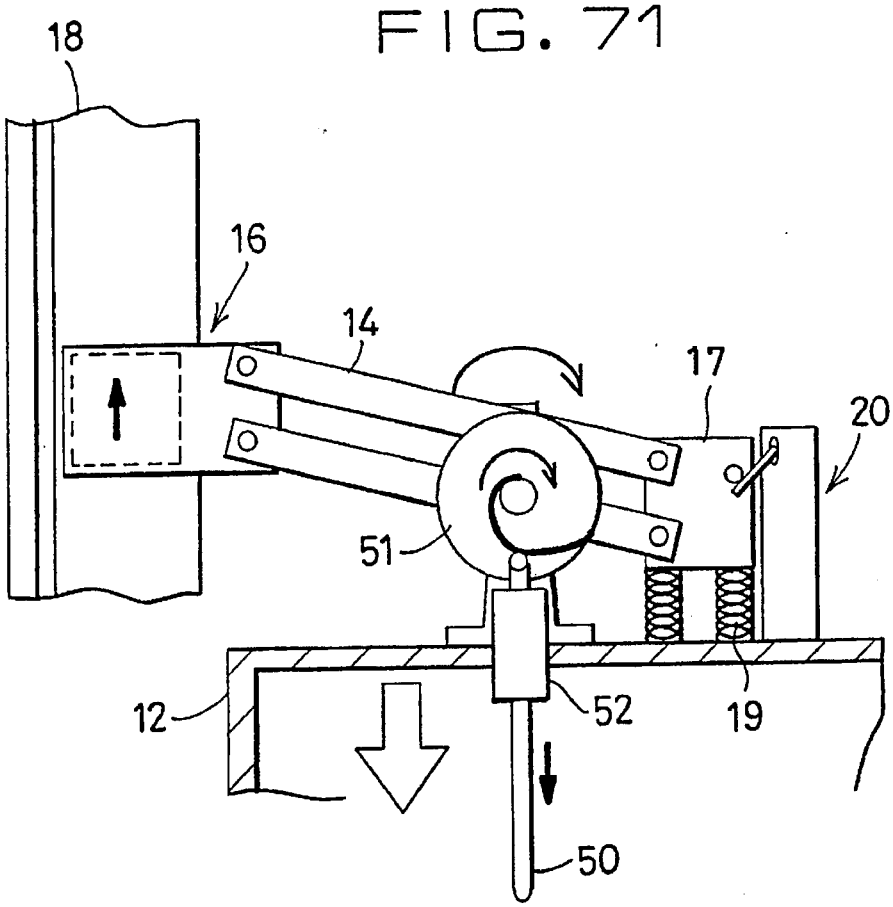
Figure 70:
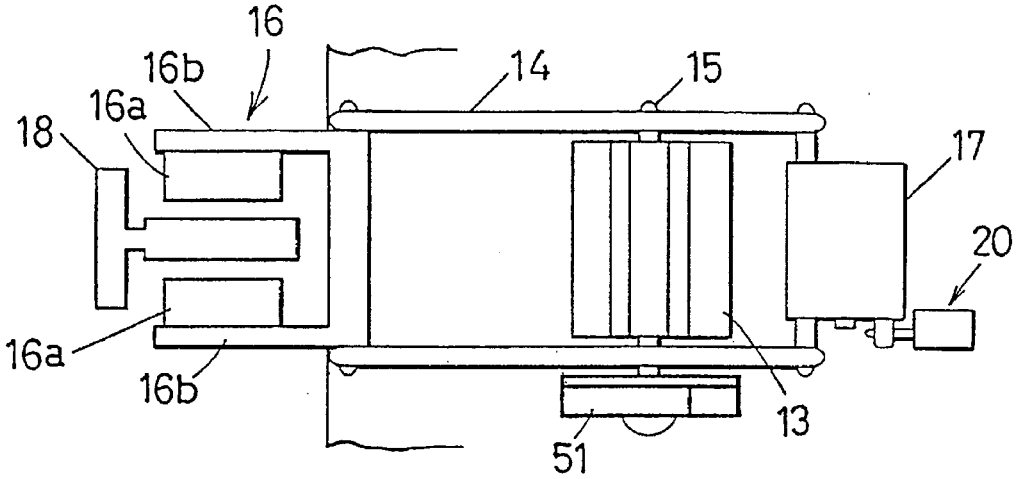
Figure 70:
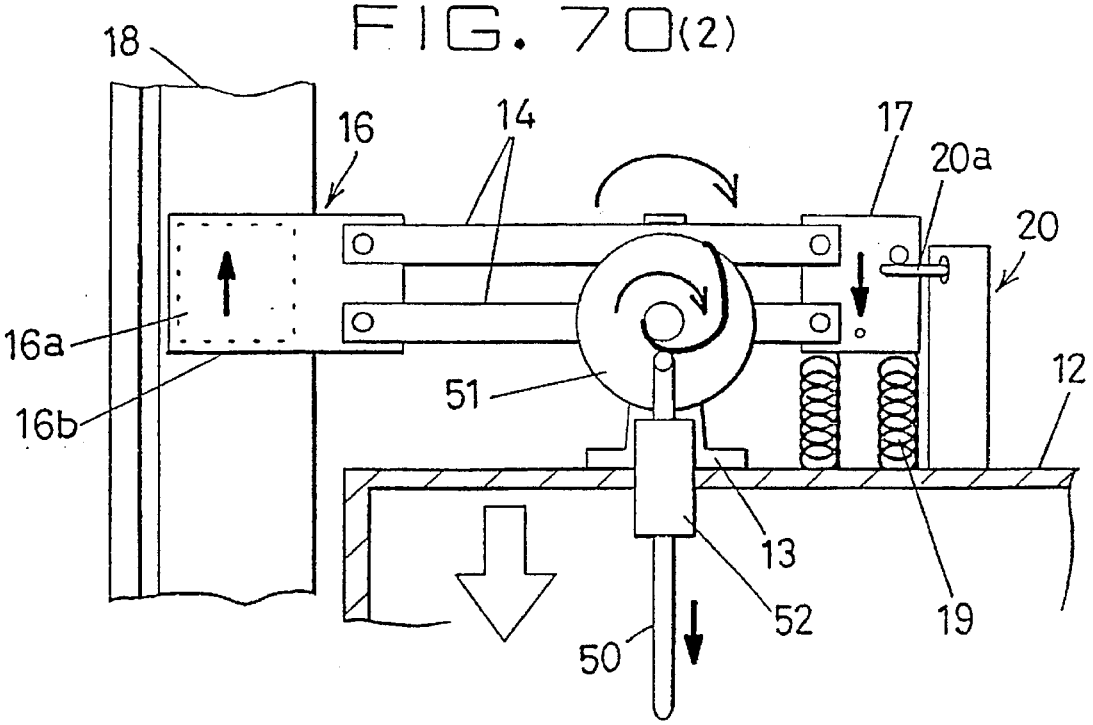
Figure 72:
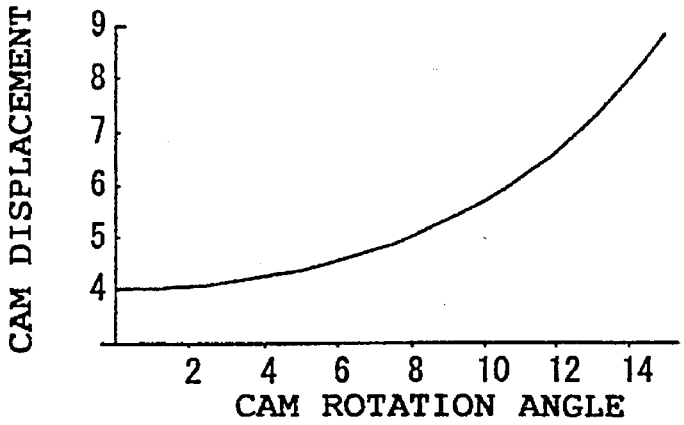
Figure 73:
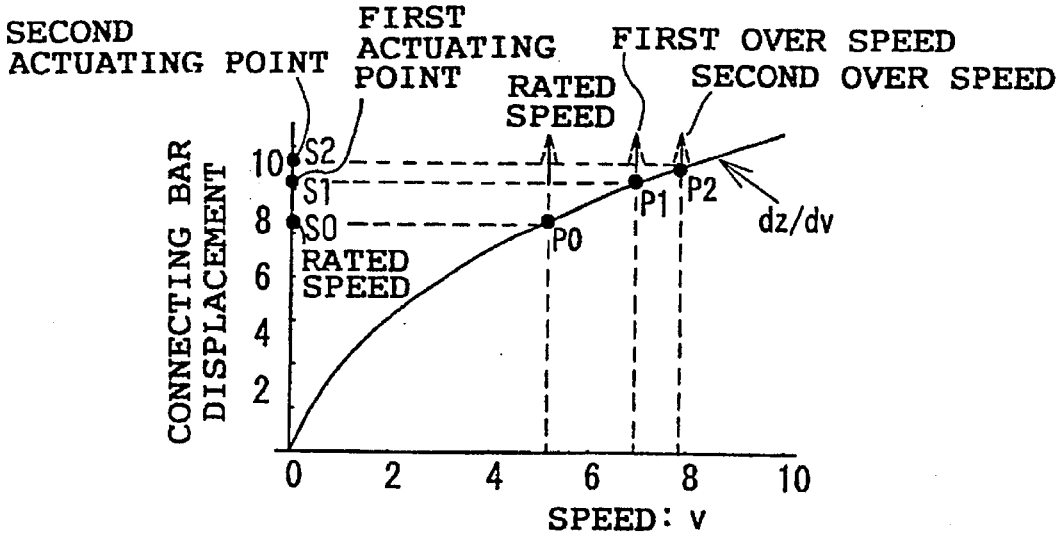
Figure 74:
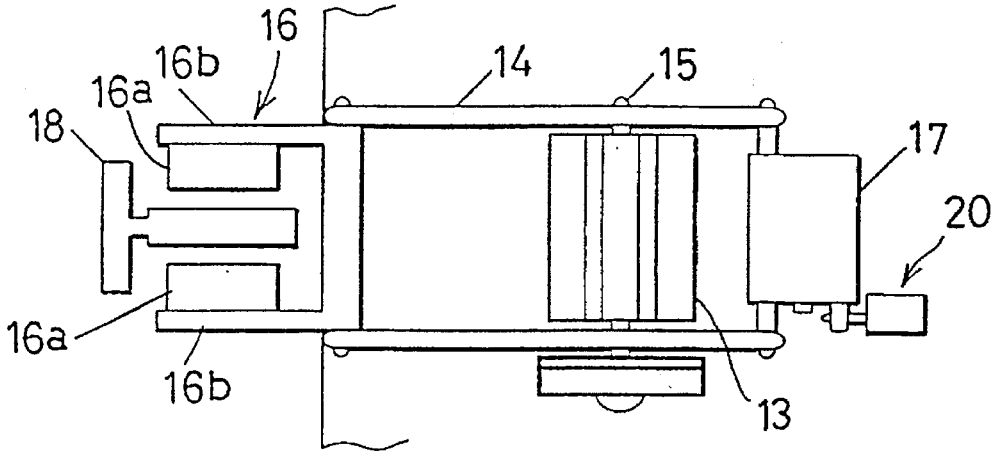
Figure 74:
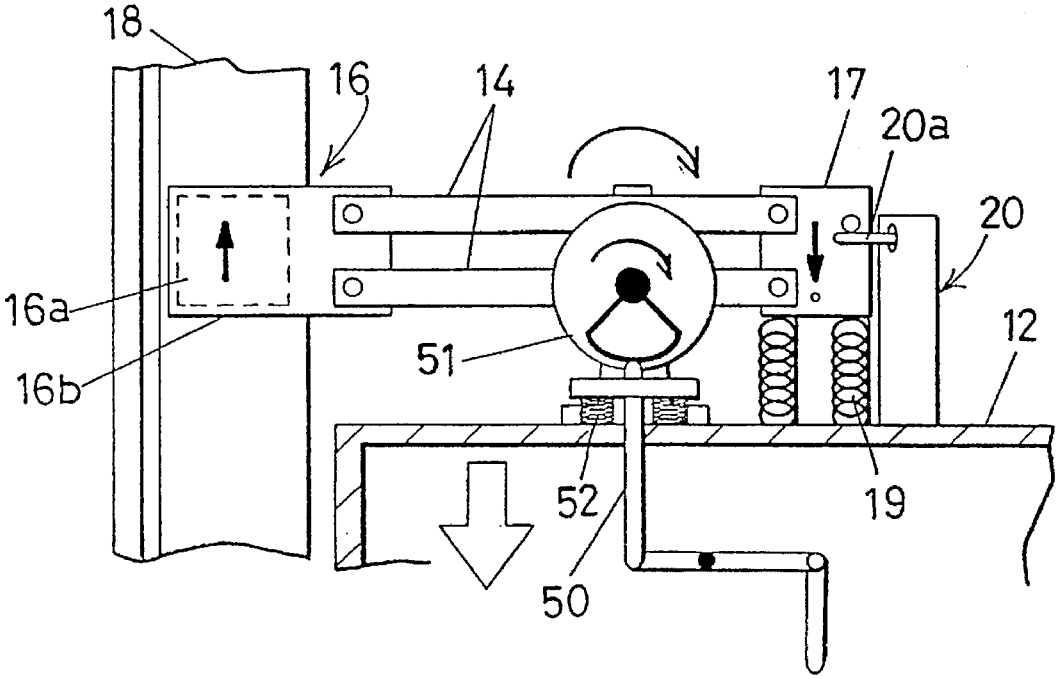
Figure 75:
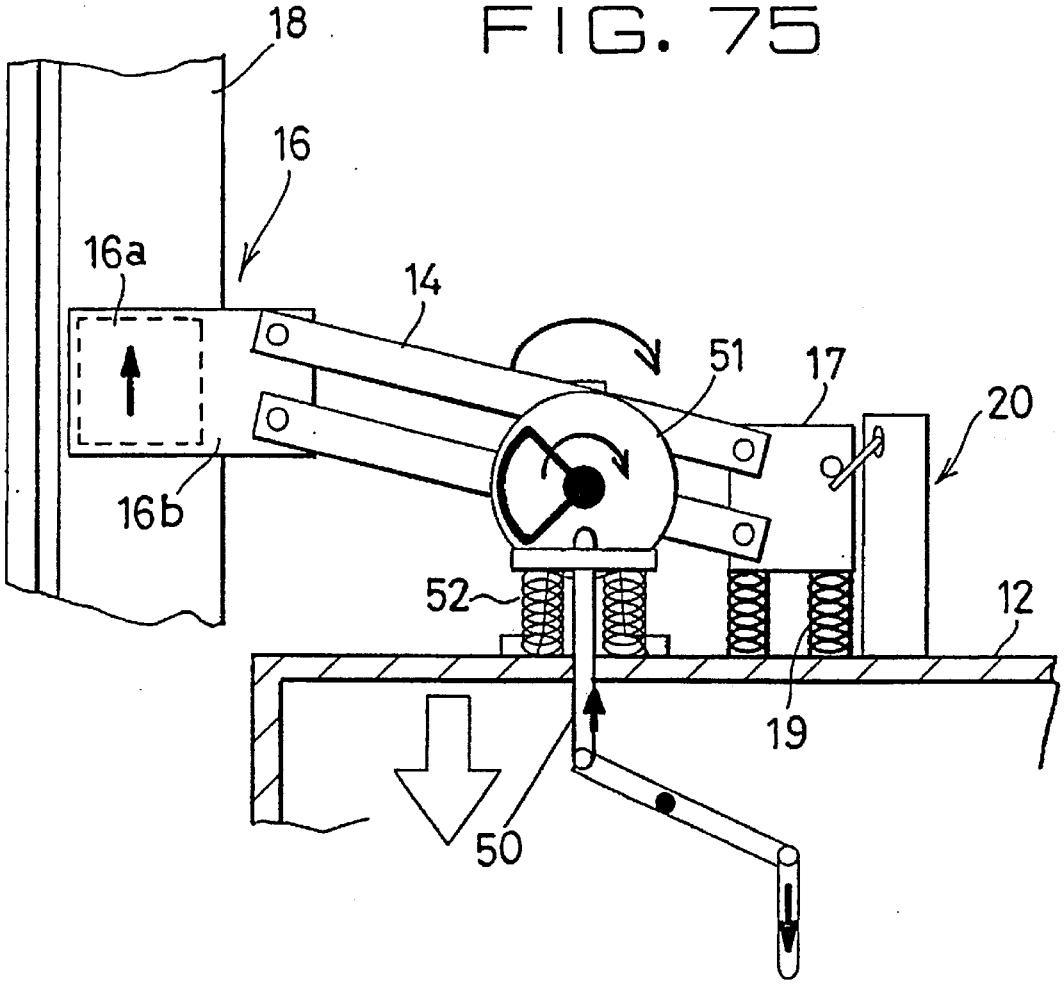
Figure 76:
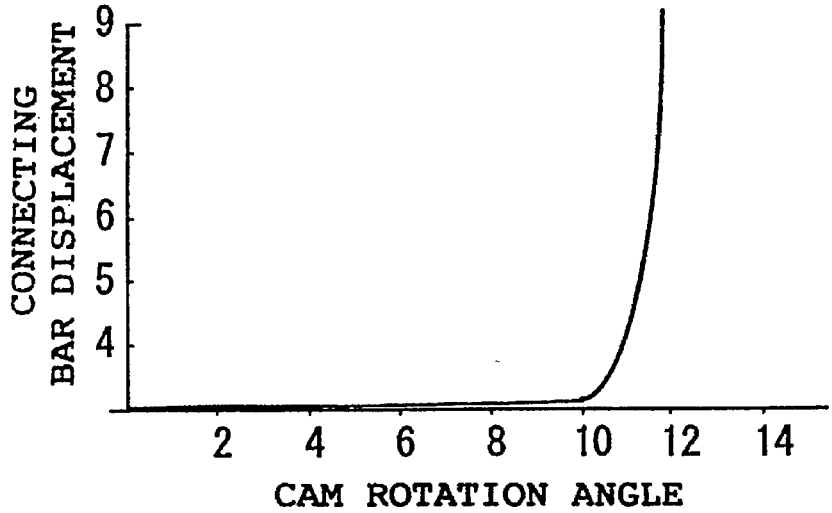
Figure 77:
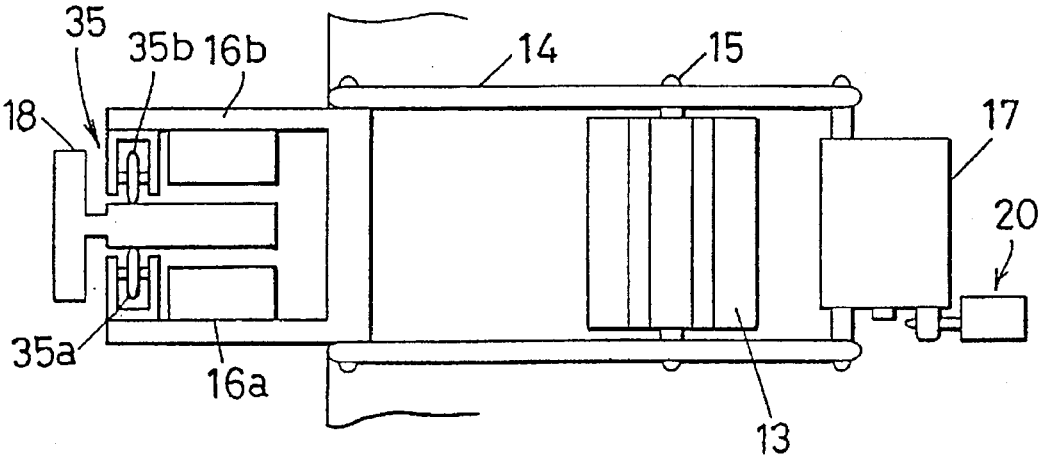
Figure 77:
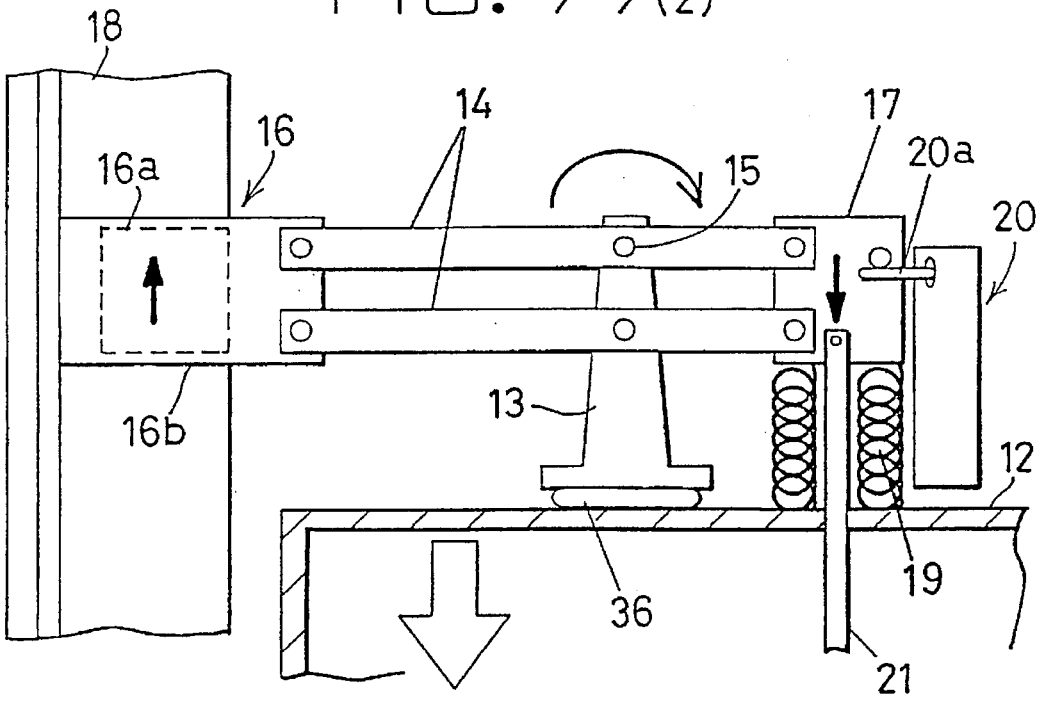
Figure 78:
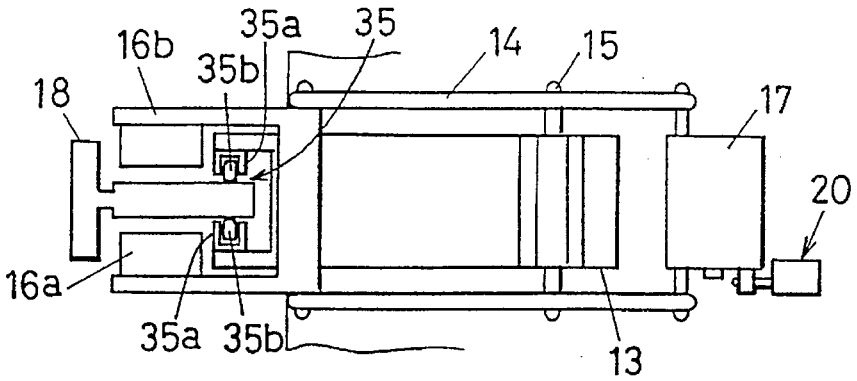
Figure 78:
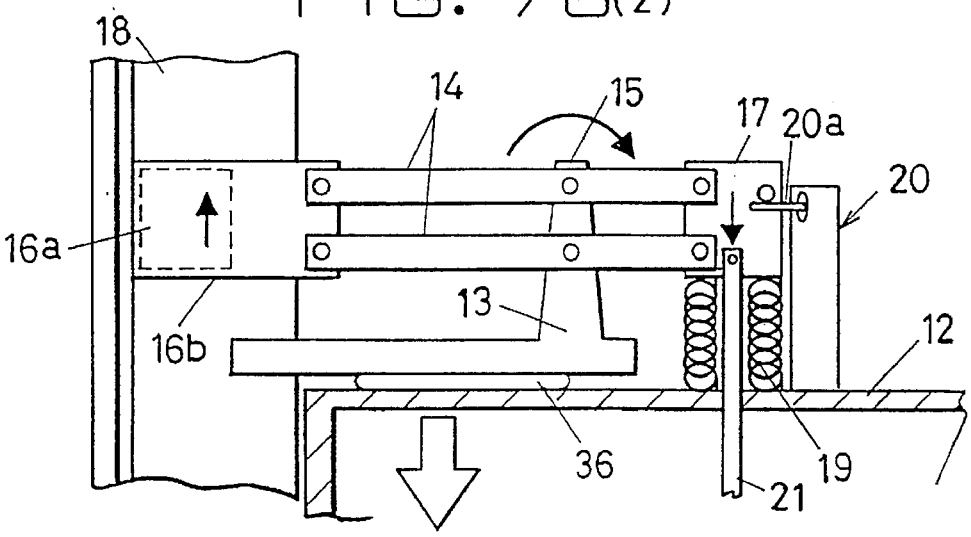
Figure 79:
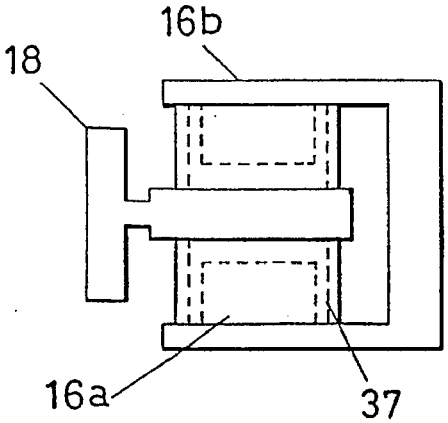
Figure 79:
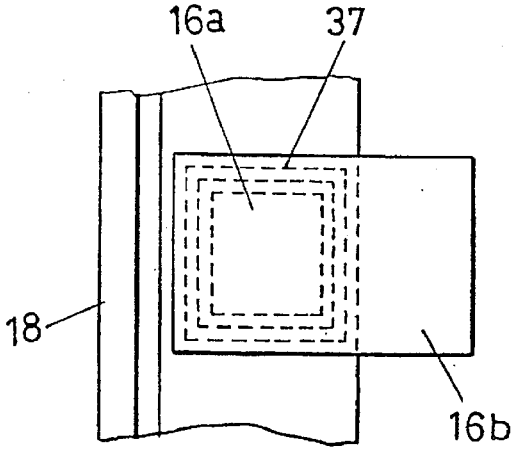
Figure 81:
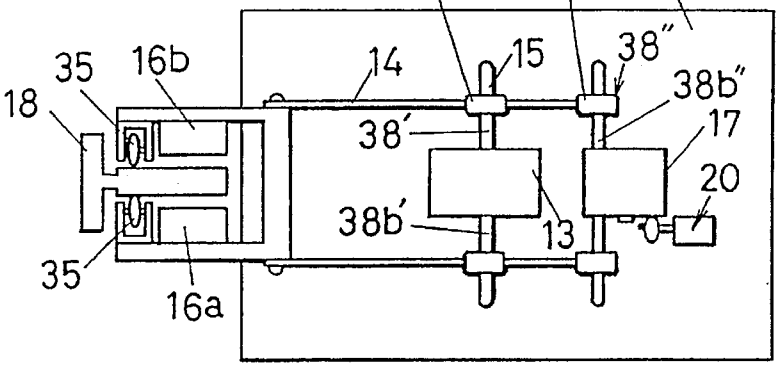
Figure 81:
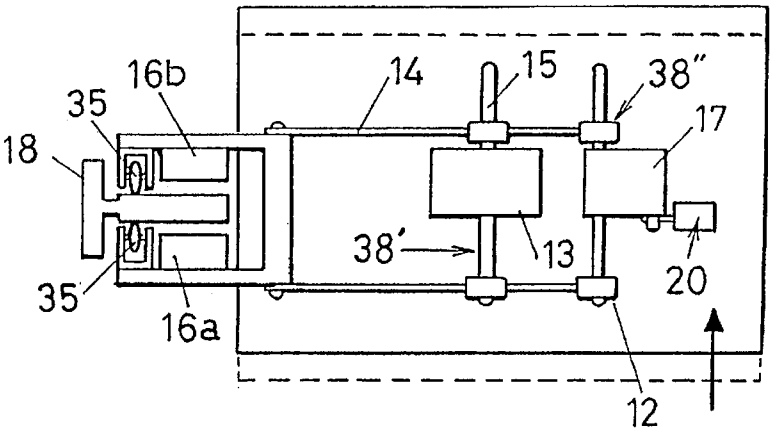
Figure 80:
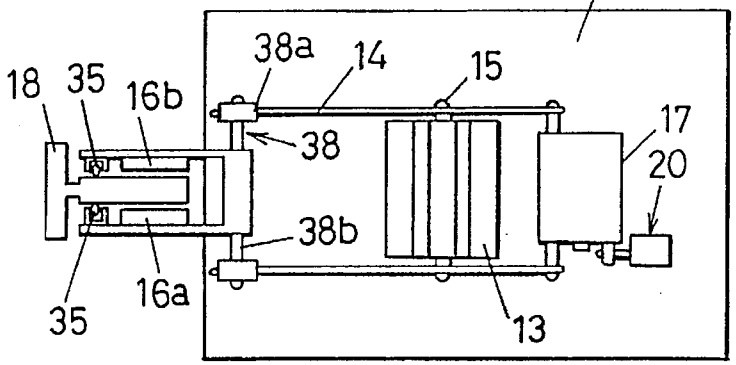
Figure 80:
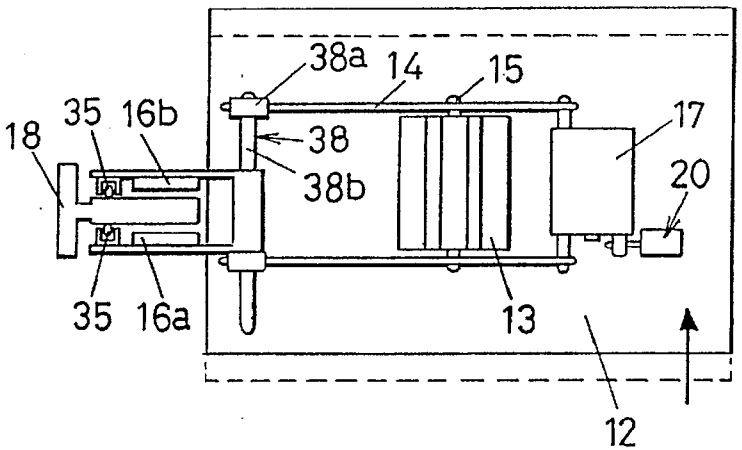
Figure 83:
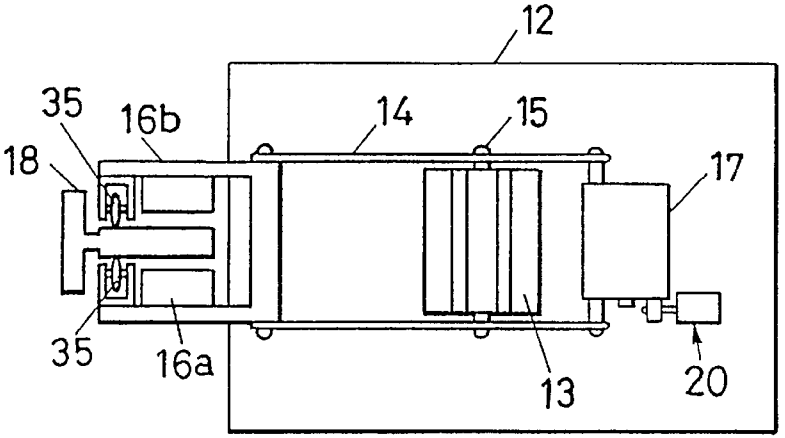
Figure 83:
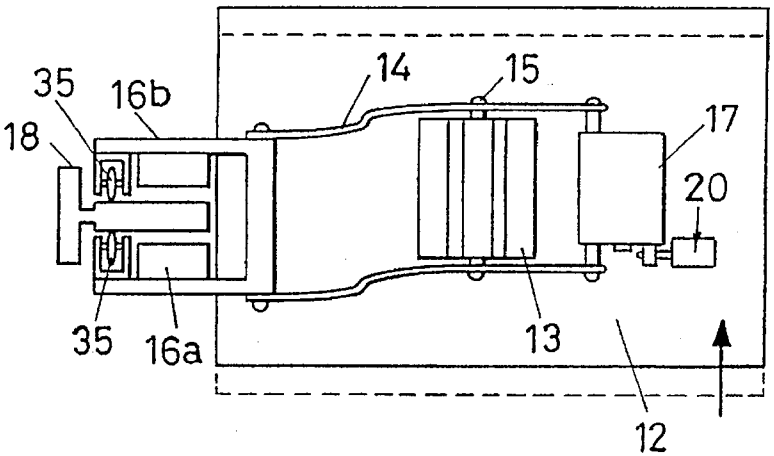
Figure 82:
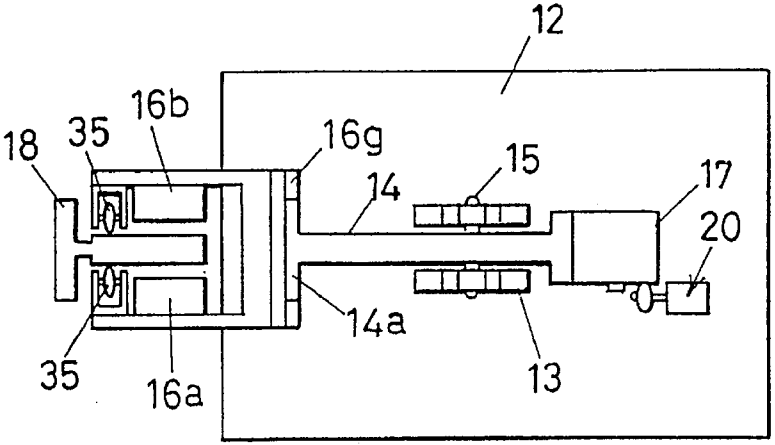
Figure 82:
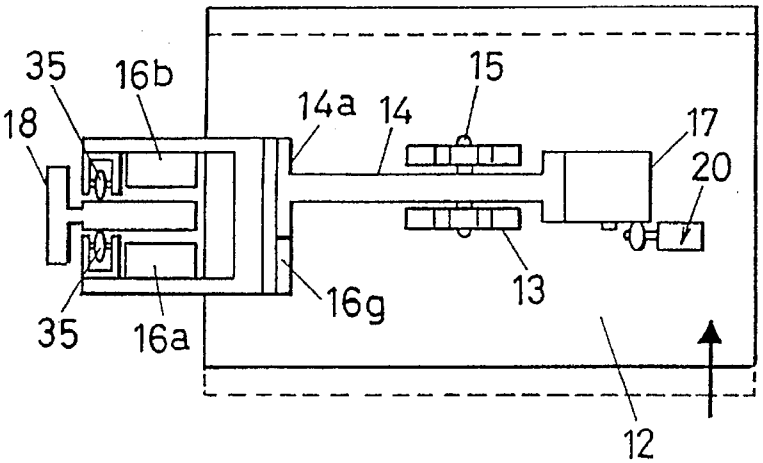
Figure 84:
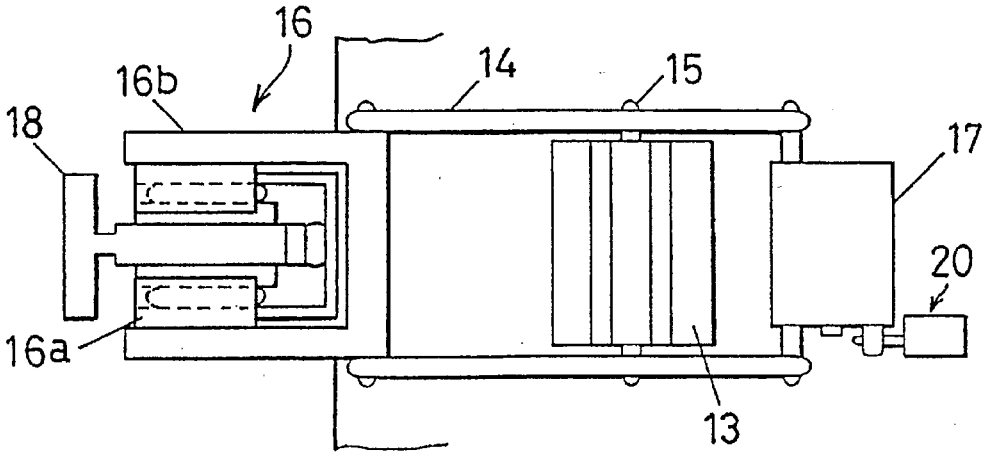
Figure 84:
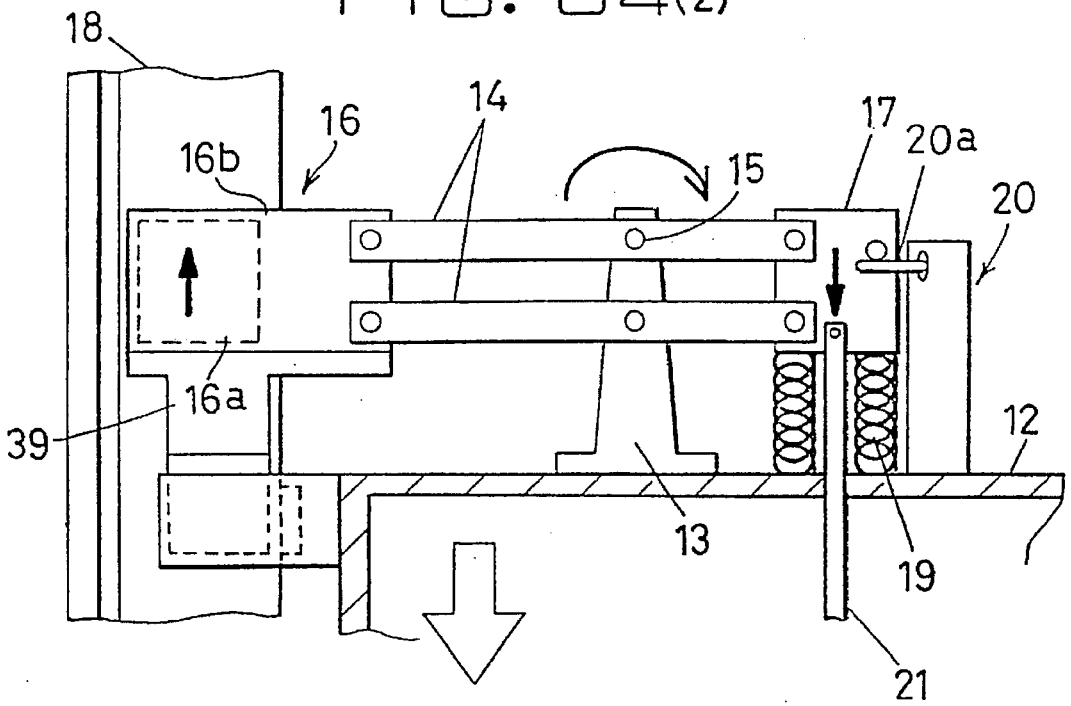
Figure 85:
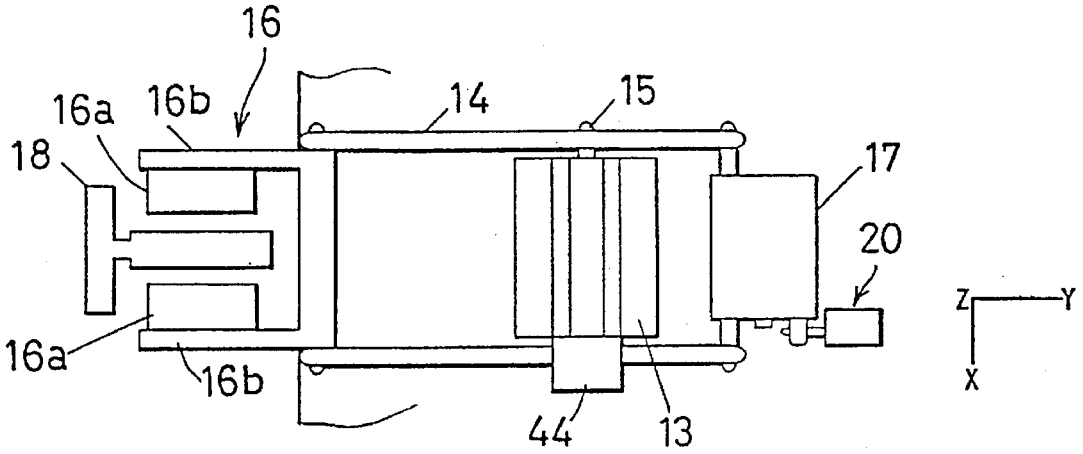
Figure 85:
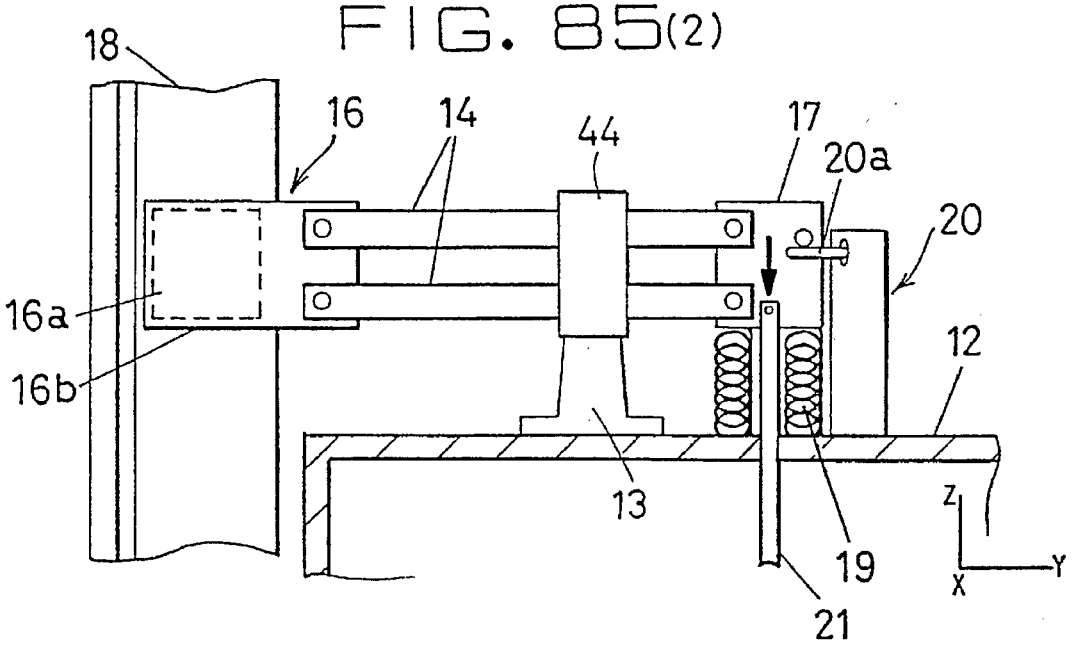
Figure 86:
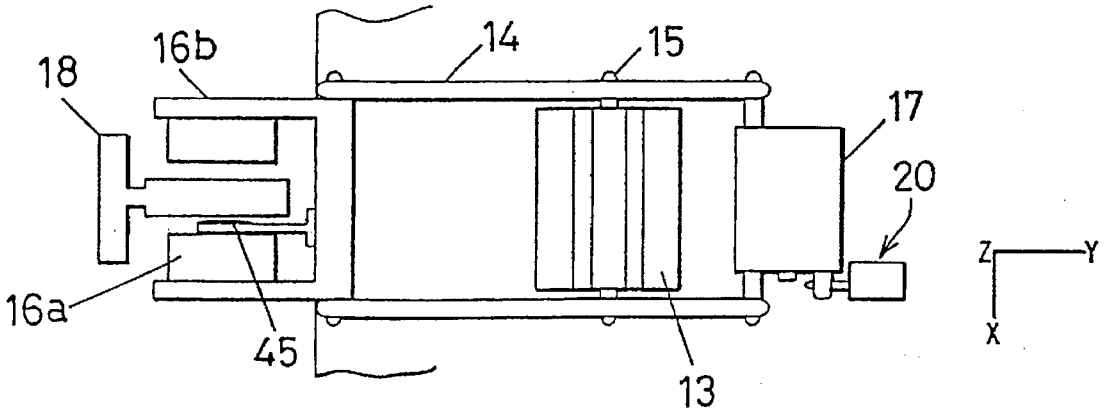
Figure 86:
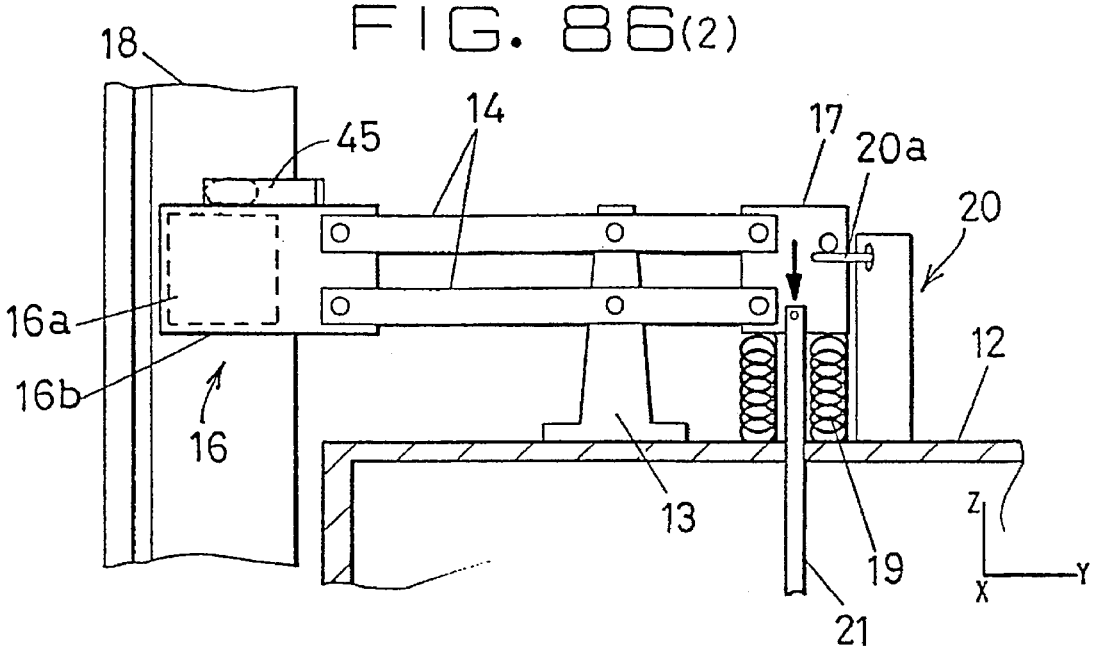
Figure 87:
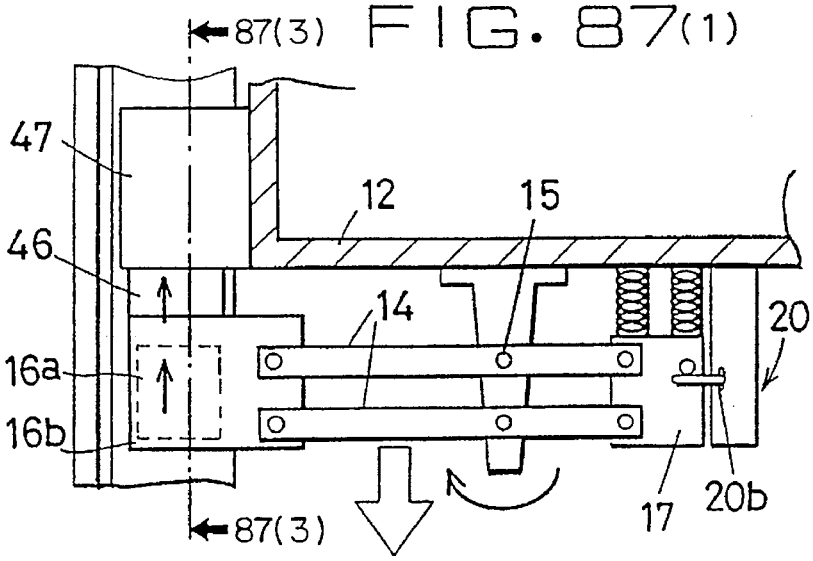
Figure 87:
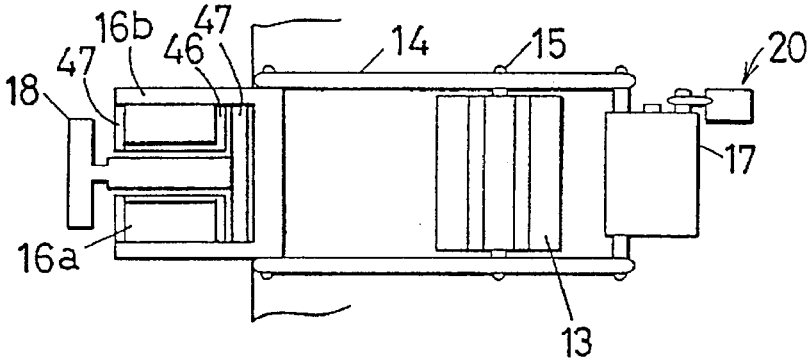
Figure 87:
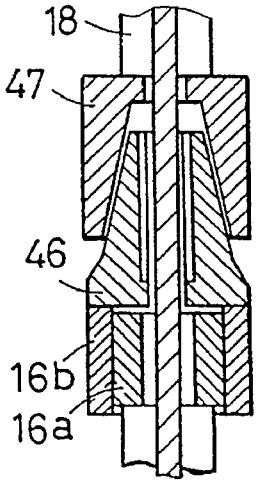
Figure 88:
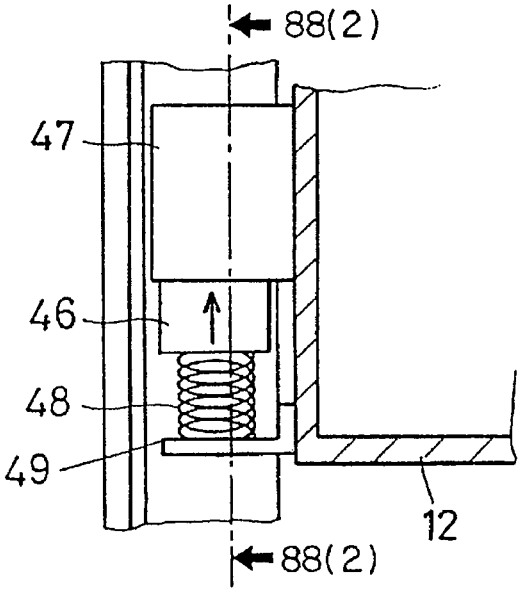
Figure 88:
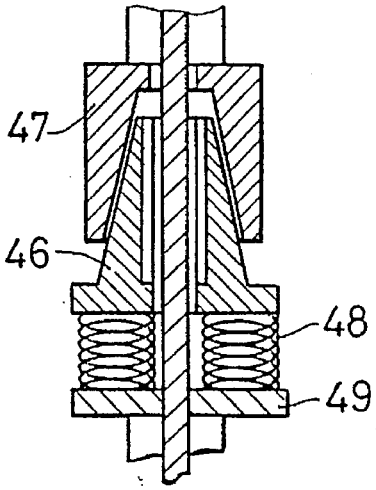
Figure 89:
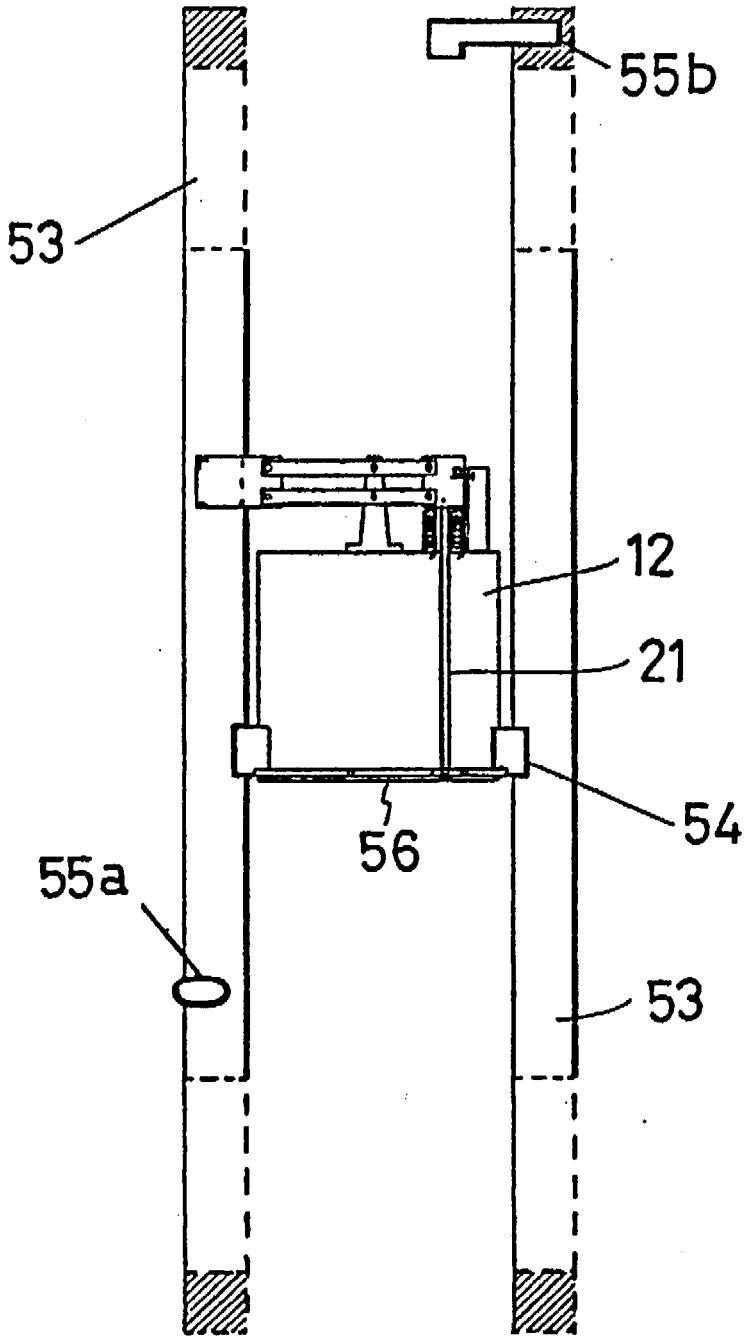
Figure 90:
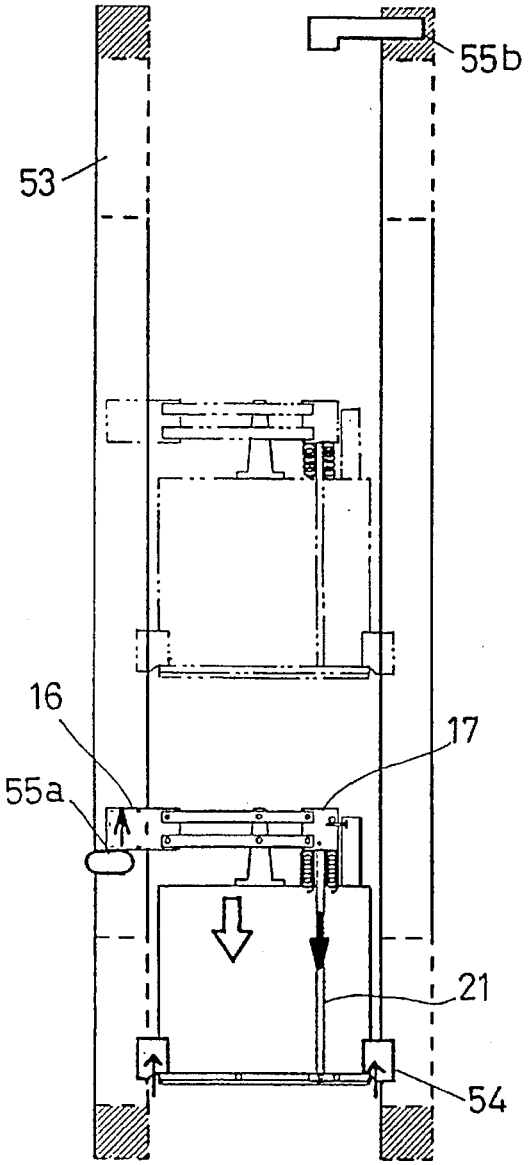
Figure 90:
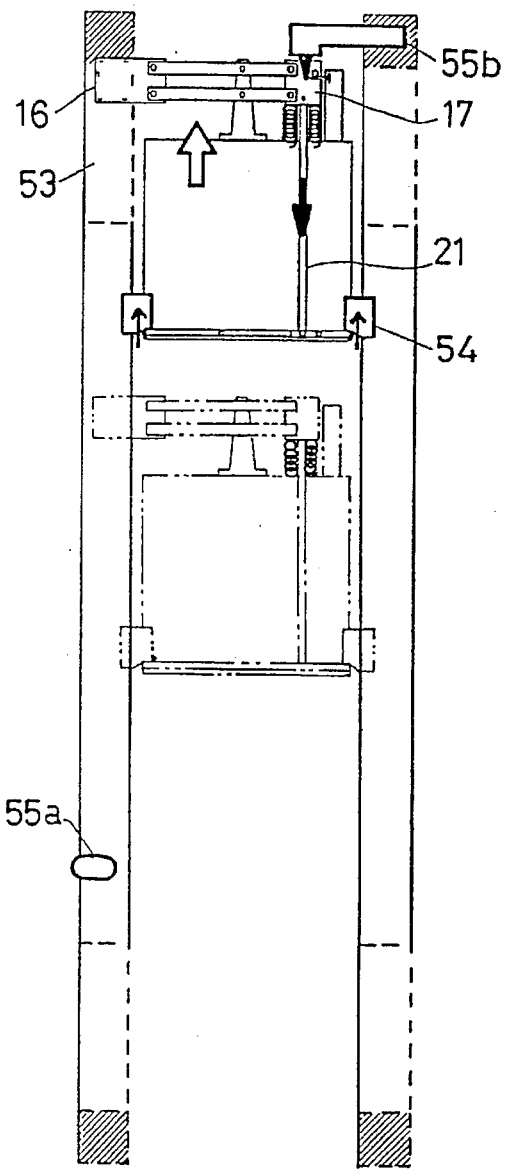
Figure 91:
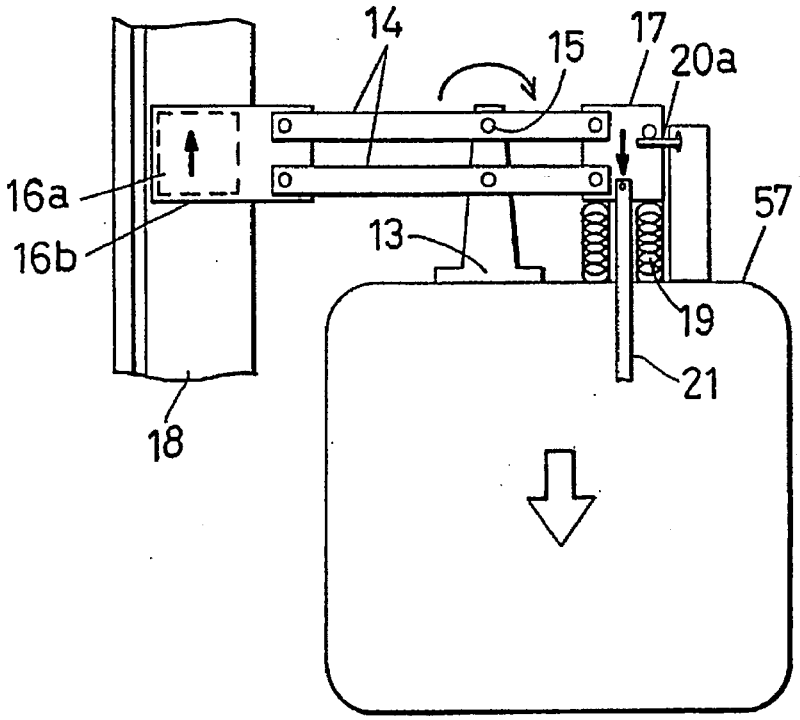
Figure 92:
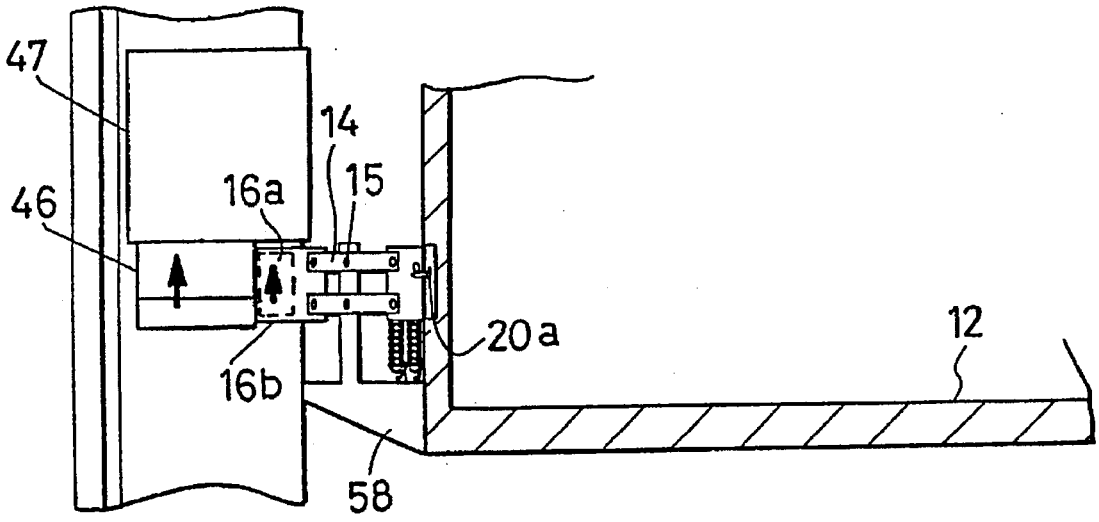
Figure 93:
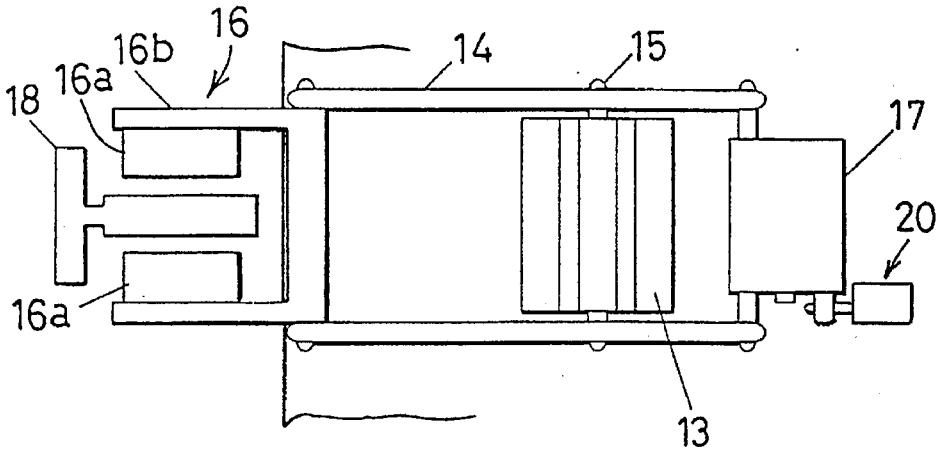
FIG. 93(1) PRIOR ART
Figure 93:
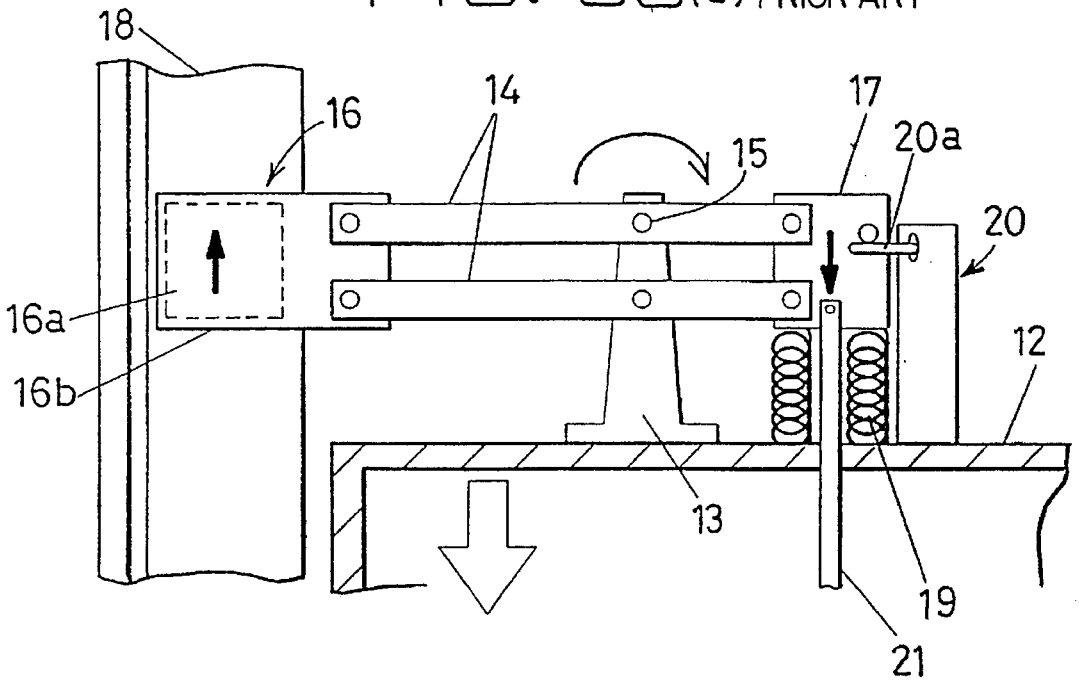
FIG. 93(2) PRIOR ART
Figure 94:
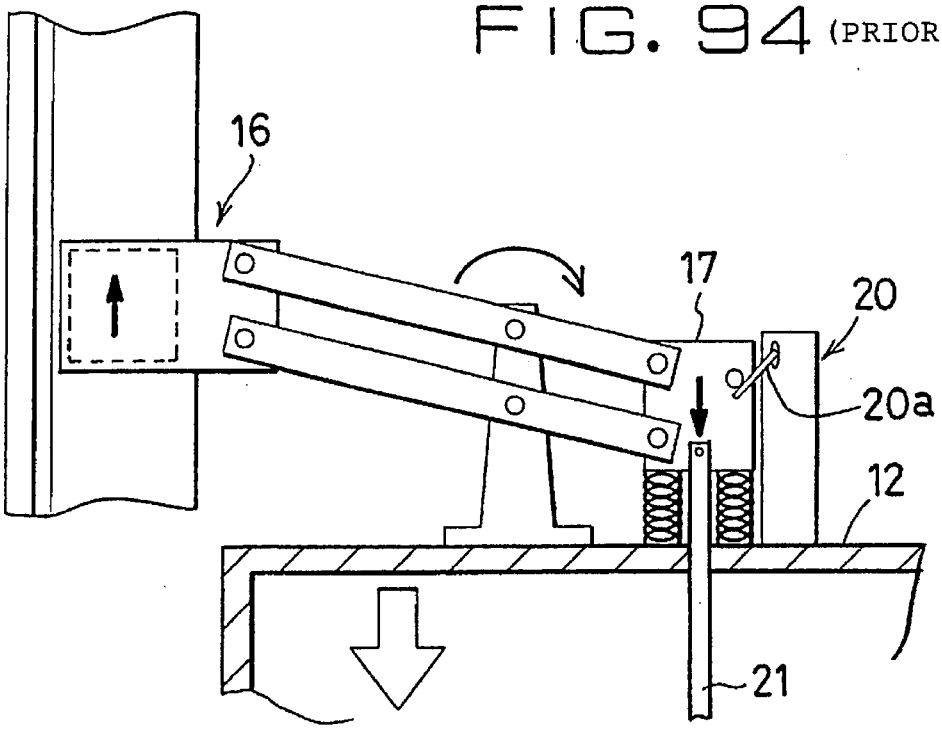
FIG. 94 (PRIOR ART)
Figure 97:
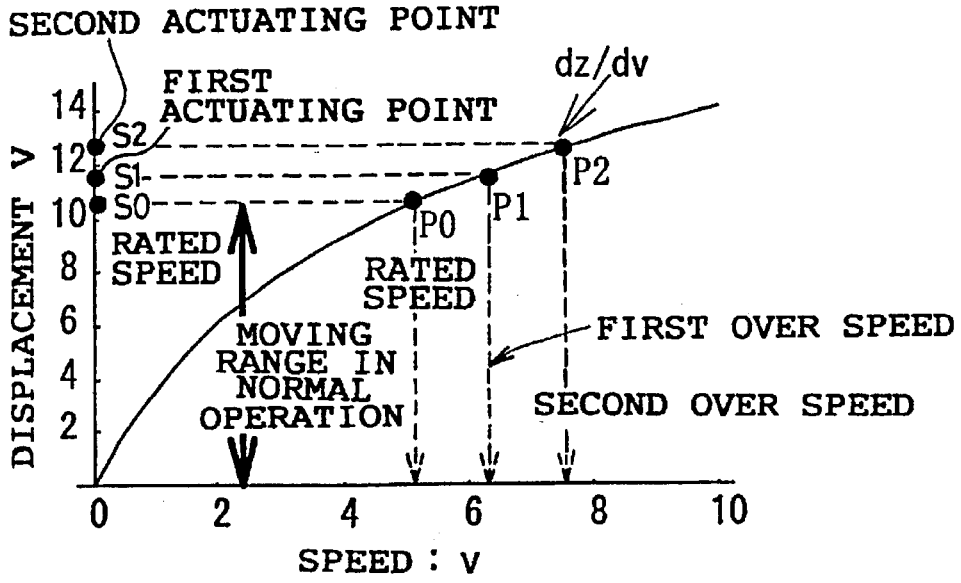
Figure 95:
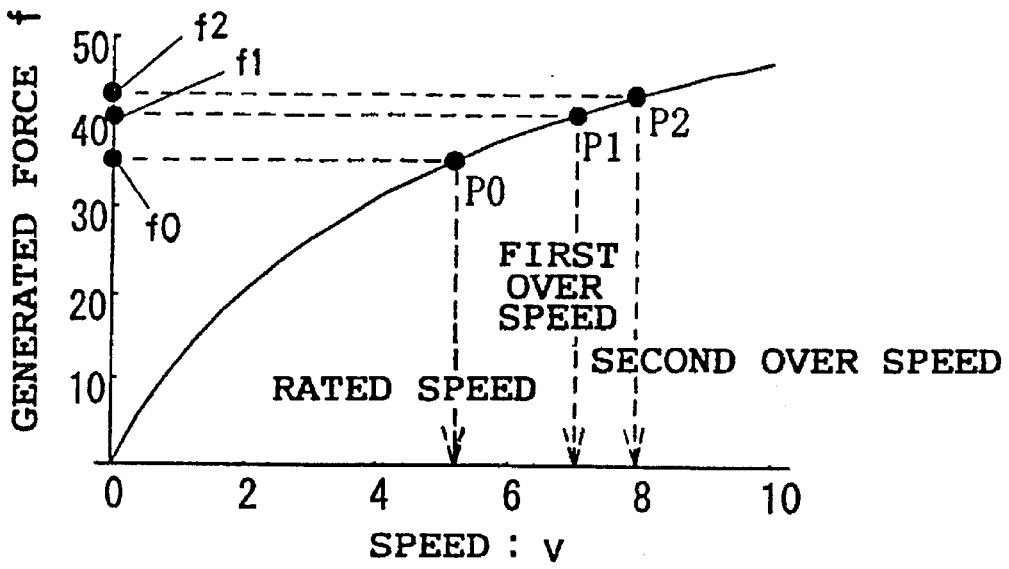
Figure 96:
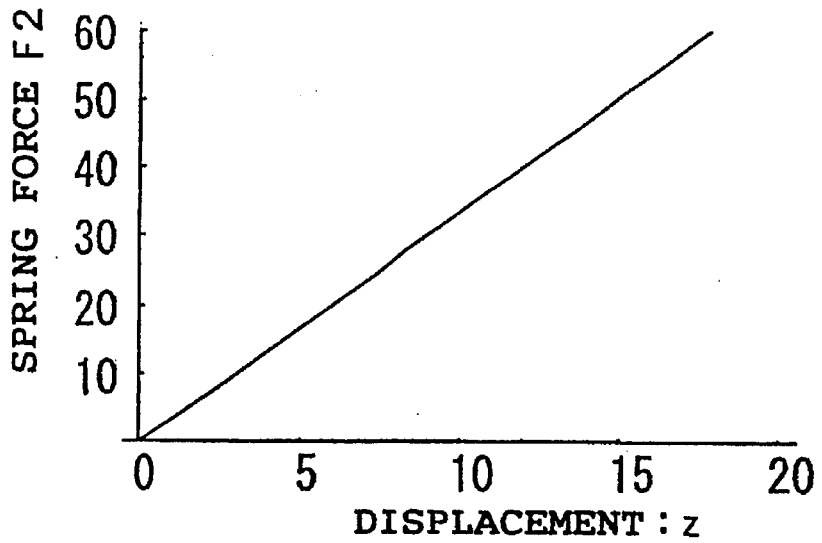

FIG. 66(1) is a diagram illustrating a characteristic of a elastic spring 19 in the embodiment 28 when the elastic spring 19 is displaced;

FIG. 66(2) is a diagram illustrating a characteristic of a elastic spring 41 in the embodiment 28 when the elastic spring 41 is displaced;

FIG. 66(3) is a diagram illustrating a characteristic of a combined spring which is a series combination of the elastic spring 19 and the elastic spring 41 of the embodiment 28 when the elastic spring 19 and the elastic spring 41 are displaced;

FIG. 67 is a diagram illustrating a displacement of a pickup portion with respect to a speed of a car in the embodiment 28;

FIG. 68(1) is a plan view showing a construction of an embodiment 29 of the present invention;

FIG. 68(2) is a front elevational view showing a construction of the embodiment 29;

FIG. 69 is a flow chart illustrating an algorithm wherein an actuator spring and a control apparatus of the embodiment 29 control a displacement of a balance weight;

FIG. 70(1) is a plan view showing a construction of an embodiment 30 of the present invention;

FIG. 70(2) is a front elevational view showing a construction of the embodiment 30;

FIG. 71 is a front elevational view showing a condition in which an arm in the embodiment 30 is pivoted clockwise;

FIG. 72 is a diagram illustrating a displacement of a cam portion with respect to an angle of rotation of a cam in the embodiment 30;

FIG. 73 is a diagram illustrating a displacement of a connection rod with respect to a car speed of the embodiment 30;

FIG. 74(1) is a plan view showing a construction of an embodiment 31 of the present invention;

FIG. 74(2) is a front elevational view showing a construction of the embodiment 31;

FIG. 75 is a front elevational view showing a condition in which a cam in the embodiment 31 is rotated;

FIG. 76 is a diagram illustrating a displacement of a connection rod with respect to an angle of rotation of the cam in the embodiment 31;

FIG. 77(1) is a plan view showing a construction of an embodiment 32 of the present invention;

FIG. 77(2) is a front elevational view showing a construction of the embodiment 32;

FIG. 78(1) is a plan view showing a construction of an embodiment 33 of the present invention;

FIG. 78(2) is a front elevational view showing a construction of the embodiment 33;

FIG. 79(1) is a plan view showing a construction only of a pickup portion in an embodiment 34 of the present invention;

FIG. 79(2) is a front elevational view showing a construction of the pickup portion in the embodiment 34 of the present invention;

FIG. 80(1) is a plan view showing a condition in which a car in an embodiment 35 of the present invention is not displaced with respect to a conductor;

FIG. 80(2) is a plan view showing a condition in which the car in the embodiment 35 of the present invention is displaced in the direction indicated by an arrow mark with respect to a conductor;

FIG. 81(1) is a plan view showing a condition in which a car in an embodiment 36 of the present invention is not displaced with respect to a conductor;

FIG. 81(2) is a plan view showing a condition in which the car in the embodiment 36 of the present invention is displaced with respect to a conductor;

FIG. 82(1) is a plan view showing a condition in which a car in an embodiment 37 of the present invention is not displaced with respect to a conductor;

FIG. 82(2) is a plan view showing a condition in which the car in the embodiment 37 of the present invention is displaced with respect to a conductor;

FIG. 83(1) is a plan view showing a condition in which a car in an embodiment 38 of the present invention is not displaced with respect to a conductor;

FIG. 83(2) is a plan view showing a condition in which the car in the embodiment 38 of the present invention is displaced with respect to a conductor;

FIG. 84(1) is a plan view showing a construction of an embodiment 39 of the present invention;

FIG. 84(2) is a front elevational view showing a construction of the embodiment 39;

FIG. 85(1) is a plan view showing a construction of an embodiment 40 of the present invention;

FIG. 85(2) is a front elevational view showing a construction of the embodiment 40;

FIG. 86(1) is a plan view showing a construction of an embodiment 41 of the present invention;

FIG. 86(2) is a front elevational view showing a construction of the embodiment 41;

FIG. 87(1) is a front elevational view showing a construction of an embodiment 42 of the present invention;

FIG. 87(2) is a plan view showing a construction of the embodiment 42;

FIG. 87(3) is a sectional view taken along line A—A of the front elevational view of FIG. 87(1);

FIG. 88(1) is a front elevational view showing a construction of an embodiment 43 of the present invention;

FIG. 88(2) is a sectional view taken along line A—A of the front elevational view of FIG. 88(1);

FIG. 89 is a front elevational perspective view showing an embodiment 44 of the present invention;

FIG. 90(1) is a front elevational perspective view showing a condition in which a car in the embodiment 44 enters in a pit portion;

FIG. 90(2) is a front elevational perspective view when a car in the embodiment 44 enters a pit portion;

FIG. 91 is a front elevational view showing a construction of an embodiment 45 of the present invention;

FIG. 92 is a front elevational view showing a construction of an embodiment 46 of the present invention;

FIG. 93(1) is a plan view showing an example of a conventional elevator speed controller;

FIG. 93(2) is a front elevational view of the conventional example of FIG. 93(1);

FIG. 94 is a front elevational view showing a condition in which a conventional arm shown in FIG. 93 is inclined;

FIG. 95 is a diagram illustrating a generated force generated in a pickup portion of the conventional example of FIG. 93;

FIG. 96 is a diagram illustrating a spring force of a elastic spring with respect to a displacement of the pickup portion of the conventional example shown in FIG. 93; and FIG. 97 is a diagram illustrating a displacement of the pickup portion with respect to a speed of a car of the conventional example of FIG. 93.

DETAILED DESCRIPTION OF THE PREFERRED EMBODIMENTS

In the following, several preferred embodiments of the present embodiment will be described in detail below with reference to the drawings. It is to be noted that components of each embodiment same as or corresponding to the components of previous embodiments prior to the embodiment are denoted by like reference characters and overlapping description of them is omitted herein to avoid redundancy.

Embodiment 1

Figure 1:
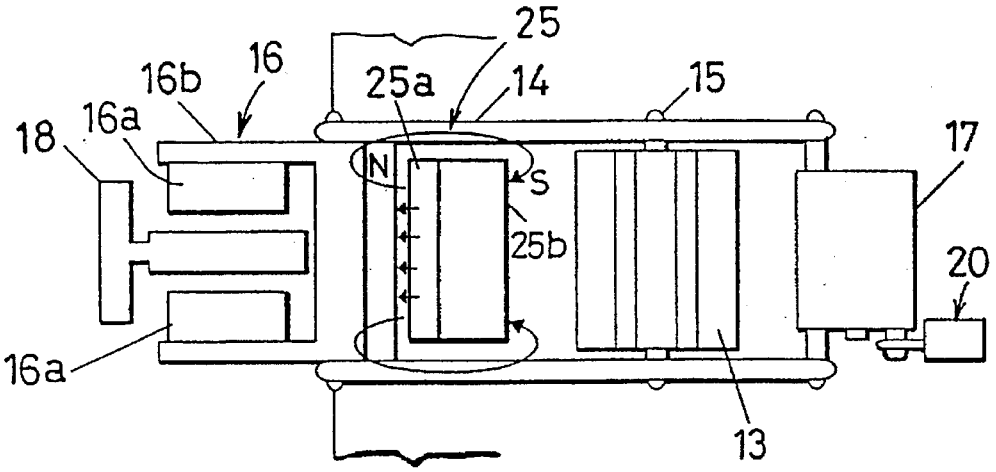
FIG. 1(1) is a plan view showing an embodiment 1 of the present invention.
Figure 1:
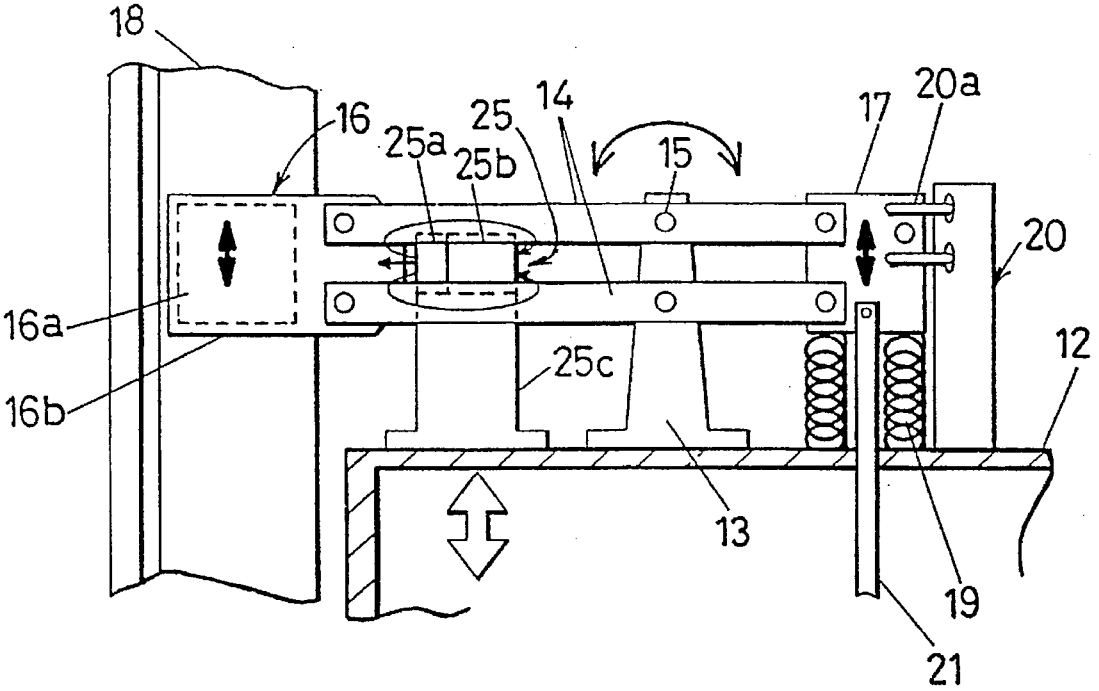
Figure 2:
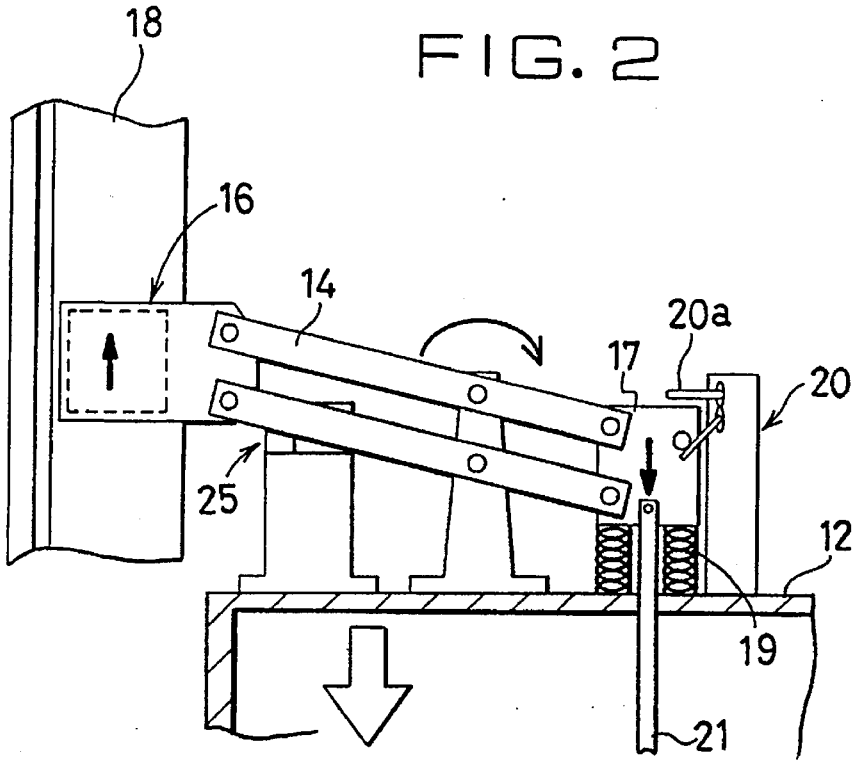
FIG. 2 is a front elevational view showing a condition in which an arm of the embodiment 1 is inclined.

Referring to FIGS. 1(1) and 1(2), reference character 12 denotes a car of an elevator, 13 a base provided on the car 12, 14 an arm formed form a pair of parallel links, 15 a fulcrum provided on the base 13 for supporting the arm 14 for pivotal motion, 16 a pickup mounted for pivotal motion at an end of the arm 14 for detecting the speed of the car 12, 16*a* a pair of magnets provided in an opposing relationship to each other, 16*b* a yoke to which the magnets 16*a* are secured, 17 a balance weight provided at the other end of the arm 14 so as to be balanced with the pickup 16, and 18 a conductor such as a guide rail provided fixedly alongside the car 12, and magnetic fluxes going out of the magnets 16*a* of the pickup 16 pass a plate-formed portion extending from the center of the conductor 18 toward the car 12 and the yoke 16*b* to form a first magnetic circuit. Further, reference numeral 19 denotes a elastic spring for providing a drag to a displacement of the balance weight 17 by pivotal motion of the arm 14, and the arm 14, the fulcrum 15, the pickup 16, the balance weight 17 and the elastic spring 19 form a conversion apparatus which converts a force generated by eddy currents generated in the conductor 18 when the car 12 runs and acting upon the magnets 16*a* into a displacement of the magnets 16*a* in the running direction of the car 12. Reference numeral 20 denotes a brake apparatus which includes a car stopping switch 20*a* which operates in response to a displacement of the balance weight 17 and an emergency stopping operation mechanism not shown, 25 a magnetic spring for generating a force to return the pickup 16 into its balanced condition, 25*a* a magnet, 25*b* a yoke, and 25*c* a base for securing the magnet 25*a* and the yoke 25*b* to the car 12, and a magnetic path of the magnetic spring 25 is formed by the magnet 25*a*, the yoke 25*b* and the yoke 16*b*. As shown in FIGS. 1(1) and 1(2), the pickup 16 and the magnetic spring 25 are separate from each other with a gap left therebetween, and when the arm 14 is in its horizontal position, the pickup 16 and the magnetic spring 25 are positioned closest to each other. The magnetic spring 25 is connected to the base 25*c* so that, even if the car 12 moves and the yoke 16*b* is pivoted around the fulcrum 15, the magnetic spring 25 is not turned, and consequently, if the car 12 moves to pivot the arm 14 to an oblique position as seen in FIG. 2, the pickup 16 and the magnetic spring 25 are spaced away from each other.

Reference numeral 21 denotes a connection rod for rendering emergency stopping operative, and when the speed of the car 12 exceeds an over speed so that the car 12 enters a dangerous condition, the pickup 16 and the balance weight 17 are displaced by a great extent in the upward or downward direction by the arm 14 and the elastic spring 19, whereupon the emergency stopping mechanism connected to the car stopping switch 20*a* and the connection rod 21 is rendered operative to stop the car 12 immediately.

Subsequently, operation will be described. When the magnetic field by the magnets 16*a* and the yoke 16*b* moves in the conductor 18, a force (drag) in a direction to act against the movement of the car 12 is generated in the pickup 16 with a magnitude corresponding to the speed of the car 12. This force is converted into a displacement in the upward or downward direction of the pickup 16 and the balance weight 17 by the arm 14 and the elastic spring 19. This principle is the same as the principle of the conventional elevator speed controller.

As described hereinabove, such a system which makes use of eddy currents as described above has a subject to be solved in that, when the speed is low, since the drag generated is so great that the arm 14 is pivoted by a great extent even if the speed is within a rated speed, a safety apparatus may possibly malfunction discriminating the speed then as an over speed in error due to a disturbance, an error in setting or the like.

Thus, in the embodiment 1, the magnetic spring 25 which is a non-linear spring by which, when the arm 14 is near to its horizontal position, a strong force acts in a direction to keep the arm 14 to its horizontal position is provided so that, when the speed is low, the arm 14 exhibits a small amount of pivotal motion, but when the arm 14 is pivoted to some extent, the spring force is reduced and the pivotal motion of the arm 14 is increased, thereby decreasing occurrence of a malfunction and increasing the life. In particular, in the embodiment 1, a non-linear spring having such a characteristic as described below is formed by providing, rearwardly of the pickup 16, the magnetic spring which generates a force to attract the pickup 16.

Figure 3:
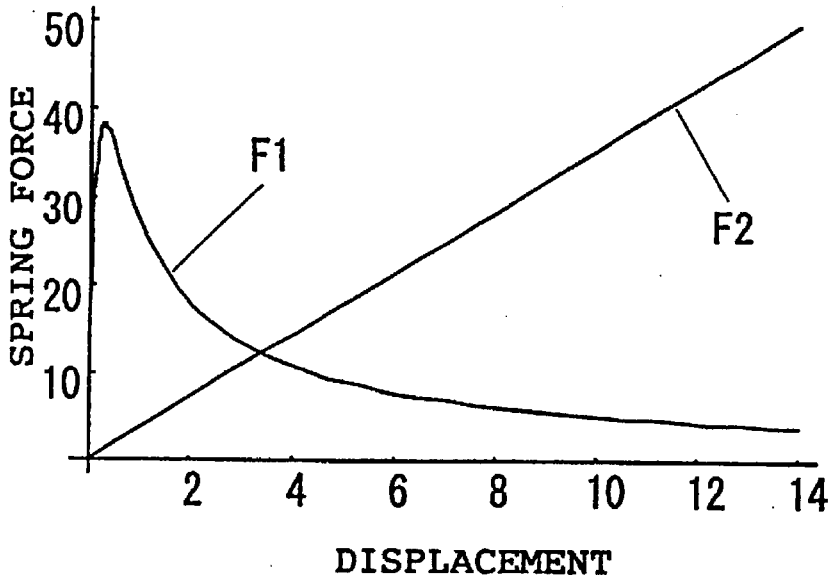
FIG. 3 is a diagram illustrating a relationship of a spring force generated in a elastic spring and a magnetic spring with respect to a displacement of a pickup of the embodiment 1.
Figure 4:
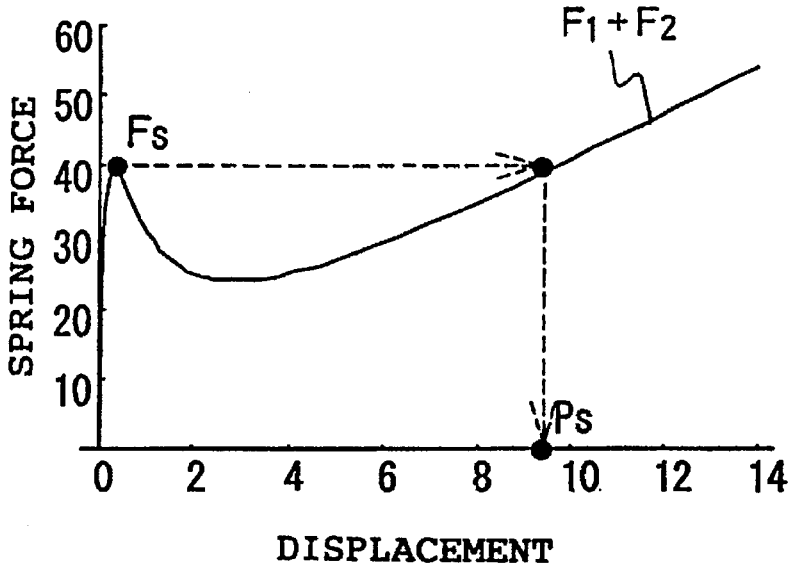
FIG. 4 is a diagram illustrating a combined spring force of the elastic spring and the magnetic spring of FIG. 3.

Due to the physical property of magnetism, the magnetic spring force F1 of the magnetic spring 25 is varied by a great extent by a small displacement, and then as the displacement increases, the rate of variation decreases as seen in FIG. 3. Meanwhile, the elastic spring force F2 of the elastic spring 19 is normally linear with respect to the displacement as seen in FIG. 3. In the embodiment 1, the spring forces F1 and F2 are combined so that such a non-linear spring as seen in FIG. 4 is formed. This non-linear spring exerts a strong force (exhibits a high spring constant) when the displacement is small, but does not exhibit a great increase (exhibits a low spring constant) after the displacement exceeds a certain magnitude.

Figure 5:
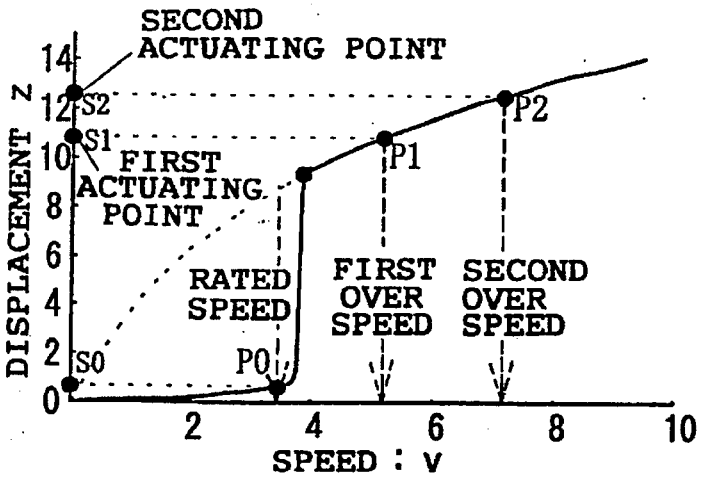
FIG. 5 is a diagram illustrating a displacement of a pickup with respect to a speed of a car of the embodiment 1.

Since the generated force generated by the pickup 16 with respect to the speed of the car 12 exhibits such a variation as shown in FIG. 95, such a relationship between the speed of the car 12 and the displacement of the pickup 16 as seen in FIG. 5 is provided by the non-linear spring formed by the magnetic spring 25 and the elastic spring 19 of FIG. 4. As the speed rises, the drag by eddy currents of the pickup 16 increases. However, up to a speed Vs at which this force exceeds the spring force Fs of FIG. 4, the arm 14 is held from pivotal motion by a high magnetic force by the magnetic spring 25, and also the displacement of the pickup 16 is small at P0. After the speed exceeds a rated speed V0, the generated force generated by the pickup 16 exceeds the combined spring force F1+F2, and the pickup 16 is displaced and the magnetic spring force F1 is reduced as seen in FIG. 3. Consequently, the combined spring force is reduced as seen in FIG. 4, and the pickup 16 and the balance weight 17 are displaced at a stroke to the position of Ps of FIG. 4 at which they can be held by the force of the elastic spring 19. Thereafter, the pickup 16 and the balance weight 17 exhibit a displacement governed by the spring force F2 of the elastic spring 19.

Here, if the spring force Fs which is a primary peak value of the combined spring force F1+F2 is set higher than the value of the generated force f0 at the rated speed of FIG. 95 and lower than the value of the generated force f1 at the first over speed (that is, a first dangerous speed) V1, then there is an advantage in that a small displacement is obtained in an ordinary rated operation, but a great displacement is obtained when an emergency occurs. Further, if a rising point is provided between the first over speed V1 and the second over speed (that is, a second dangerous speed) V2, then there is another advantage in that the emergency stop can be operated with certainty.

From the foregoing, with the present embodiment 1, the displacement P0 of the pickup 16 within the rated speed can be reduced comparing with that of the conventional example, and since a large difference is taken between displacements at the first over speed V1 and the second over speed V2, the probability of a malfunction is reduced.

Embodiment 2

Figure 6:
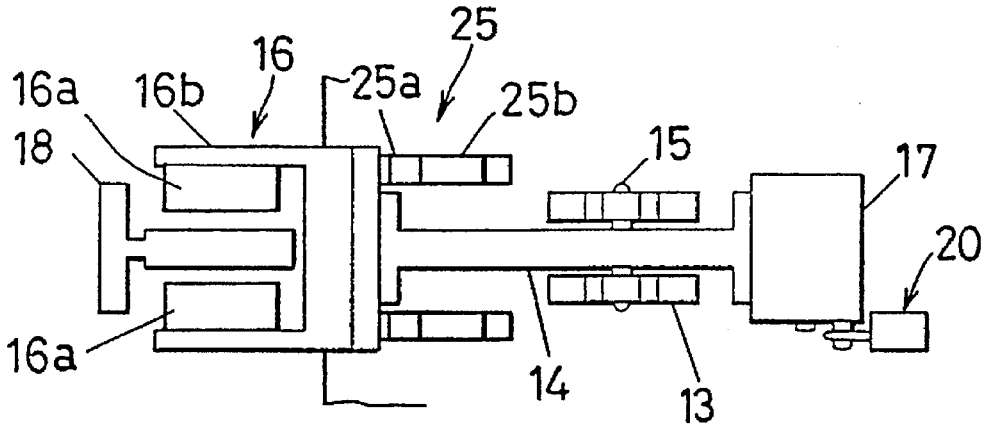
FIG. 6(1) is a plan view showing an embodiment 2 of the present invention.
Figure 6:
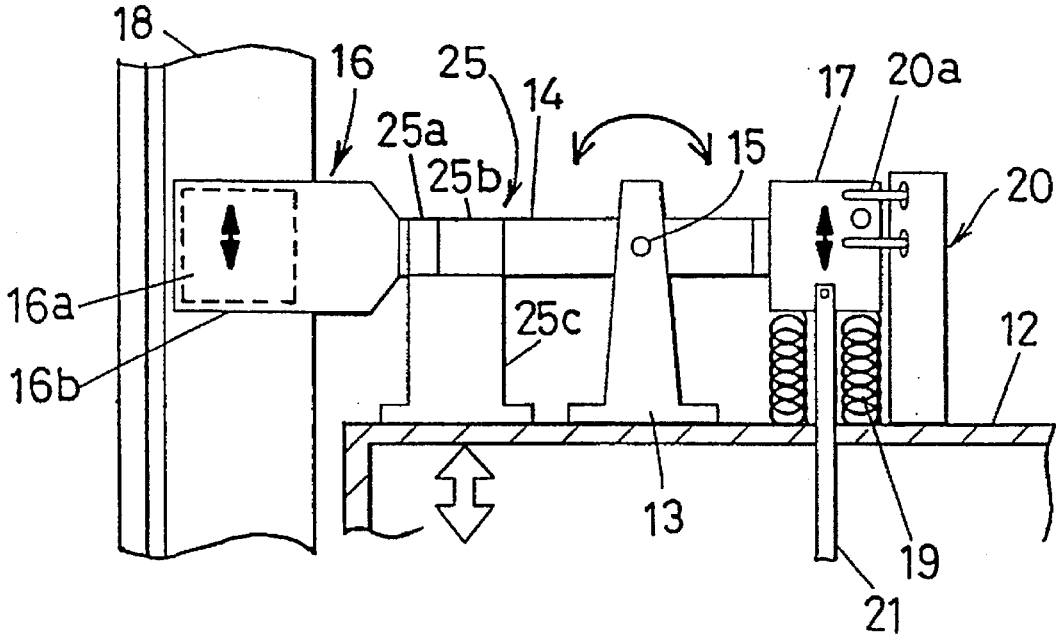

While the arm 14 in the embodiment 1 is formed as parallel links, in the present embodiment 2, the arm 14 is formed by a single link interconnecting the pickup 16 and the balance weight 17 as shown in FIGS. 6(1) and 6(2). Due to the present construction, the arm 14 is simplified in construction and can be formed by a reduced number of parts and at a reduced cost.

Embodiment 3

Figure 7:
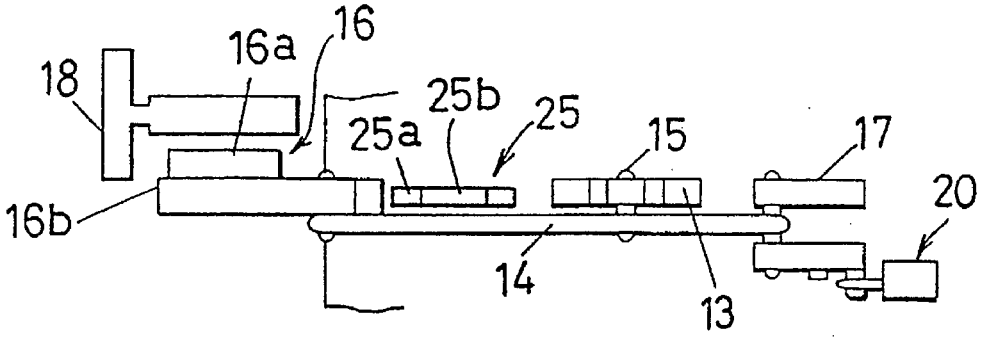
FIG. 7(1) is a plan view showing an embodiment 3 of the present invention.
Figure 7:
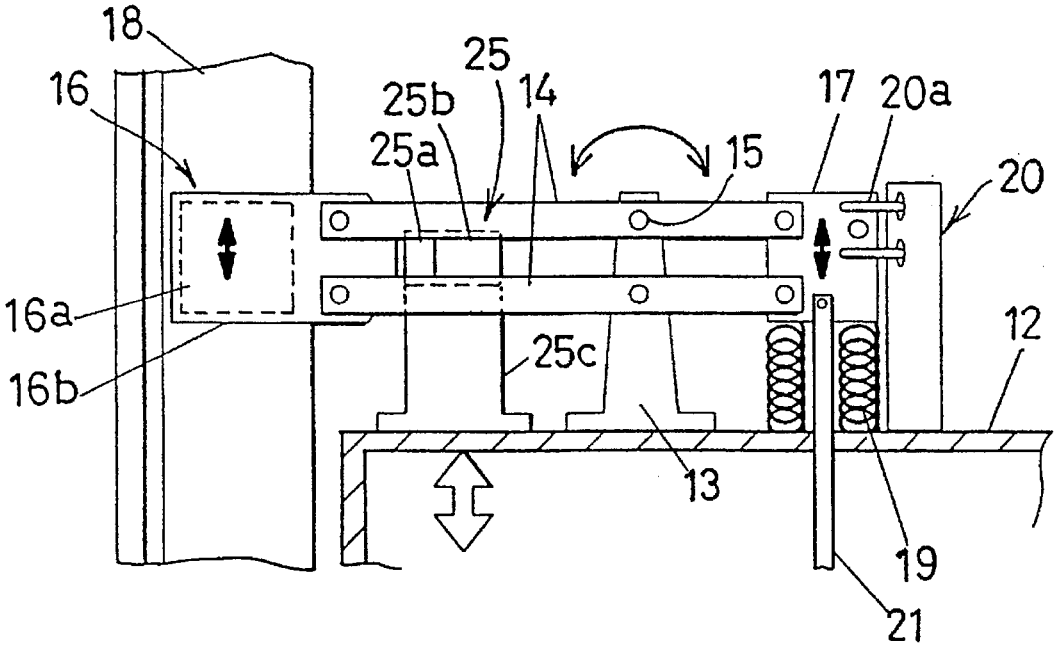

While, in the embodiment 1, the magnets **16*a* are provided on the opposite sides of the conductor 18 such that the conductor 18 is held between the magnets 16*a*, in the present embodiment 3, a magnets 16*a* is provided on only one side of the conductor 18 as shown in FIGS. 7(1) and 7(2). Due to this construction, the magnetic circuit of the pickup 16 is simplified in construction, and the number of parts can be reduced and the cost can be reduced. Further, since the pickup 16** is reduced in weight, the dynamic response thereof is improved.

Embodiment 4

Figure 8:
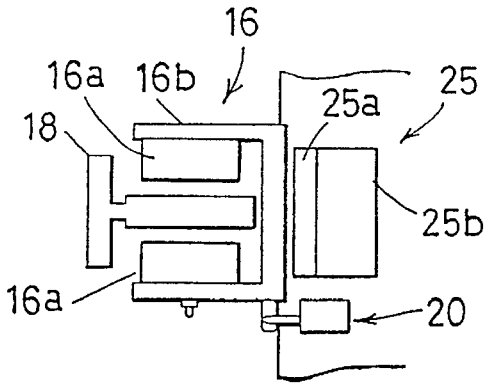
FIG. 8(1) is a plan view showing an embodiment 4 of the present invention.
Figure 8:
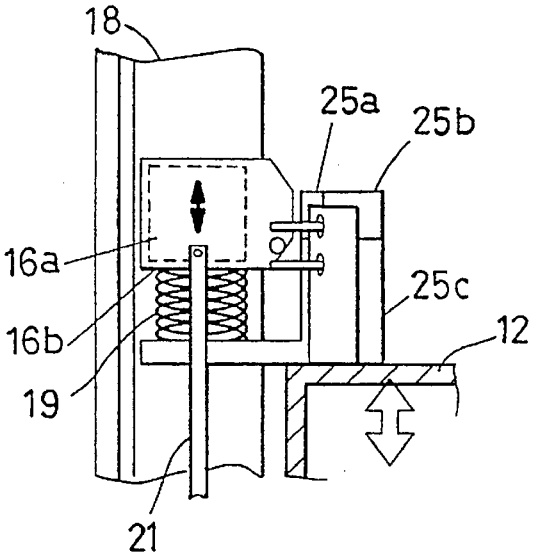

While the embodiment 1 has the construction which includes the balance weight 17, in the embodiment 4, as shown in FIGS. 8(1) and 8(2), the arm 14, the base 13 and the balance weight 17 are not provided, but the pickup 16 is carried on the car 12 by way of the elastic spring 19 while the magnetic spring 25 is provided rearwardly of the pickup 16 and the car stopping switch **20*a* directly detects the movement of the pickup 16**. Due to the construction just described, the apparatus can be formed with a small size, with a light weight and at a reduced cost.

Embodiment 5

Figure 9:
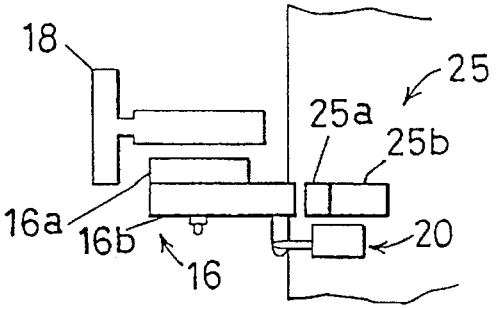
FIG. 9(1) is a plan view showing an embodiment 5 of the present invention.
Figure 9:
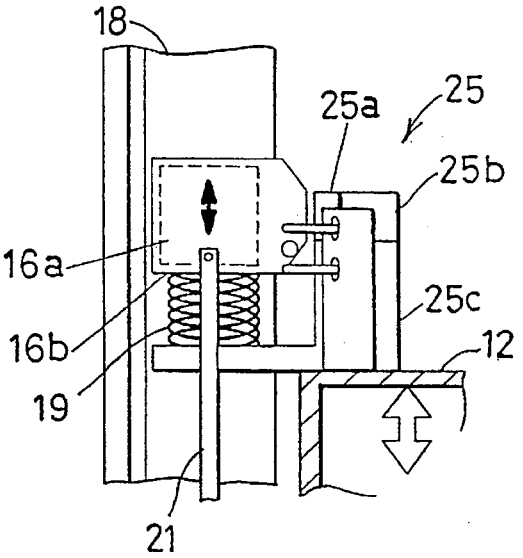

In the embodiment 5, as shown in FIGS. 9(1) and 9(2), the arm 14, the base 13 and the balance weight 17 are omitted similarly to the embodiment 4, and besides, a magnets **16*a* is provided on only one side of the conductor 18**. Due to the construction just described, the apparatus can be formed with a further reduced size, with a further reduced weight and at a further reduced cost.

Embodiment 6

Figure 10:
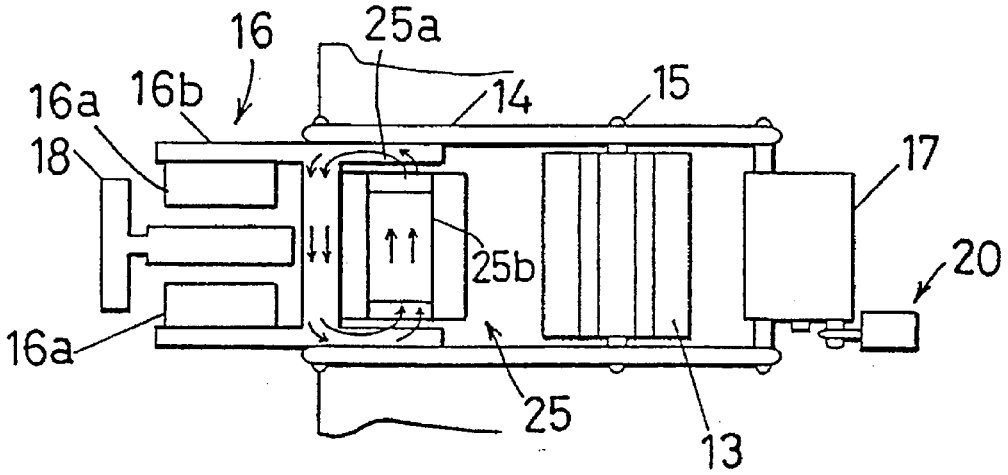
FIG. 10(1) is a plan view showing an embodiment 6 of the present invention.
Figure 10:
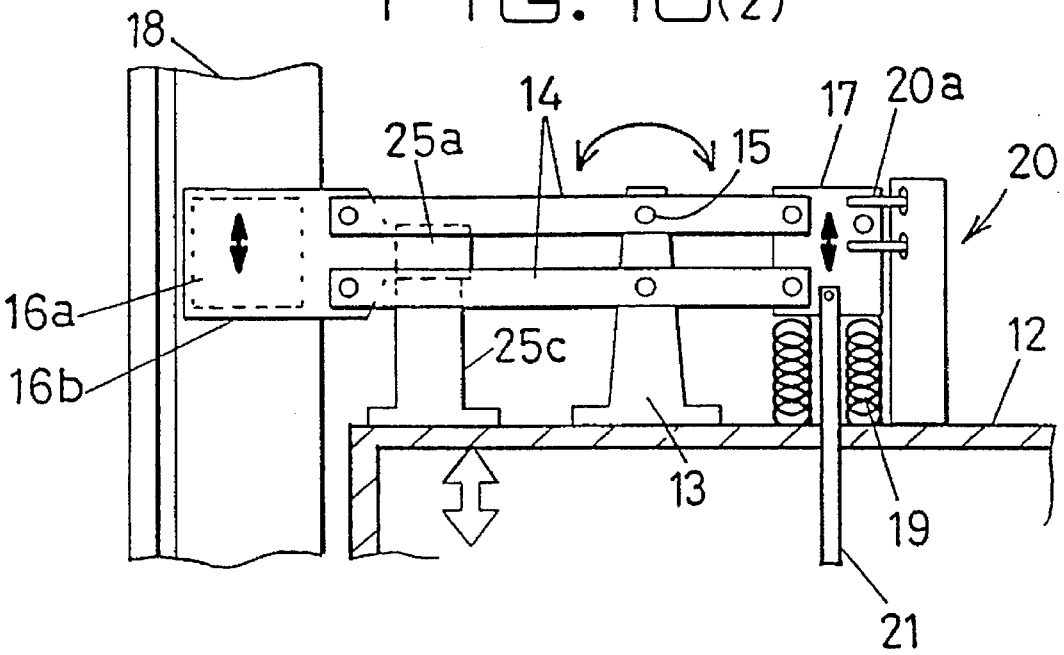

While, in the embodiment 1, the magnet **25*a* magnetized perpendicularly to the plane of pivotal motion of the arm 14 is provided on the rear face of the pickup 16, in the embodiment 6, a magnet 25*a* magnetized in a direction parallel to the plane of pivotal motion of the arm 14 is provided as shown in FIGS. 10(1) and 10(2). Due to the construction, the magnetic reluctance of the magnetic spring 25 section is reduced and magnetic fluxes pass there more readily, and consequently, a high magnetic spring effect can be obtained even if the magnet 25*a* used is small. Consequently, the magnetic spring 25** can be formed at a reduced cost, and since leakage fluxes to the surroundings can be reduced, a magnetic influence upon the surroundings can be reduced.

Embodiment 7

Figure 11:
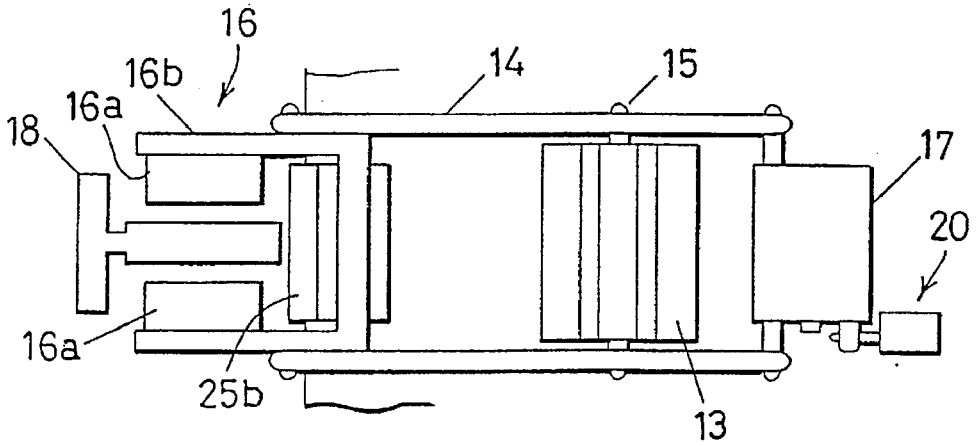
FIG. 11(1) is a plan view showing an embodiment 7 of the present invention.
Figure 11:
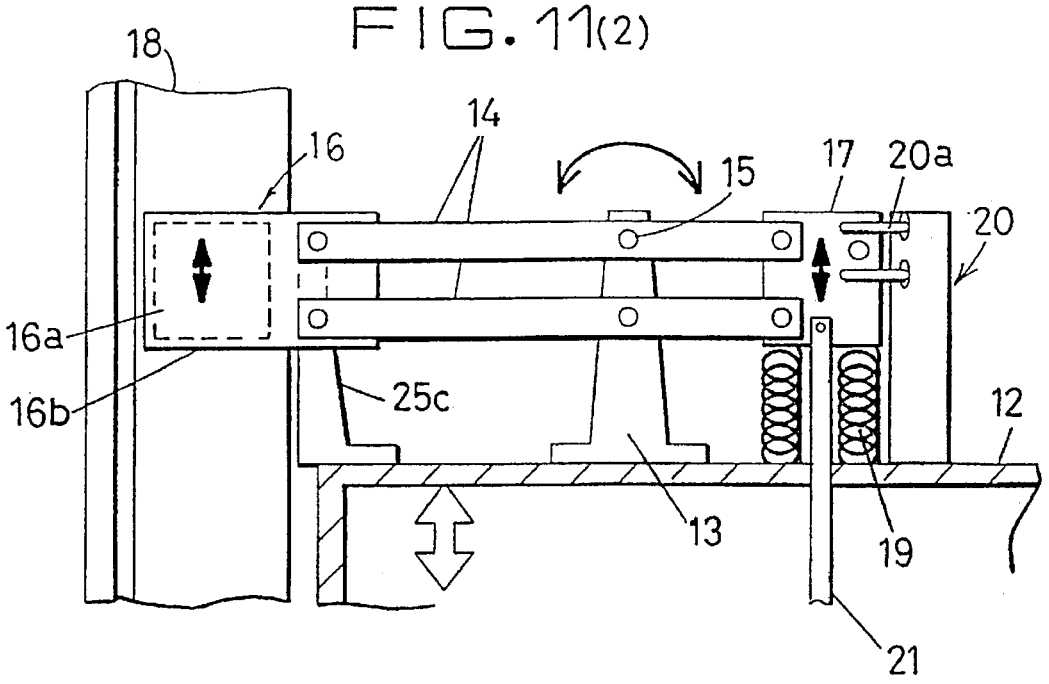

In the embodiment 7, only the yoke **25*b* of the magnetic spring 25 is provided in the pickup 16 as shown In FIGS. 11(1) and 11(2)**.

Operation will be described subsequently. With the construction of the embodiment 7, while the displacement of the arm 14 is small and the arm 14 remains in a substantially parallel condition to the car 12, some of magnetic fluxes passing the yoke **16*b* of the pickup 16 are branched to the yoke 25*b* of the magnetic spring 25 and form a second magnetic circuit. Consequently, a magnetic attracting force acts between the yoke 16*b* of the pickup 16 and the yoke 25*b* of the magnetic spring 25. On the other hand, if the arm 14 is displaced by a great amount until the yoke 25*b* is not present any more in the magnetic circuit of the pickup 16, then the magnetic attracting force does not act between the yoke 16*b* and the yoke 25*b* any more. Accordingly, the yoke 25*b* acts as a magnetic spring, and consequently, the number of parts of the magnetic spring 25 section can be reduced and the magnetic spring 25** can be formed with a small size and at a low cost.

Embodiment 8

Figure 12:
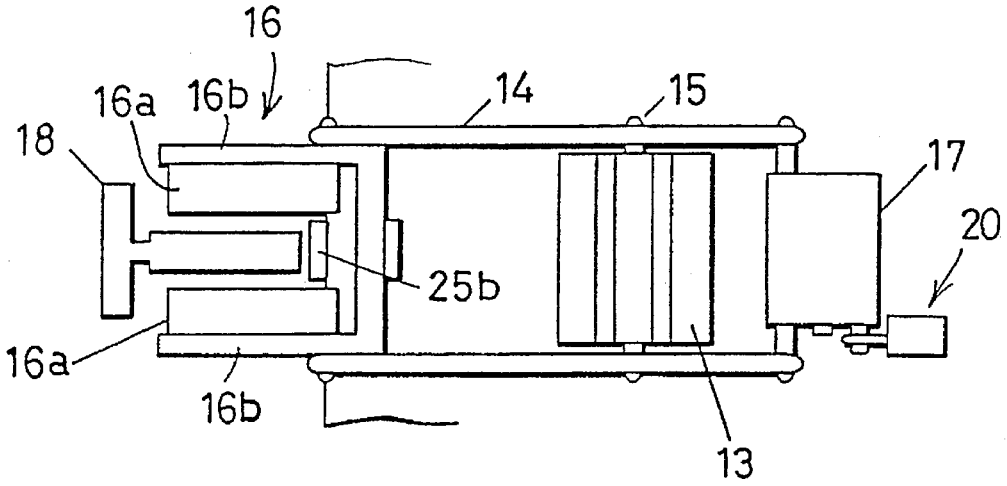
FIG. 12(1) is a plan view showing an embodiment 8 of the present invention.
Figure 12:
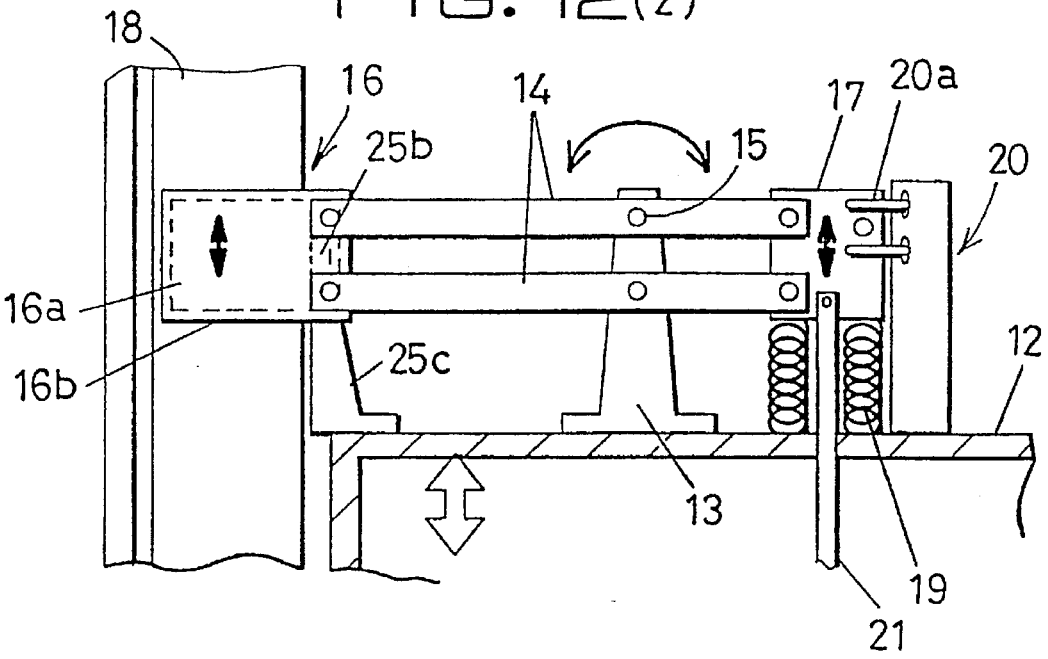
Figure 13:
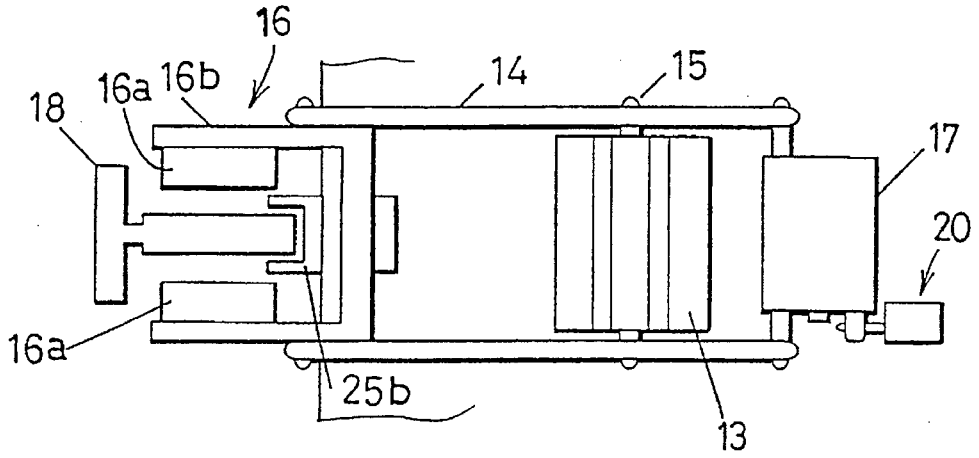
FIG. 13(1) is a plan view showing another example of the embodiment 8.
Figure 13:
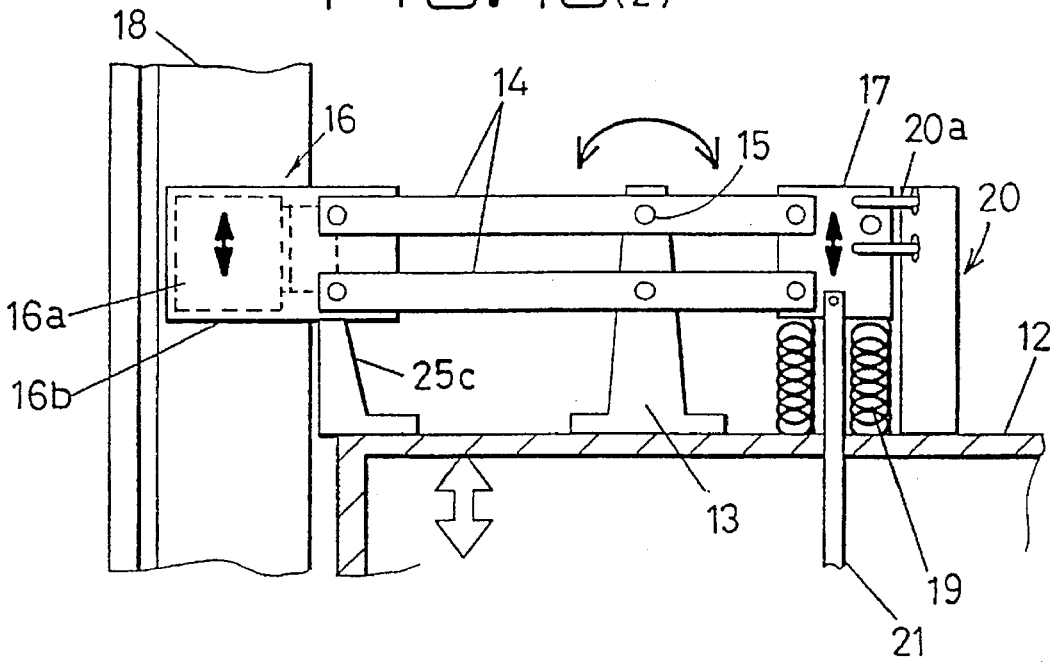

In the embodiment 8, as shown in FIGS. 12 (1), 12(2), 13(1) and 13(2), the yoke **25*b* is disposed at a portion of a space between the opposing magnets 16*a* of the magnetic circuit formed by the pickup 16 so that it may make use of some of magnetic fluxes which pass the conductor 18 of the magnetic circuit (FIGS. 12(1) and 12(2) show an example wherein the yoke 25*b* is merely located adjacent the conductor 18, and FIGS. 13(1) and 13(2) show another example wherein the magnetic spring 25 is located adjacent the conductor 18 in such a manner as to surround the conductor 18**).

Operation will be described subsequently. In the embodiment 8, in addition to the effect of the magnetic spring of the embodiment 7, while the displacement of the arm 14 is small, since some of magnetic fluxes generated between the magnets **16*a* are branched to the yoke 25*b* and are not supplied to the conductor 18, the generated force of the pickup 16 is weak, but when the displacement of the arm 14 is great, since the yoke 25*b* is displaced from the first magnetic circuit and all of magnetic fluxes generated between the magnets 16*a* pass the conductor 18, the generated force of the pickup 16** is strong. Consequently, a high magnetic spring effect is obtained.

Embodiment 9

Figure 14:
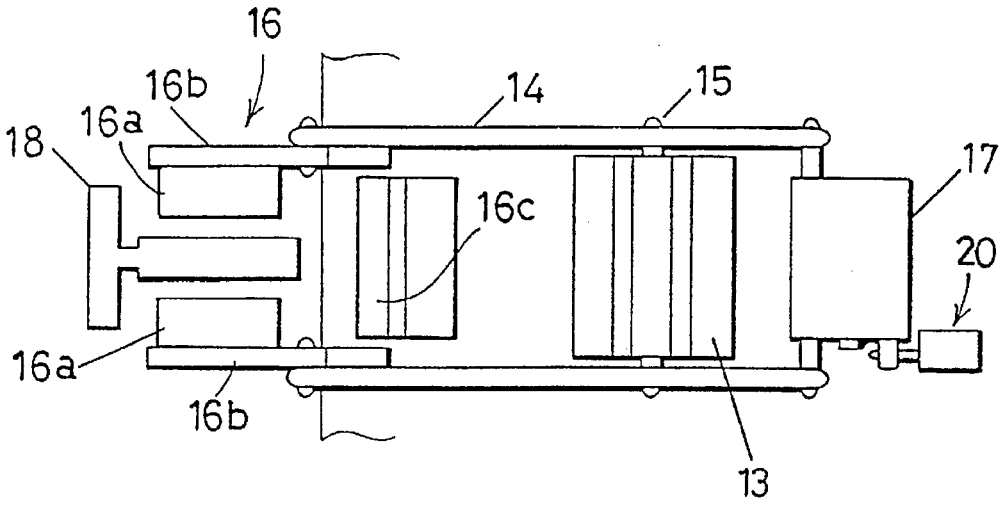
FIG. 14(1) is a plan view showing an embodiment 9 of the present invention.
Figure 14:
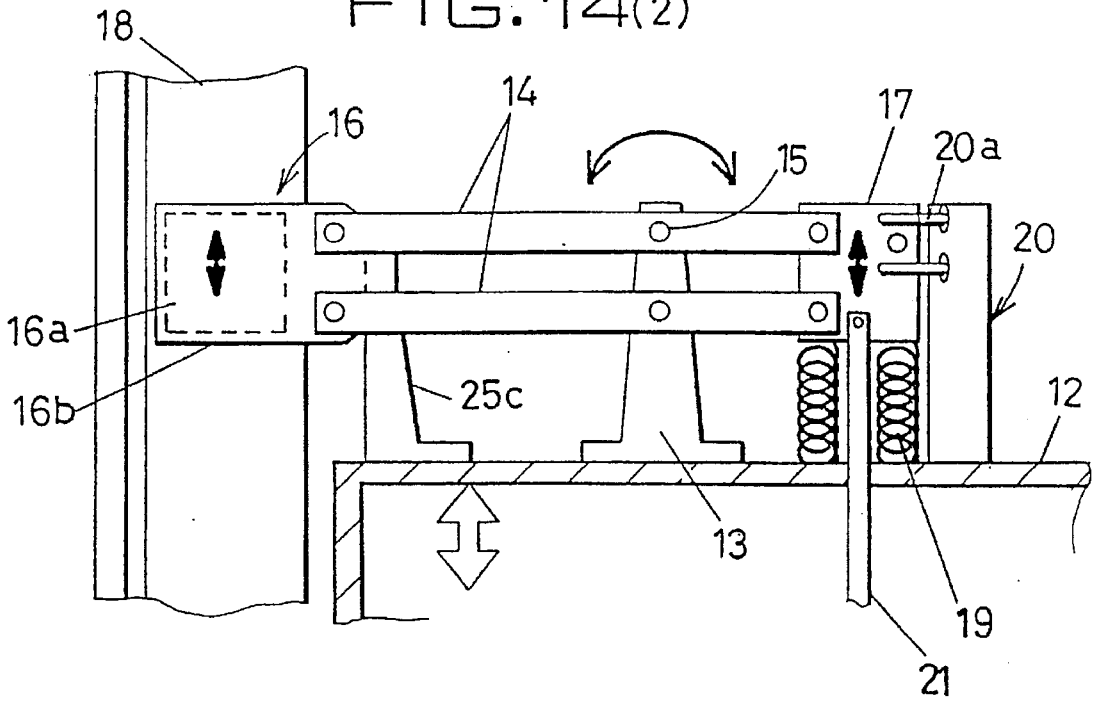

Also in the embodiment 9, a non-linear magnetic spring from which a strong force acts in a direction to keep the arm 14 in its horizontal position when the arm 14 is near to its horizontal position. FIG. 14(1) is a plan view of the embodiment 9 while FIG. 14(2) is a front elevational view of the embodiment 9, and as shown in FIGS. 14(1) and 14(2), the pickup 16 includes a pair of magnets **16*a* disposed on the opposite sides of and in an opposing relationship to the conductor 18 with spaces left therebetween, and yokes 16*b* and 16*c* for assuring a path of magnetic fluxes of the two magnets 16*a*. The yokes 16*b* are connected to the arm 14, and the yoke 16*c* is mounted on the base 25*c* separately from the yokes 16*b***.

Operation will be described below. As shown in FIGS. 14(1) and 14(2), since the yokes **16*b* and the yoke 16*c* of the embodiment 9 are separate from each other with gaps left therebetween, even if the arm 14 is pivoted, the yoke 16*c* is not displaced but only the magnets 16*a* and the yokes 16*b* are displaced. Since magnetic fluxes pass between the yoke 16*c* and the yokes 16*b*, a magnetic attracting force to attract them to each other acts, and since the distance between them is in the minimum when the arm 14 is in its horizontal position, the magnetic attracting force is strong. But as the arm 14 is pivoted, the distance between the yokes 16*b* and the yoke 16*c* is increased and the magnetic attracting force between them is decreased. Consequently, a non-linear magnetic spring whose spring constant is high when the car 12 runs at a low speed but is low when the car 12 runs at a high speed is formed. With the construction of the embodiment 9, the number of parts is reduced and the rotating section can be simplified in construction and reduced in weight comparing with the constructions of the other embodiments described above. Also an additional effect that the pivotal displacement of the arm 14 when the car 12** runs at a low speed is small is obtained.

Embodiment 10

Figure 15:
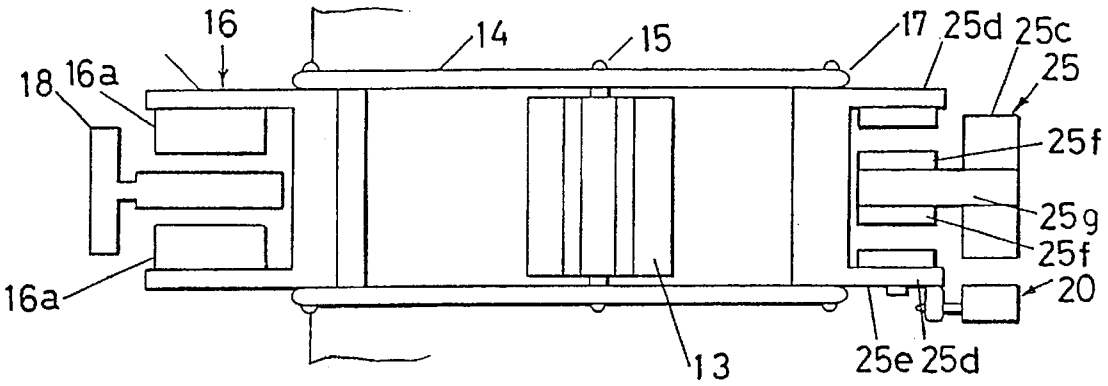
FIG. 15(1) is a plan view showing an embodiment 10 of the present invention.
Figure 15:
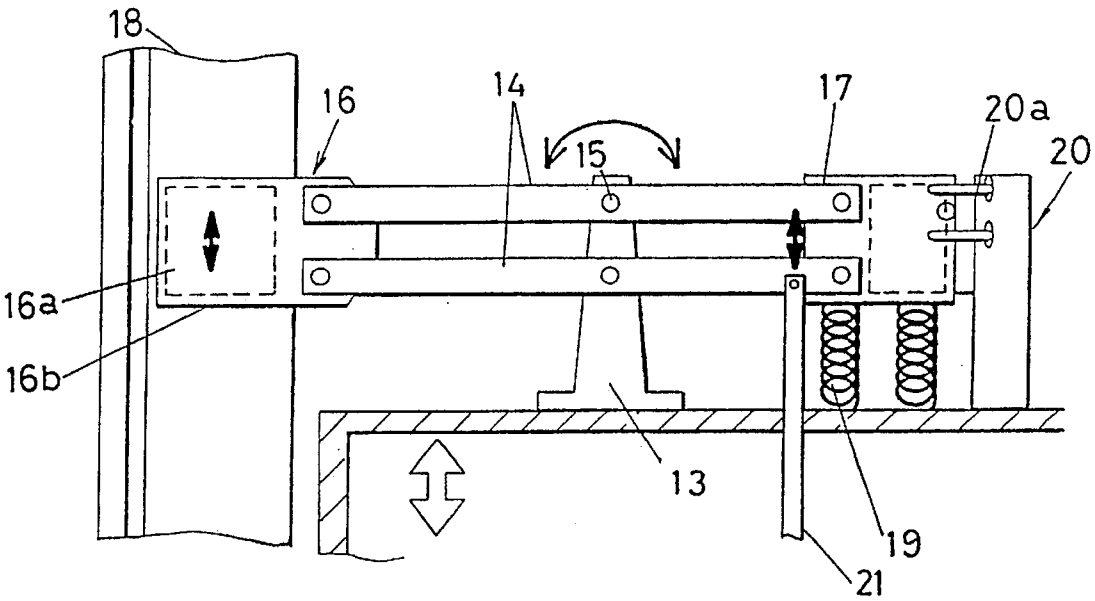

Also in the embodiment 10, a non-linear magnetic spring by which a strong force acts in a direction to keep the arm 14 in its horizontal position when the arm 14 is near to the its horizontal position. As shown in FIGS. 15(1) and 15(2), in the embodiment 10, a second magnetic circuit for generating the force of the magnetic spring 25 is provided on the opposite side (counter weight side) of the pickup 16 and used also as the balance weight 17. In FIGS. 15(1) and 15(2), reference character **25*d* denotes a pair of counter magnets provided in an opposing relationship to each other, 25*e* a counter yoke for holding the counter magnets 25*d* thereon to form a counter magnetic circuit, 25*f* a pair of magnets for forming a sub magnetic circuit, and 25*g* a sub yoke mounted on the base 25*c* for holding the magnets 25*f***. The counter magnetic circuit and the sub magnetic circuit attract each other. In other words, the sub magnetic circuit and the counter magnetic circuit are disposed such that different magnetic poles thereof are opposed to each other.

Operation will be described below. In the embodiment 10, when the arm 14 is pivoted, since the sub magnetic circuit is not displaced but the counter magnetic circuit is displaced, an attracting magnetic force to attract them to each other acts between them, and when the arm 14 is at its horizontal position, since the distances between the opposing magnets of the sub magnetic circuit and the counter magnetic circuit are shortest, the attracting force is strongest. The magnetic force varies by a great amount in response to a variation of the distance as described above. As a result, a non-linear magnetic force which exhibits a high spring force when the car 12 runs at a low speed but exhibits a low spring force when the car 12 runs at a high speed is formed. With the construction of the embodiment 10, since the magnetic spring is provided on the counter weight side, the pickup section which is liable to suffer from an accident of contact can be simplified in construction and can be constructed such that it can be manufactured readily and an accident can be reduced. Further, since any other function than the pickup function is not provided for the pickup section, also the pickup section can be constructed in various constructions readily. Furthermore, since the balance weight 17 serves also as the magnetic spring, there is an effect that the number of parts is reduced as much and the rotating section is simple in construction and light in weight.

Embodiment 11

Figure 16:
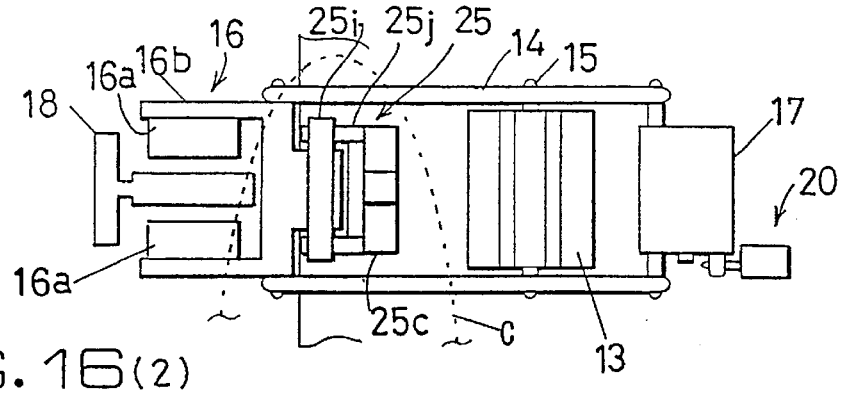
FIG. 16(1) is a plan view showing an embodiment 11 of the present invention.
Figure 16:
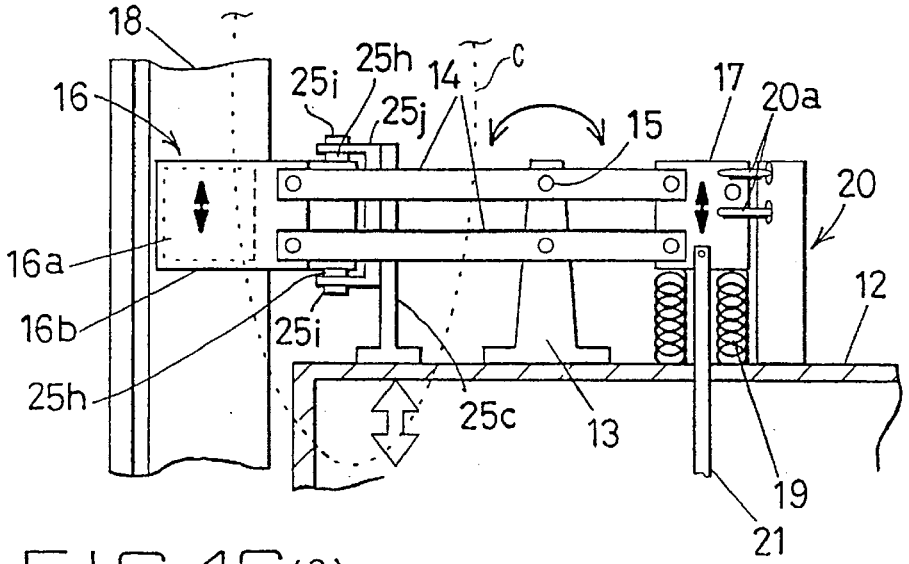
Figure 16:
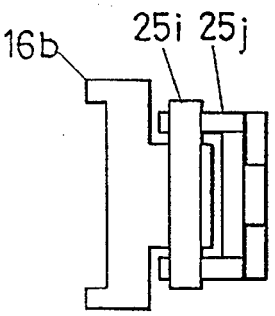
Figure 16:
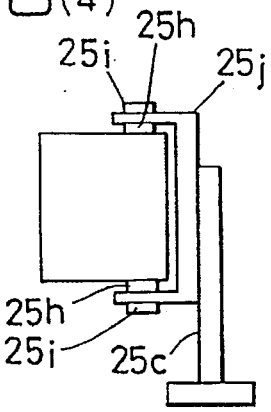
Figure 16:
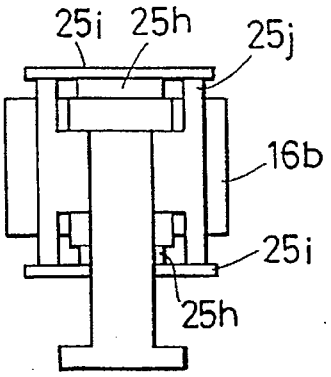

Also in the embodiment 11, a non-linear magnetic spring by which a strong force acts in a direction to keep the arm 14 in its horizontal position when the arm 14 is near to the its horizontal position is formed. Referring to FIGS. 16(1) and 16(2), reference character **25*h* denotes a set of magnets provided in an opposing relationship to each other such that they hold the yoke 16*b* of the pickup 16 from above and below therebetween and having a longer side in a direction perpendicular to the arm 14 than another side extending in parallel to the arm 14, 25*i* a pair of yokes securely mounted on the magnets 25*h*, and 25*j* a magnetic holder securely mounted on the base 25*c*, having arms extending in a direction parallel to the arm 14 above and below projecting portions of the yoke 16*b* in such a manner as to surround the projecting portions of the yoke 16*b* and attracting the yokes 25*i* to the arms thereof to hold the magnets 25*h* by way of the yokes 25*i***.

Figure 17:
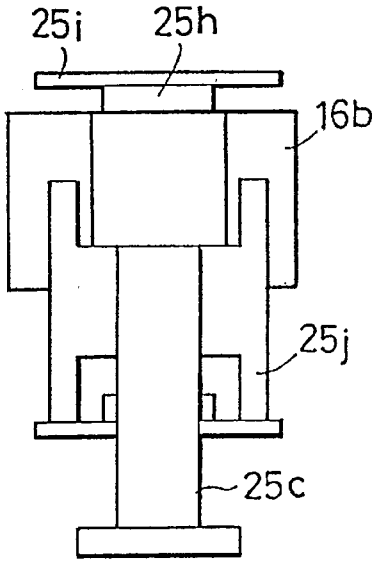
FIG. 17(1) is a front elevational view showing a condition in which an arm of the embodiment 11 is pivoted.
Figure 17:
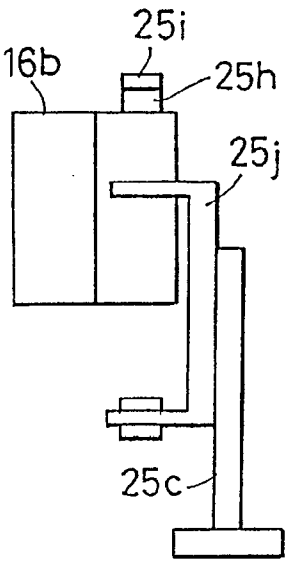
Figure 17:
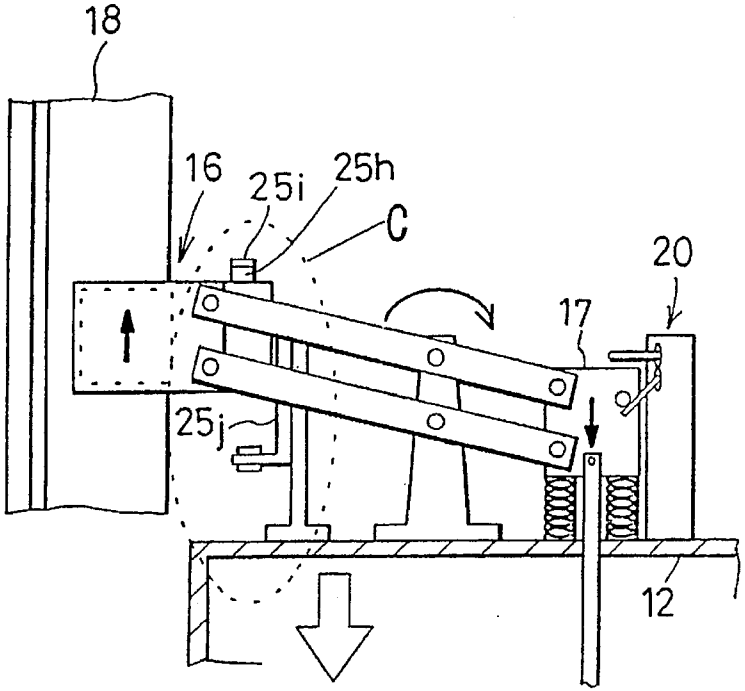
Figure 18:
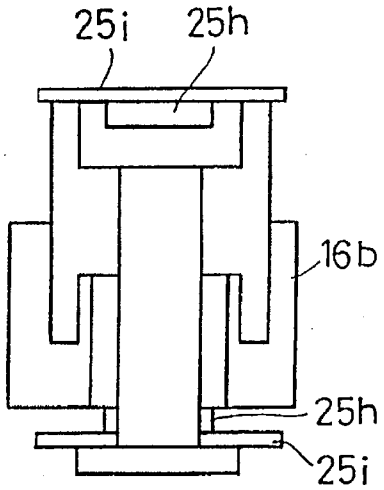
FIG. 18(1) is a front elevational view showing a condition in which the arm of the embodiment 11 is pivoted.
Figure 18:
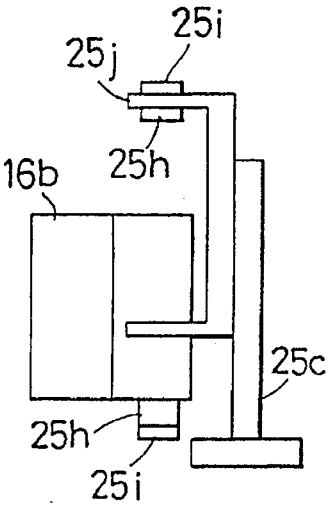
Figure 18:
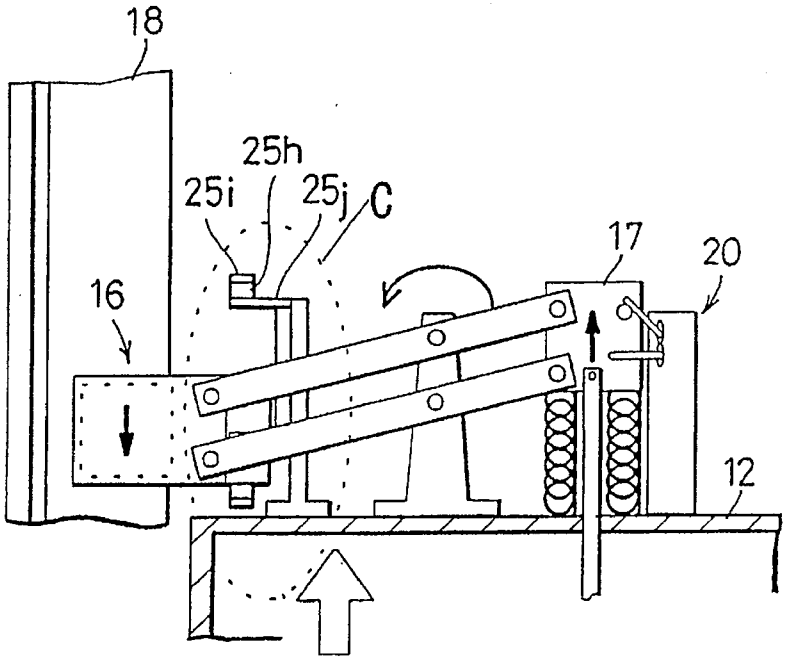

Operation will be described subsequently. The magnets **25*h* are attracted to upper and lower faces of the yokes 16*b* when the arm 14 is in its horizontal condition (stationary condition). As shown in FIGS. 17(1) to 17(3), when the car 12 moves downwardly and the speed of the car rises so that a generated force stronger than the attracting force between the yokes 25*i* and the magnet holder 25*j* and the attracting force between the yokes 16*b* and the lower magnet 25*h* acts upon the pickup 16, the pickup 16 is moved upwardly with the upper magnet 25*h* and the upper yoke 25*i* held placed thereon while the lower magnet 25*h* and the lower yoke 25*i* remain in the attracted condition to the magnet holder 25*j* since the yoke 25*i* is limited from upward movement by the magnet holder 25*j*. On the contrary when the car 12 moves upwardly, as seen in FIGS. 18(1) to 18(3), when a generated force stronger than the attracting force between the yokes 25*i* and the magnet holder 25*j* and the attracting force between the yokes 16*b* and the upper magnet 25*h* acts upon the pickup 16, the pickup 16 moves down with the lower magnet 25*h* and the lower yoke 25*i* held placed thereon while the upper magnet 25*h* and the upper yoke 25*i* remain in the attracted condition to the magnet holder 25*j* since the lower yoke 25*i* is limited from downward movement by the magnet holder 25*j***.

Figure 19:
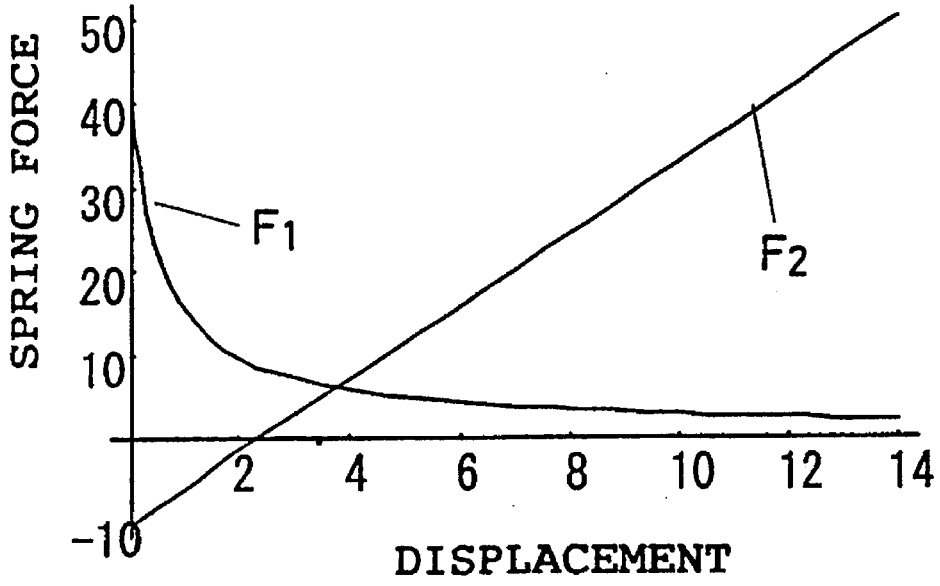
FIG. 19 is a diagram illustrating a relationship of a spring force generated in a elastic spring and a magnetic spring with respect to a displacement of a pickup of the embodiment 11.
Figure 20:
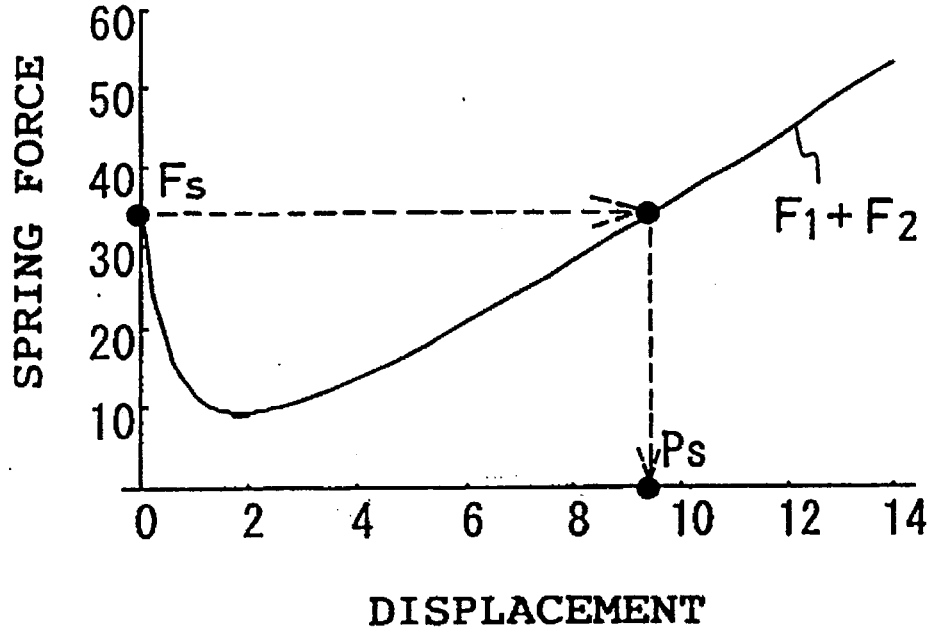
FIG. 20 is a diagram illustrating a combined spring force of the elastic spring and the magnetic spring shown in FIG. 19.
Figure 21:
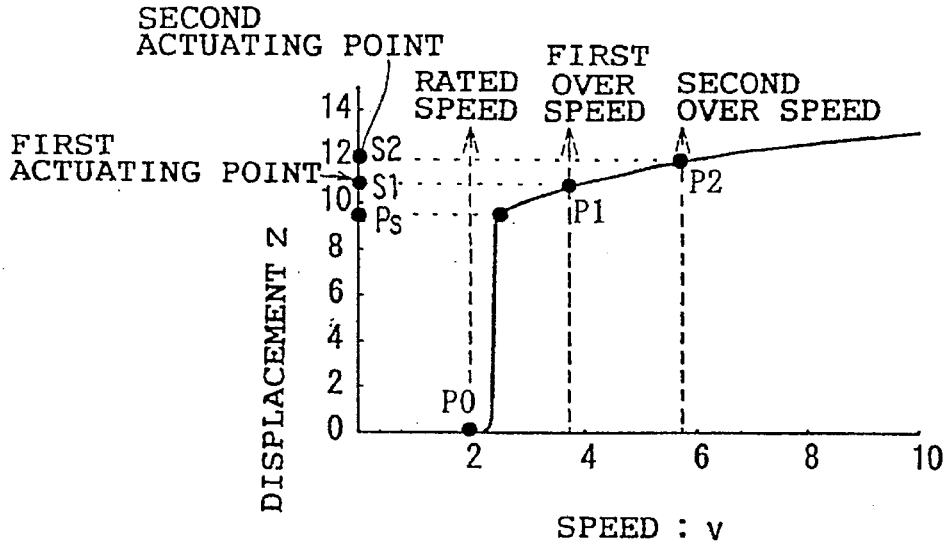
FIG. 21 is a diagram illustrating a displacement of a pickup with respect to a speed of a car of the embodiment 11.

The characteristics of the spring force F1 of the magnetic spring 25 formed in this manner and the spring force F2 of the elastic spring 19 with respect to the displacement of the pickup 16 are illustrated in FIG. 19; the characteristic of the composite spring force of the magnetic spring 25 and the elastic spring 19 with respect to the displacement of the pickup 16 is illustrated in FIG. 20; and the characteristic of the displacement amount of the pickup 16 of the embodiment 11 with respect to the running speed of the car 12 is illustrated in FIG. 21. While, with the constructions of the embodiments 1 to 10 described above, the spring force when the movement of the car 12 is started when the arm 14 is in is horizontal condition (stationary condition) is 0, with the construction of the present embodiment 11, since the magnets **25*h* remain attracted to the yokes 16*b* when the arm is in its horizontal condition, when the car 12 tries to start its upward or downward movement, the spring force Fs acts as a preload from the beginning. Consequently, when the car 12 moves, for example, in the downward direction at the rated speed, a generated force tending to move the pickup 16 in the upward direction acts, but the attracting force of the magnets 25*h* acting against this force acts to hold the horizontal position of the arm 14 without allowing pivotal motion of the arm 14. However, if the speed of movement of the car 12 exceeds a speed Vs at which a generated force stronger than the spring force Fs is generated, then the generated force by eddy currents becomes stronger than the attracting force of the magnets 25*h* and the arm 14 starts its pivotal motion, and the arm 14 is pivoted to the position of the displacement Ps. If the pickup 16 is moved and the arm 14 is pivoted, then as shown in FIGS. 17(1) to 17(3) and 18(1) to 18(3), one of the magnets 25*h* is spaced away from the pickup 16 and the attracting force decreases suddenly. Consequently, since the pickup 16 is displaced only against the spring force F2 by the elastic spring 19**, a large displacement is obtained.

With the present embodiment, since the arm 14 is not pivoted at all when the speed of the car 12 is low, a malfunction can be reduced and also the life can be increased. Further, if the speed Vs at which the arm 14 starts its pivotal motion is set to a value higher than the rated speed, then since the arm 14 does not normally move, a longer life and safety can be assured. Furthermore, with the construction of the present embodiment, since the magnets **25*h* for obtaining the attracting force is in the same direction as the direction of movement of the pickup 16, the attracting force is obtained effectively, and a high effect is obtained with a small magnetic circuit. Further, since the magnets 25*h* for obtaining the attracting force are constructed in a condition in which the are attracted to the pickup 16 when the arm 14** is in its horizontal condition, a strong attracting force is obtained with a weak magnetic force, and there is an effect that a smaller magnetic can be used.

It is to be noted that, while, in the construction of the present embodiment, the magnets **25*h* are attracted in a closely contacting condition to the yokes 16*b* when the arm 14 is in its horizontal condition, they may otherwise be attracted in a non-contacting condition with gaps left there. Further, while the pickup 16 and the magnetic spring 25 are attracted to each other using the magnets 25*h*, leakage magnetic fluxes of the pickup 16 may be utilized to obtain the attracting force only from the yokes without using the magnets 25*h*. In this instance, only the yokes 25*i* are installed in the proximity of the yokes 16*b* of the pickup 16. Further, both or either one of the magnets 25*h* and the yokes 25*i* may be proved on only one of the upper and lower sides of the yokes 16*b***.

Embodiment 12

Figure 22:
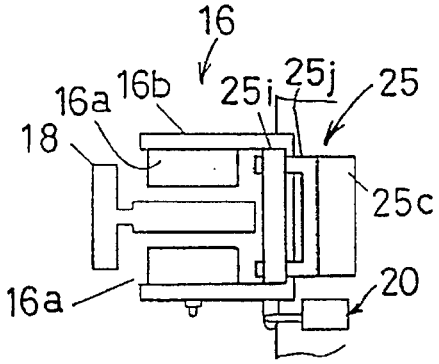
FIG. 22(1) is a plan view showing an embodiment 12 of the present invention.
Figure 22:
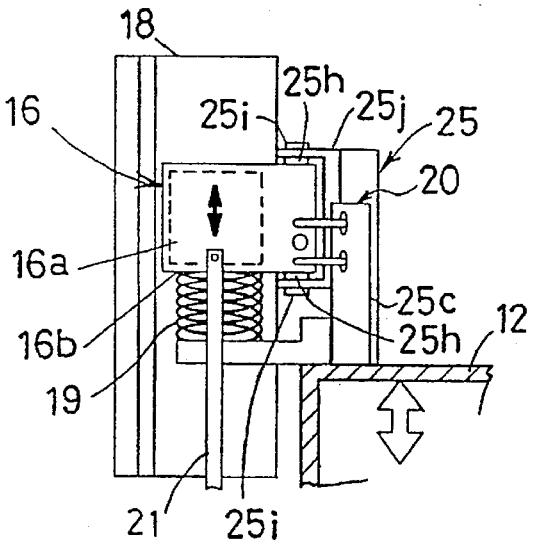

In the embodiment 12, as shown in FIGS. 22(1) and 22(2), the arm 14 is not provided, and instead, the pickup 16 is supported directly on the elastic spring 19 while a magnetic spring 25 having the same construction as that of the embodiment 11 which includes a pair of magnets **25*h*, a pair of yokes 25*i* and a base 25*c*** is provided. Due to the construction just described, the number of parts can be reduced, and the apparatus can be produced in a reduced size with a reduced weight at a reduced cost.

Embodiment 13

Figure 23:
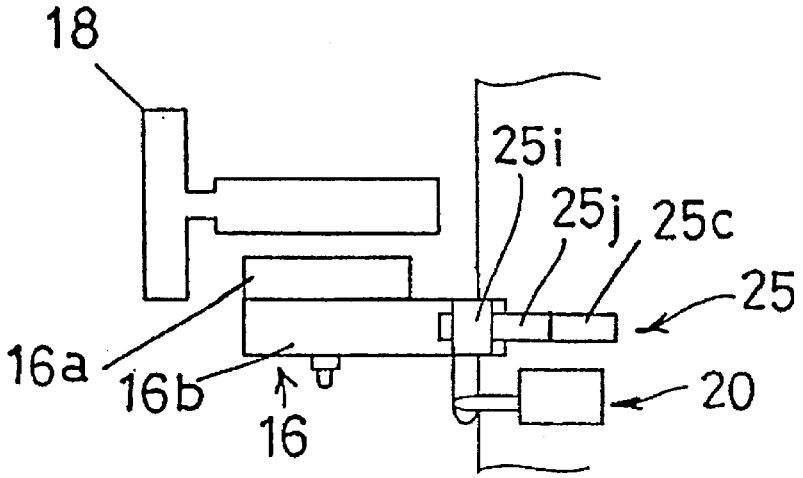
FIG. 23(1) is a plan view showing an embodiment 13 of the present invention.
Figure 23:
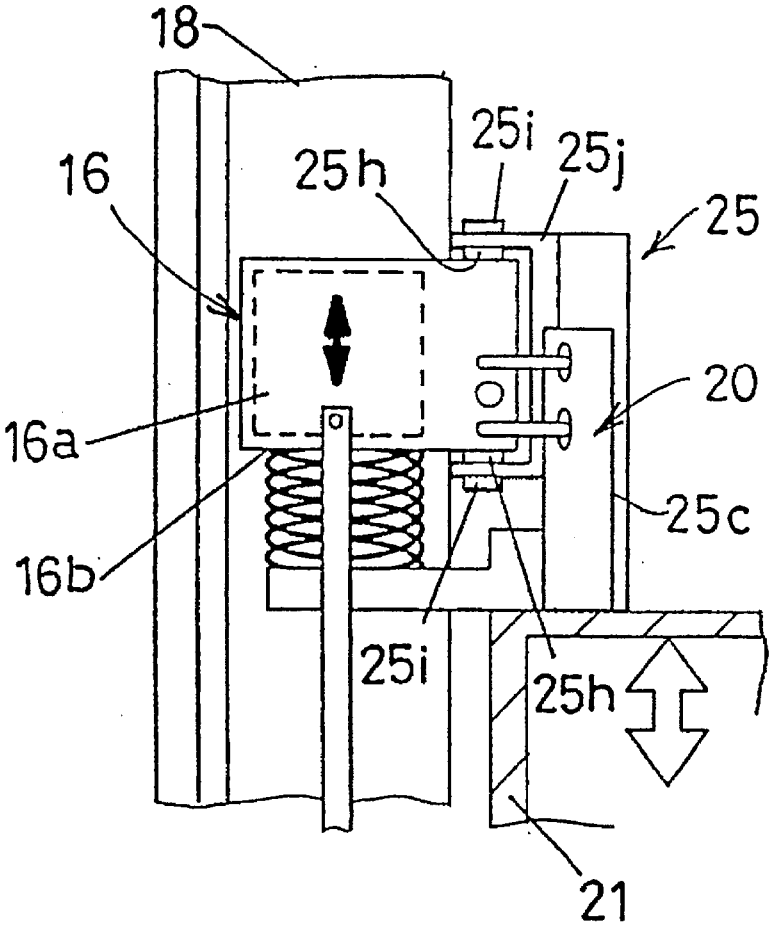

In the embodiment 13, as shown in FIGS. 23(1) and 23(2), a pair of magnets **25*h*, a pair of yokes 25*i* and a magnet holder 25*j* are provided similarly to the embodiment 11 described above on only one of the yokes 16*b* on one side of the pickup 16 wherein a magnet 16*a* is provided on one side of the conductor 18 to form a magnetic spring 25**. Due to the construction just described, the number of parts can be further reduced, and the apparatus can be further reduced in size and in weight as well as in cost.

In the constructions of all of the embodiments described above, the magnetic spring 25 may be provided at an intermediate portion of the arm 14 or at any other point of the arm 14, or a magnetic circuit of any other construction may be employed only if it exerts a force, when the arm 14 is displaced from its horizontal position or from a stationary condition, to tend to return the arm 14 to its horizontal position or to a position in the stationary condition.

Embodiment 14

Figure 24:
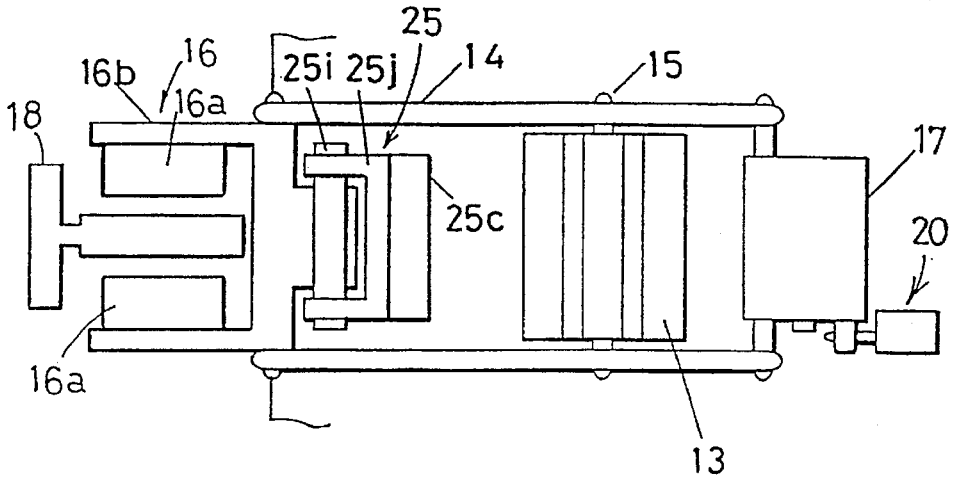
FIG. 24(1) is a plan view showing an embodiment 14 of the present invention.
Figure 24:
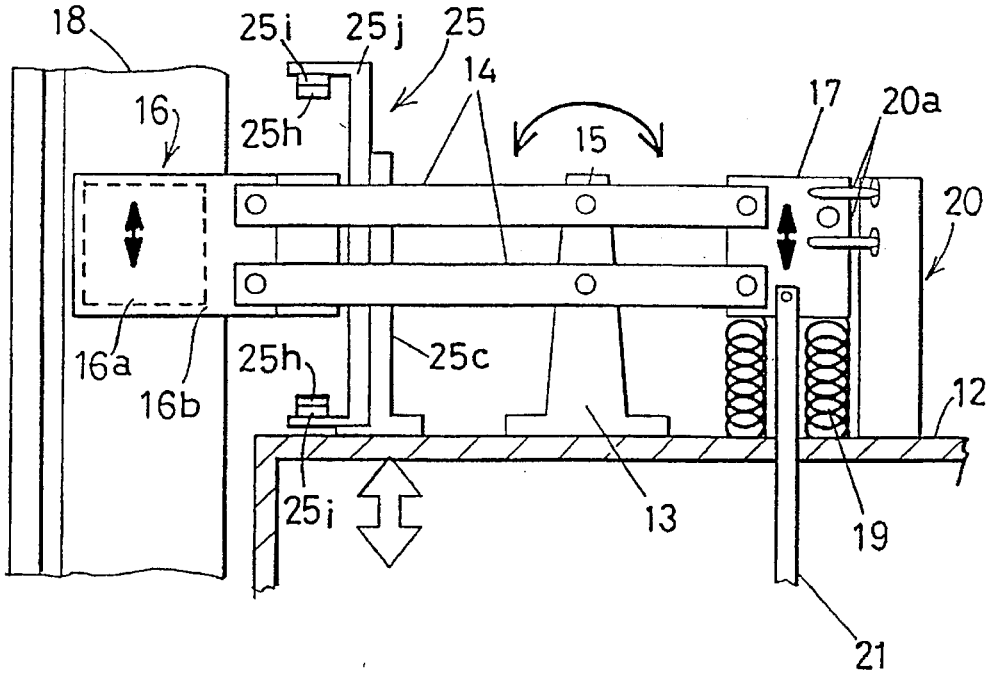
Figure 25:
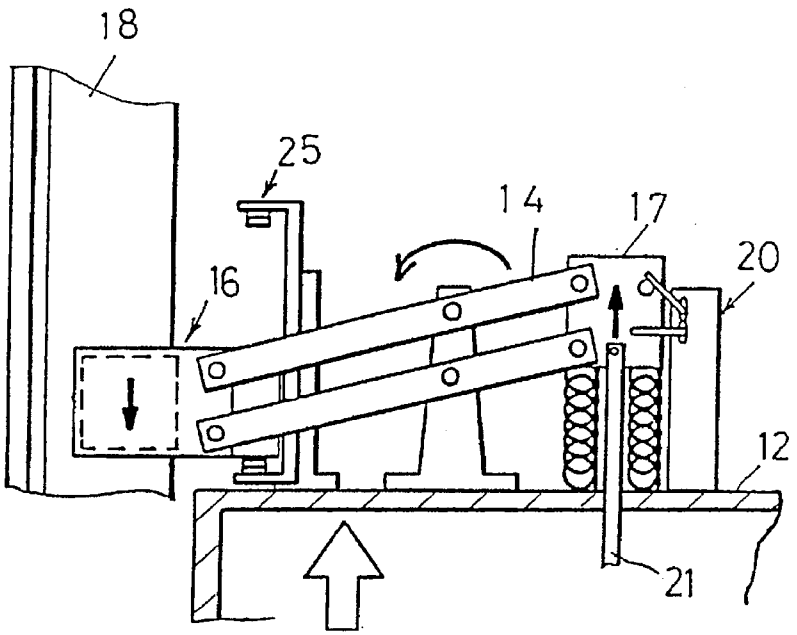
FIG. 25(1) is a front elevational view showing a condition in which an arm of the embodiment 14 is pivoted clockwise.
Figure 25:
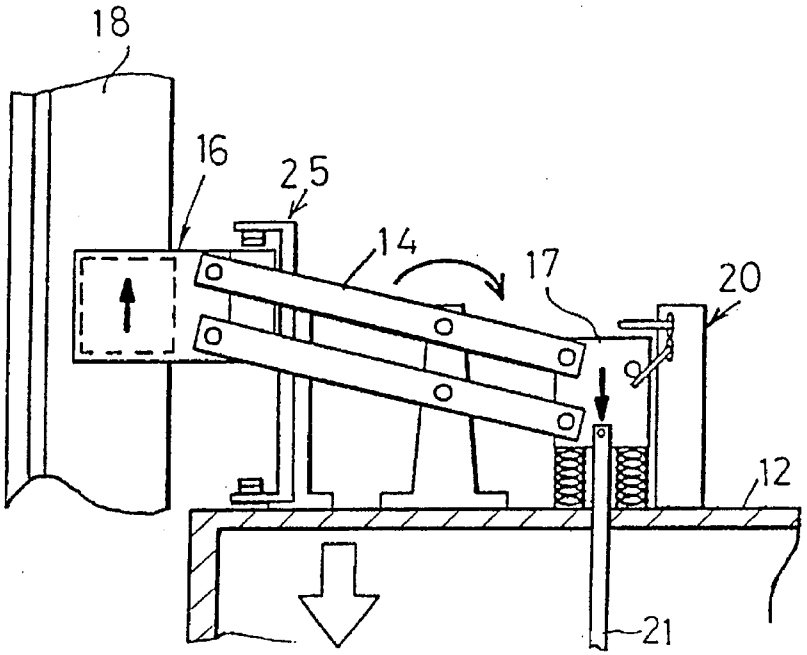

As shown In FIGS. 24(1) and 24(2), in the embodiment 14, the pickup 16 and the magnets **25*h* of the magnetic spring 25 are separate with predetermined gaps left therebetween in the vertical direction, and when the pickup 16 moves, the arm 14 is pivoted upwardly or downwardly so that the pickup 16 and one of the magnets 25*h* approach each other as seen in FIG. 25(1) (when the car 12 runs downwardly) and FIG. 25(2) (when the car 12 runs upwardly). The magnets 25*h* are connected to the base 25*c* by way of the magnet holder 25*j* so that, even if the car 12 moves to pivot the yokes 16*b* around the fulcrum 15, the magnetic spring 25 is not pivoted. As shown in FIGS. 24(1) and 24(2), when the pickup 16 is not moved relative to the car 12 and the arm 14 is in its horizontal position, the yokes 16*b* and the magnets 25*h*** are spaced from each other by a maximum distance and the magnetic attracting force between them is in the minimum.

Operation will be described subsequently. As described above, an elevator overspeed protection apparatus which makes use of eddy currents has a subject to be solved in that the operation speed of the emergency stopping mechanism is not stable and it is difficult to set the actuating point of the emergency stopping mechanism because the generated force of the pickup 16 when the car 12 runs at a high speed is weak and the rate of variation of the displacement of the pickup 16 at a dangerous speed is low. The embodiment 14 solves this subject by providing a non-linear magnetic spring by which a force acts in a direction to assist pivotal motion of the pickup 16 when the car 12 runs at a high speed until the speed reaches a dangerous speed. In particular, when the arm 14 is pivoted by a certain amount, the spring constant of the magnetic spring 25 is reduced to help pivotal motion of the arm 14, by which a stabilized operation with a reduce number of occurrences of a malfunction of the elevator overspeed protection apparatus is obtained. In the present embodiment 14, as shown in FIGS. 25(1) and 25(2), when the pickup 16 is moved upwardly or downwardly upon high speed running of the car 12 in the downward direction (FIG. 25(1)) or upon high speed running in the upward direction (FIG. 25(2)), the pickup 16 is attracted by one of the magnets **25*h*, and as a result, the spring constant of the magnetic spring 25** is reduced.

Figure 26:
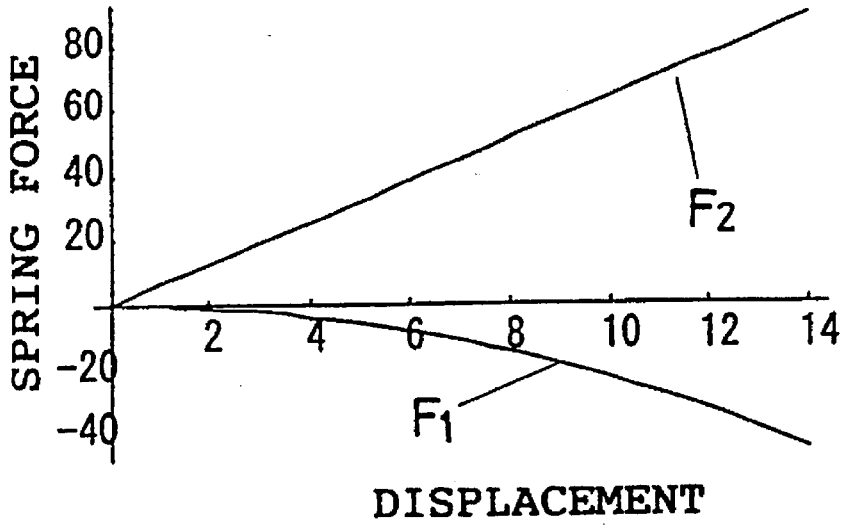
FIG. 26 is a diagram illustrating a relationship of a spring force generated in a elastic spring and a magnetic spring with respect to a displacement of a pickup of the embodiment 14.
Figure 27:
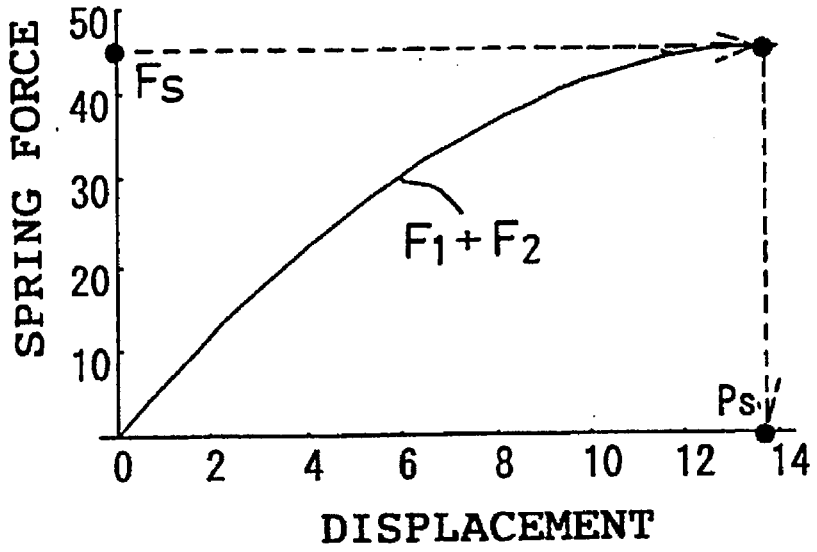
FIG. 27 is a diagram illustrating a combined spring force of the elastic spring and the magnetic spring of FIG. 26.

Referring to FIG. 26, reference character F1 denotes a spring force of the magnetic spring 25 with respect to the displacement of the pickup 16 of the present embodiment 14, and F2 a spring force of the elastic spring 19. As seen in FIG. 26, the spring force F1 of the magnetic spring 25 varies non-linearly with respect to the displacement due to the physical characteristic of magnetism, and the spring force F2 of the elastic spring 19 normally varies linearly with respect to the displacement as described hereinabove. In the present embodiment 14, the two spring forces are combined so that such a non-linear spring as shown in FIG. 27 is formed. With the non-linear spring shown in FIG. 27, substantially only the elastic spring 19 contributes and the spring constant is high when the displacement of the pickup 16 is small, but as the displacement increases to some degree (that is, as the arm 14 is pivoted by a certain amount), the contribution of the magnetic spring 25 becomes higher and the spring constant is reduced.

Figure 28:
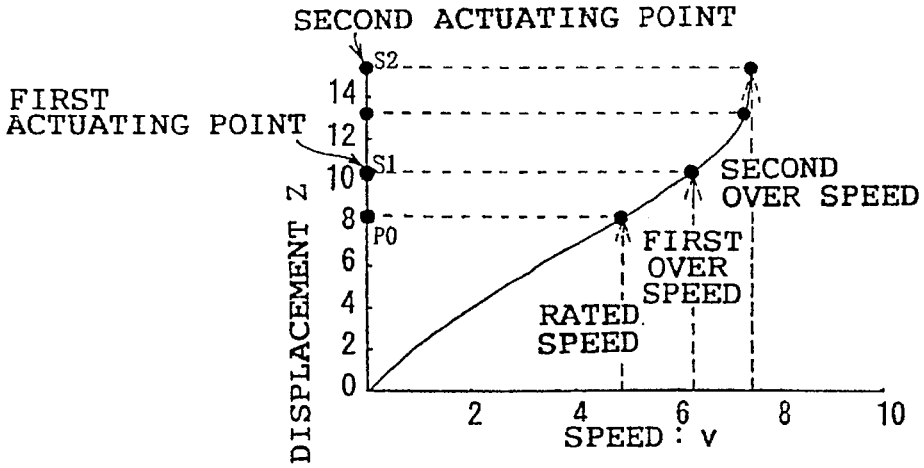
FIG. 28 is a diagram illustrating a displacement of a pickup with respect to a speed of a car of the embodiment 14.

Since the generated force generated by the pickup 16 varies in such a manner as seen in FIG. 95 in response to the speed of the car 12, by the non-linear spring of the present embodiment which has the characteristic illustrated in FIG. 27, such a relationship of the displacement of the pickup 16 to the sped of the car 12 as illustrated in FIG. 28 is obtained. As the speed of the car 12 rises, the generated force by eddy currents in the conductor 18 which acts upon the pickup 16 increases, but since the influence of the magnetic force of the magnetic spring 25 gradually increases, the spring constant of the combined spring of the magnetic spring 25 and the elastic spring 19 decreases and the displacement of the pickup 16 relative to the speed of the car 12 increases. Further, if the position of the pickup 16 exceeds the displacement Ps corresponding to the second over speed, the spring constant of the combined spring changes to the negative in sign and the generated force becomes stronger than the spring force, and consequently, the pickup 16 is attracted to and displaced by a great amount by the magnetic spring 25.

Here, when the gradient of the spring force of the magnetic spring 25 with respect to the displacement of the pickup 16 becomes equal to the gradient of the spring force of the elastic spring 19, the gradient of the spring force of the combined spring force exhibits 0 (displacement Ps in FIG. 27). After the spring force of the magnetic spring 25 exceeds the spring force of the elastic spring 19, the spring constant of the spring force of the combined spring changes to the negative in sign, and as the displacement further increases, the spring force decreases. Consequently, if the speed of the car 12 is not reduced and the generated force of the pickup 16 is maintained, then the arm 14 is attracted by the magnetic force of the magnetic spring 25 so that it is displaced suddenly. Therefore, by providing the point at which the gradient of the combined spring force becomes equal to zero to a point lower than the first dangerous speed or the second dangerous speed but higher than the rated speed, when the car 12 approaches a dangerous speed, the pickup 16 exhibits a great displacement, and consequently, an assured dangerous speed detection operation can be obtained. However, if the combined spring force at a point at which the displacement exhibits its maximum is set to a positive value greater than 0, then when the speed of the car 12 decreases from the proximity of a dangerous speed, the pickup 16 restores its original position, which facilitates later processing (on the contrary if the combined spring force is set to a negative value, then such restoration cannot be achieved, but the attracting force can be increased to improve the certainty of an emergency stopping operation).

Consequently, the displacement of the pickup 16 at a high speed can be made great comparing with that of the conventional example, and since the displacement differences at the rated speed point, the first actuating point and the second actuating point are great comparing with those of the conventional example, the operation speed of an emergency stopping operation is stabilized and the safety is improved.

Embodiment 15

Figure 29:
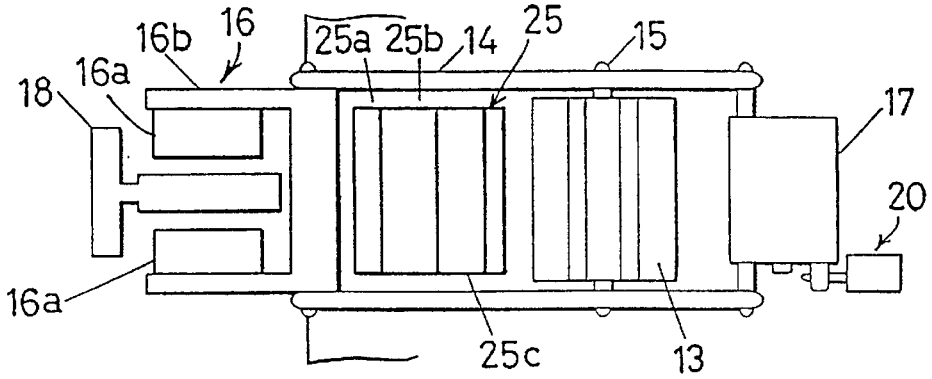
FIG. 29(1) is a plan view showing an embodiment 15 of the present invention.
Figure 29:
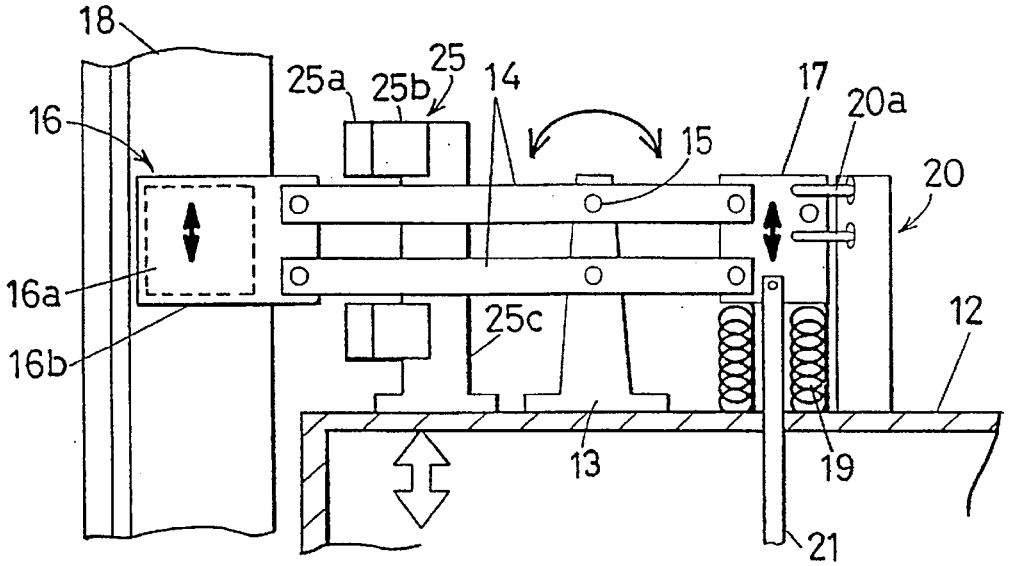
Figure 30:
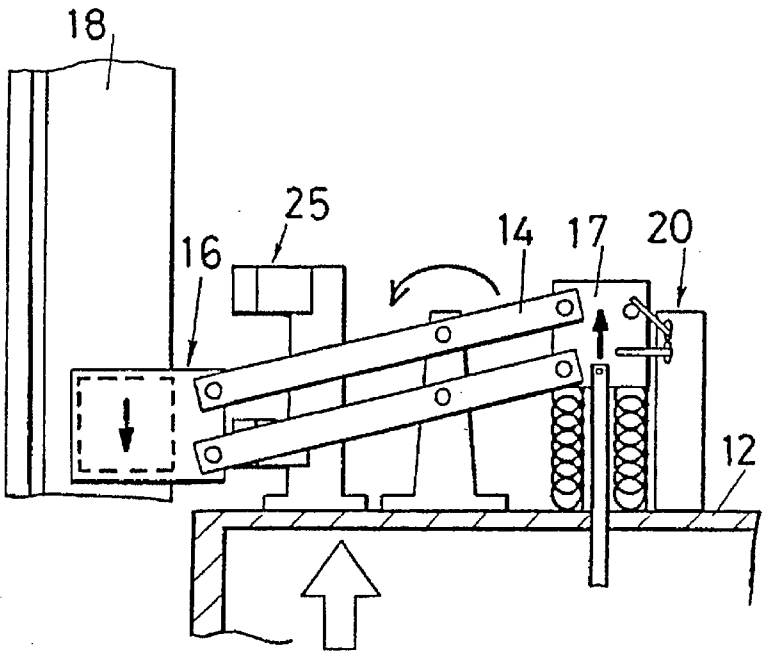
FIG. 30(1) is a front elevational view showing a condition in which an arm of the embodiment 15 is pivoted clockwise.
Figure 30:
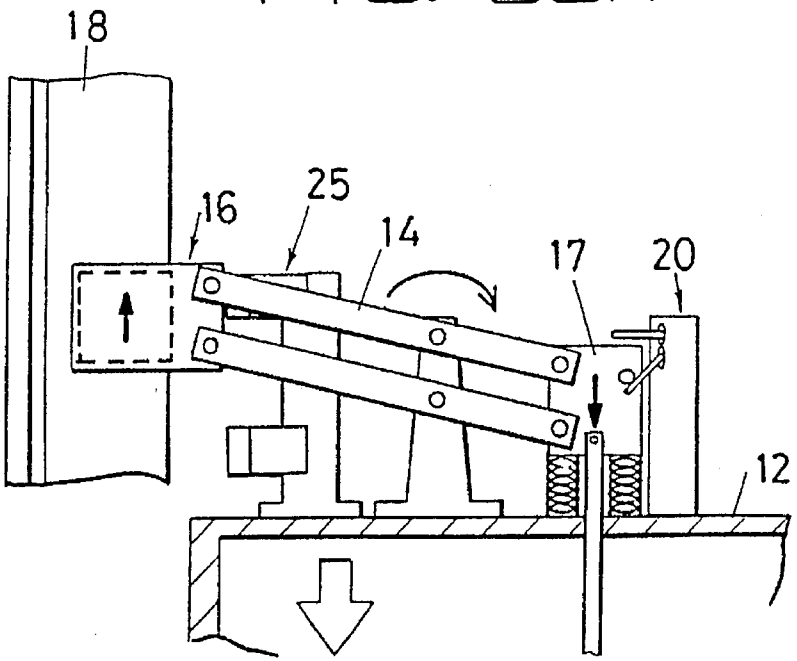

As shown in FIGS. 29(1) and 29(2), in the embodiment 15, the magnetic spring 25 is provided on the rear side of the pickup 16. Also in this instance, as seen in FIGS. 30(1) and 30(2), when the car 12 runs at a high speed in the upward or downward direction (the car 12 runs in the downward direction in FIG. 30(1), but the car 12 runs in the upward direction in FIG. 30(2)), the pickup 16 approaches one of the magnets **25*a* of the magnetic spring 25 so that the magnetic circuit of the magnetic spring 25 exerts a force to help the pivoting motion of the pickup 16 in a high speed region of the car 12**. Due to the construction just described, the height of the magnetic spring can be made low comparing with that of the embodiment 14.

Embodiment 16

Figure 31:
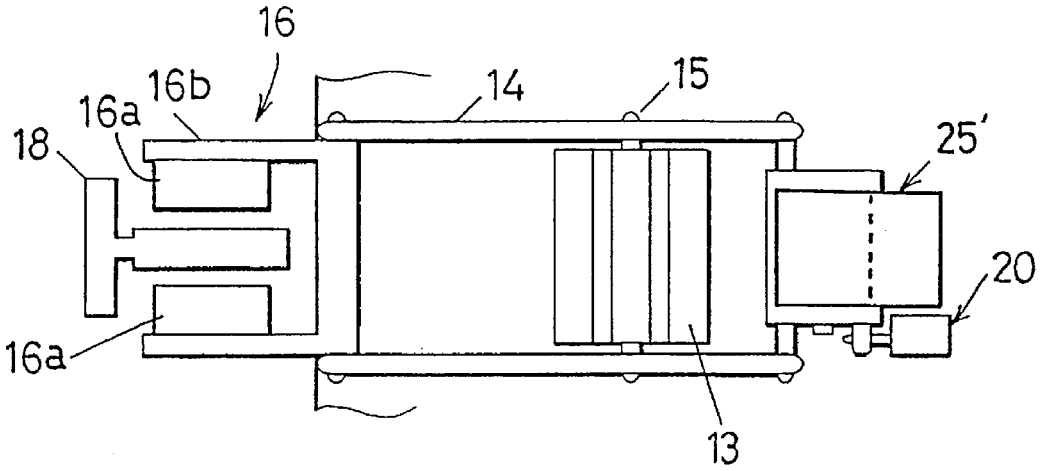
FIG. 31(1) is a plan view showing an embodiment 16 of the present invention.
Figure 31:
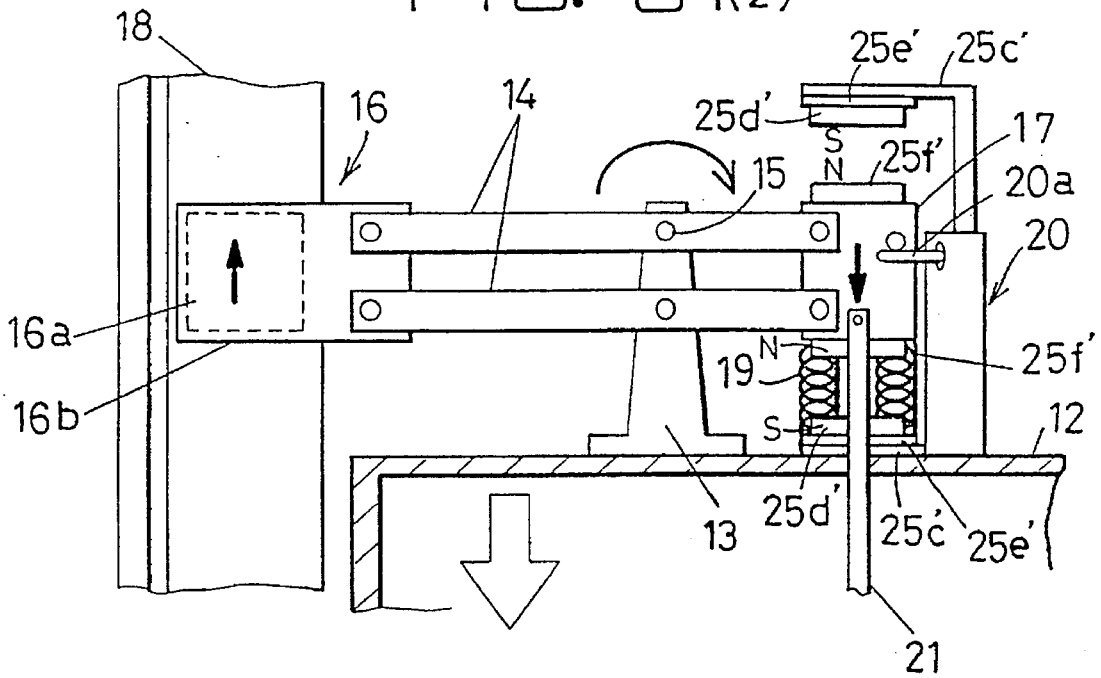

As shown in FIGS. 31(1) and 31(2), in the embodiment 16, a magnetic spring 25' is disposed on the opposite side to the pickup 16. Referring to FIGS. 31(1) and 31(2), reference character **25*d*' denotes a pair of counter magnets provided in a spaced relationship by a predetermined distance from each other in the vertical direction and in an opposing relationship to each other with the balance weight 17 interposed therebetween, 25*e*' a pair of counter yokes for holding the counter magnets 25*d*' thereon, 25*f* a pair of magnets fixedly mounted on an upper face and a lower face of the balance weight 17 in an opposing relationship with different polarities to the counter magnets 25*d*' in order to form a sub magnetic circuit, and 25*c*' a base mounted on the upper face of the car 12 for holding the counter magnets 25*d*'** thereon.

Figure 32:
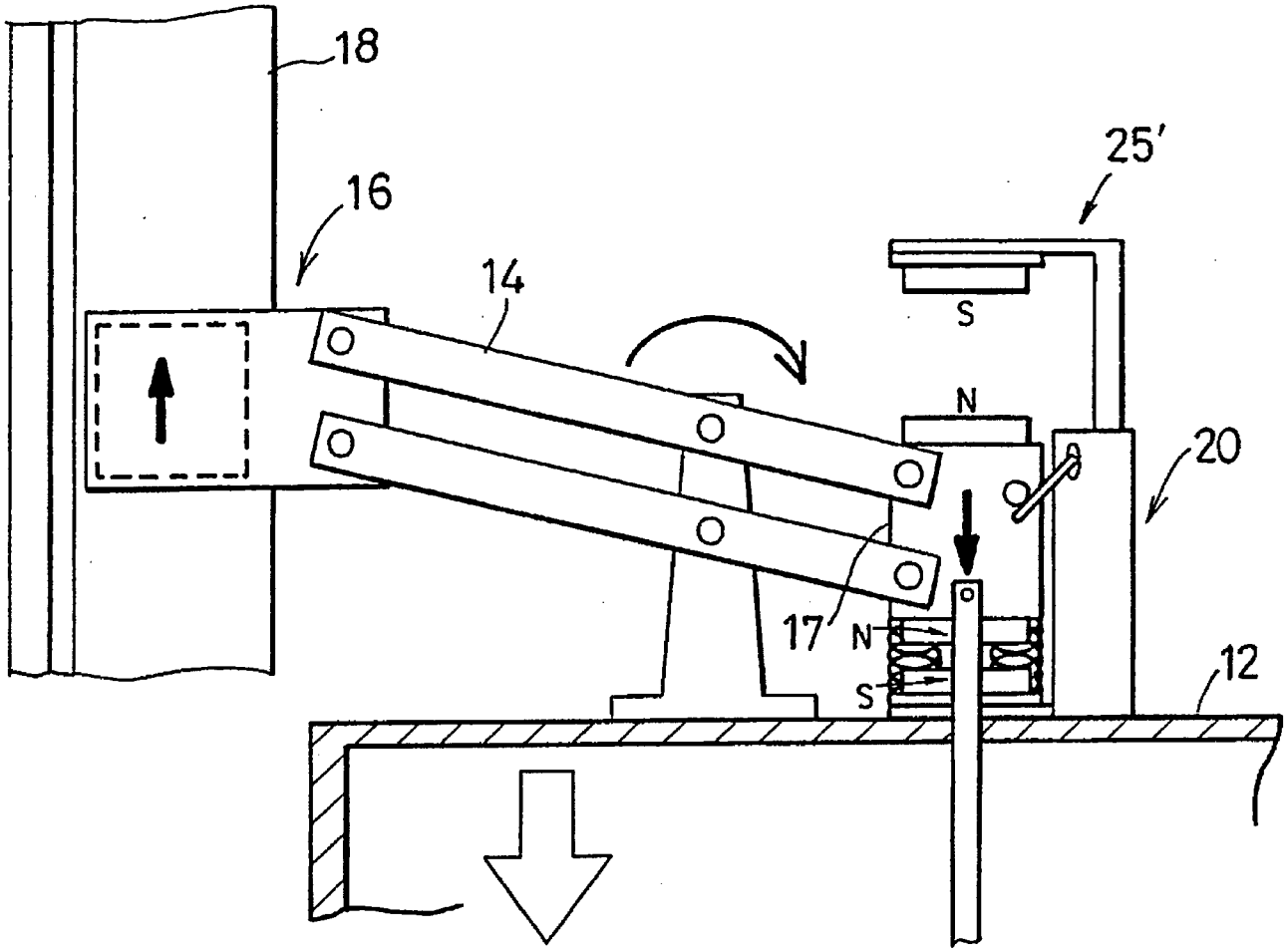
FIG. 32 is a front elevational view showing a condition in which an arm of the embodiment 16 is pivoted clockwise.

The sub magnetic circuit formed by the magnets **25*f* and the counter magnetic circuit attract each other since the counter magnets 25*d*' and the magnets 25*f*0 are provided in an opposing relationship with different polarities from each other. The attracting force exhibits its minimum value when the arm 14 is in its horizontal position as shown in FIG. 31(2), and increases as the arm 14 increases its pivotal motion as seen in FIG. 32. In other words, by the magnetic circuit of the magnetic spring 25', a force to assist pivotal motion of the pickup 16 acts in a high speed region of the car 12**.

Embodiment 17

Figure 33:
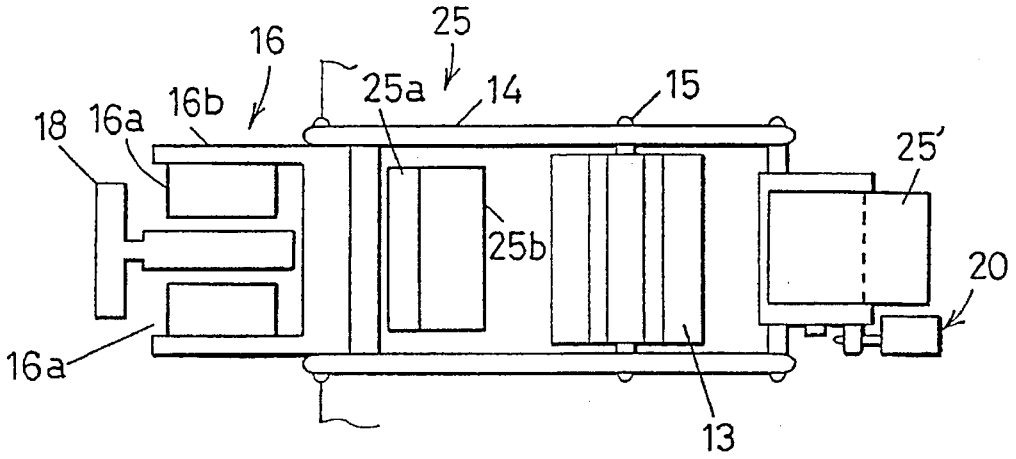
FIG. 33(1) is a plan view showing an embodiment 17 of the present invention.
Figure 33:
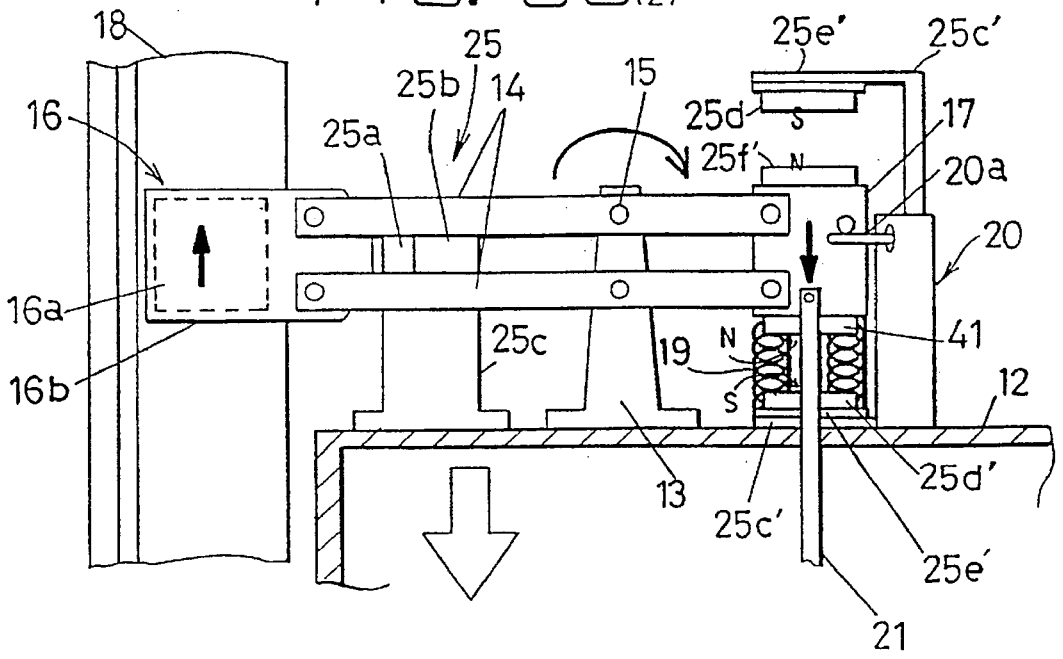

As shown in FIGS. 33(1) and 33(2), in the embodiment 17, a magnetic spring is formed by the magnetic spring 25 provided in the proximity of the pickup 16 for exerting a strong braking force when the amount of pivotal motion of the arm 14 is small, and the magnetic spring 25' provided in the proximity of the balance weight 17 for assisting the pivotal motion as the amount of pivotal motion of the arm 14 increases.

Operation will be described subsequently. In the case of the present embodiment 17, when the car 12 runs at a low speed, the displacement of the pickup 16 is small and a strong resisting force to the displacement of the pickup 16 acts by an action of the magnetic spring 25. However, as the speed of the car 12 rises and the displacement of the pickup 16 increases, since a force tending to assist pivotal motion of the arm 14 acts by an action of the magnetic spring 25', and consequently, when the car 12 runs at a high speed, the pickup 16 exhibits a great displacement, by which the safety and the certainty are further improved. Although any combination may be employed as the combination of the means for correction at a low speed and the means for correction at a high speed, where the construction of the magnetic spring is separated to the magnetic force generation side and the counterweight side as in the embodiment 17, the arrangement of the apparatus can be dispersed, which facilitates designing, assembly and adjustment.

Embodiment 18

Figure 34:
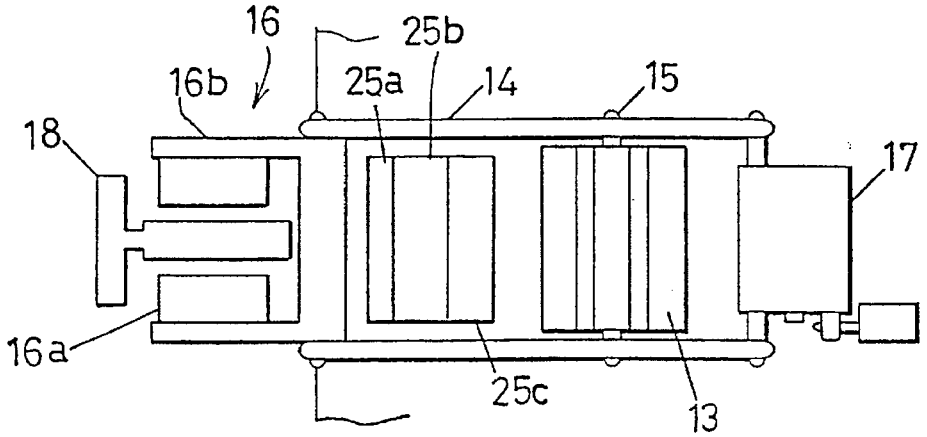
FIG. 34(1) is a plan view showing an embodiment 18 of the present invention.
Figure 34:
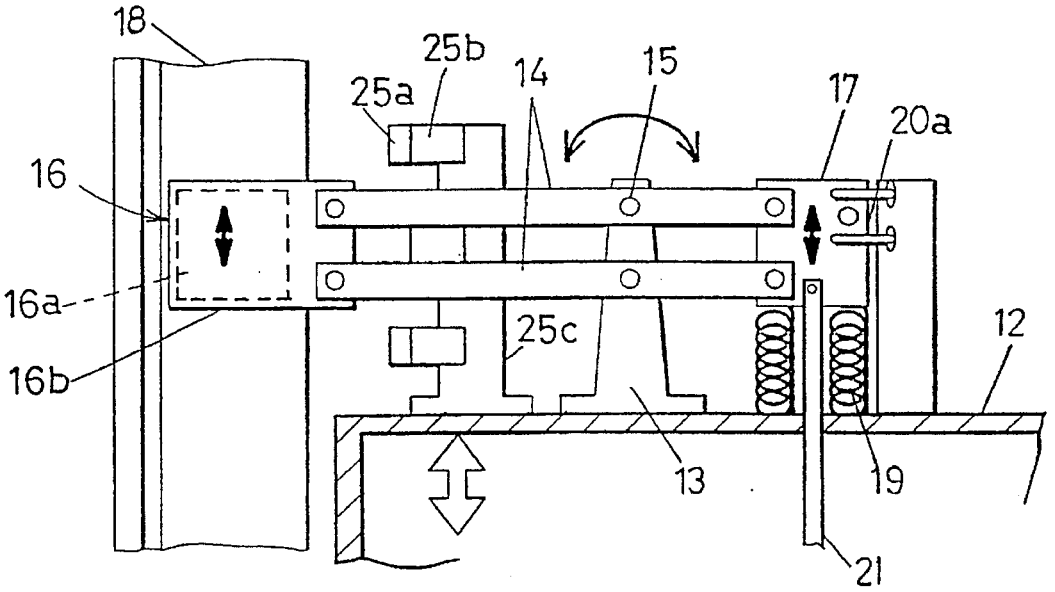

As shown in FIGS. 34(1) and 34(2), in the embodiment 18, a magnetic spring for exerting a strong braking force when the amount of pivotal motion of the arm 14 is small and another magnetic spring for assisting pivotal motion as the amount of pivotal motion of the arm 14 increases are provided in the proximity of the pickup 16. In the case of the present embodiment 18, the apparatus can be produced in a reduced size, which is advantageous in terms of the space.

Embodiment 19

Figure 35:
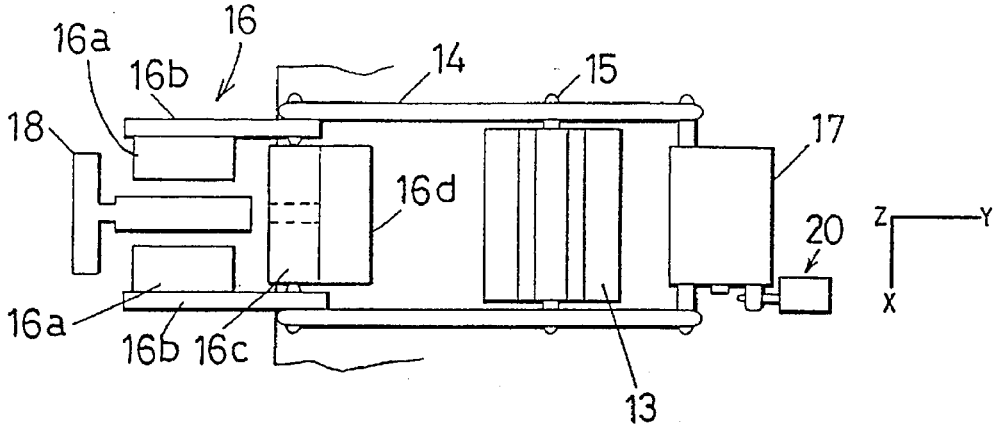
FIG. 35(1) is a plan view showing an embodiment 19 of the present invention.
Figure 35:
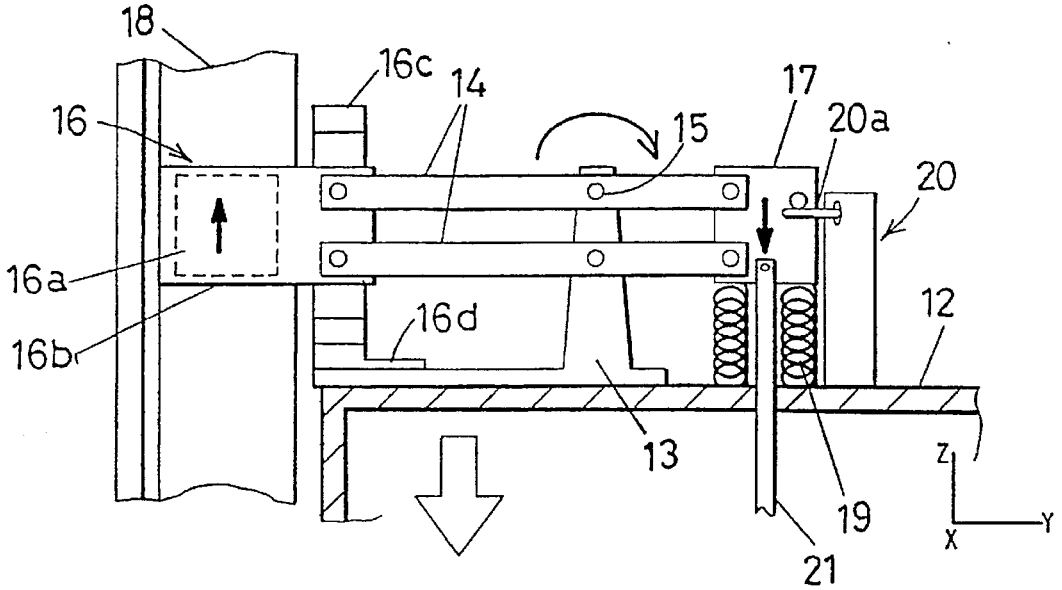
Figure 36:
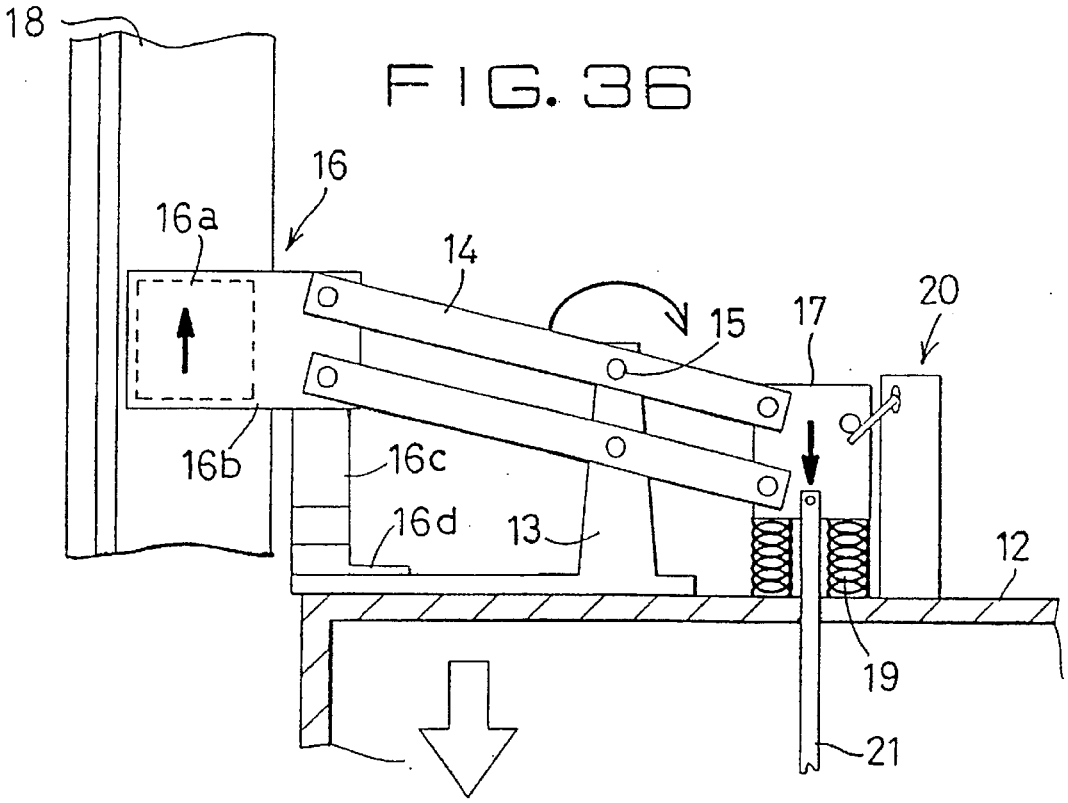
FIG. 36 is a front elevational view showing a condition in which an arm of the embodiment 19 is pivoted clockwise.
Figure 37:
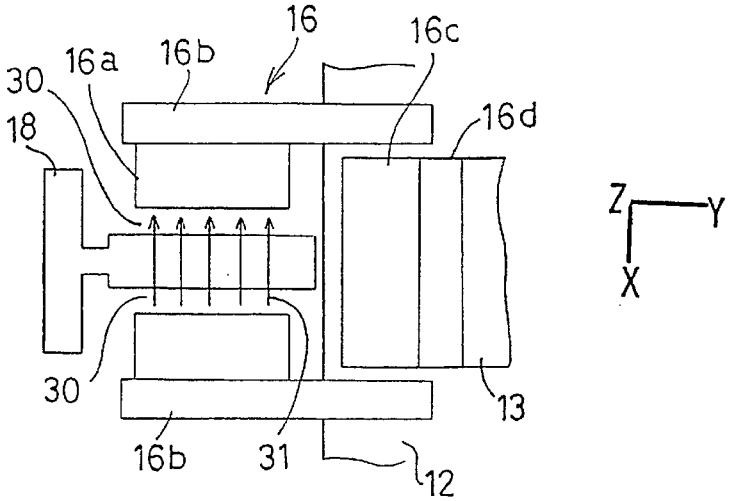
FIG. 37(1) is a plan view showing, in an enlarged scale, a construction of a pickup of the embodiment 19.
Figure 37:
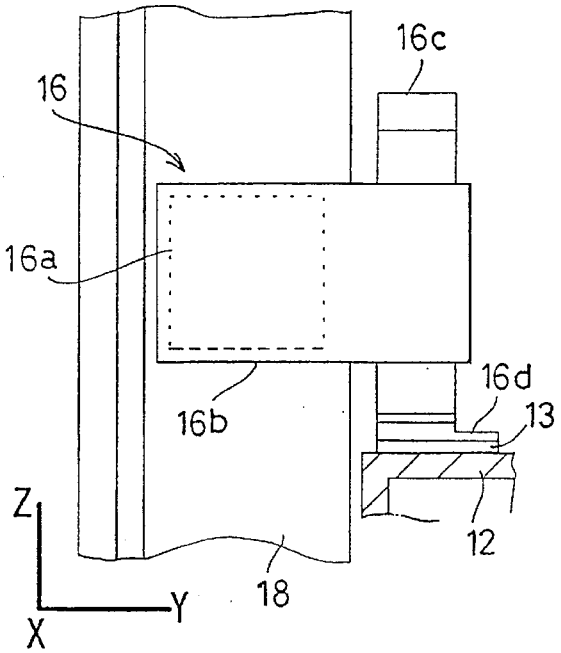
Figure 37:
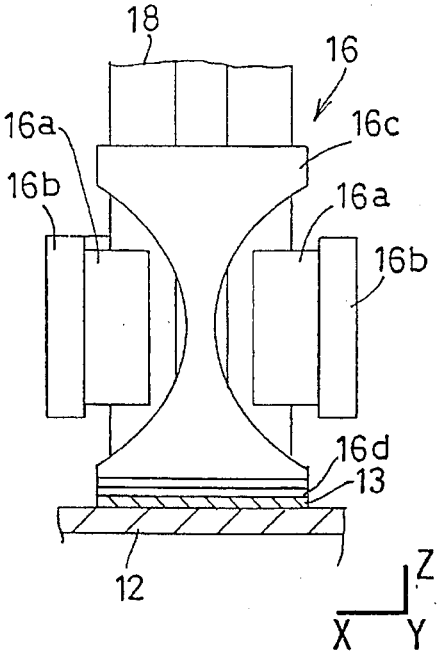

As shown in FIGS. 35(1) and 35(2), in the embodiment 19, the pickup 16 includes a pair of magnets **16*a* disposed in an opposing relationship on the opposite sides of the conductor 18, and yokes 16*b* and 16*c* for assuring a path for magnetic fluxes of the two magnets 16*a*. The yokes 16*b* are connected to the arm 14, and the yoke 16*c* is mounted at a fixing portion 16*d* thereof on the base 13. As shown in FIGS. 37(1) to 37(3), the yokes 16*b* and the yoke 16*c* are separate from each other with gaps left therebetween, and where the longitudinal direction of the conductor 18 (the direction of movement of the car 12) is taken as a Z-axis, the direction perpendicular to the plane of the conductor 18 is taken as a Y-axis and the direction perpendicular to the Z- and Y-axes is taken as an X-axis, a pair of surfaces of the yoke 16*c* in the Y-Z plane opposing to the yokes 16*b* are formed as concave faces. The concave faces are formed such that the distances between the yokes 16*b* and 16*c* are in the maximum when the arm 14 is in its horizontal position and the centers of the concave faces are opposed to the yokes 16***b* when the arm 14 is in its horizontal position, but when the arm 14 is pivoted to an oblique position, the distances between the yokes 16*b* and 16*c* decrease. The yoke 16*c* is securely mounted on the base 13 by way of the fixing portion 16*d* so that, even if the car 12 moves to pivot the pickup 16 around the fulcrum 15, the pickup 16 is not pivoted (refer to FIG. 36).

Subsequently, operation will be described. Generally in a car speed detection system which makes use of eddy currents, the strength of the drag generated in the pickup 16 (generated force against the movement of the car 12) increases in proportion to the amount of magnetic fluxes 31 (refer to FIG. 37(1)) of the air gaps 30 on the opposite sides of the conductor 18, and the amount of magnetic fluxes 31 depends upon the degree of easiness of passage of magnetic fluxes (the magnitude of the magnetic reluctance). Therefore, in the embodiment 19, the amount of the magnetic fluxes 31 acting upon the pickup 16 increases as the speed of the car 12 increases by employing the construction wherein the magnetic fluxes 31 are not easy to pass (the magnetic reluctance of the magnetic circuit is high) when the speed of the car 12 is low, but as the speed increases, the magnetic fluxes 31 become easier to pass (the magnetic reluctance decreases).

Figure 38:
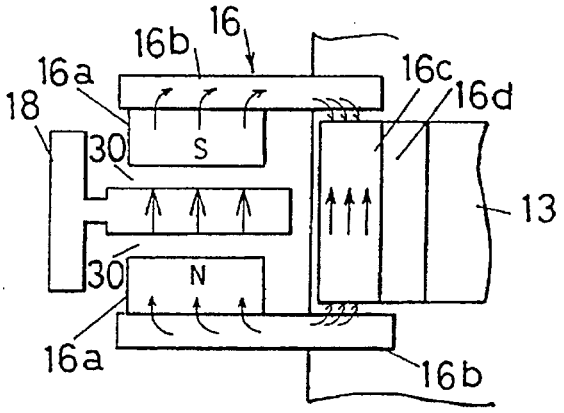
FIG. 38(1) is a plan view showing a flow of magnetic fluxes of a magnetic circuit portion of the pickup when the arm is parallel in the embodiment 19.
Figure 38:
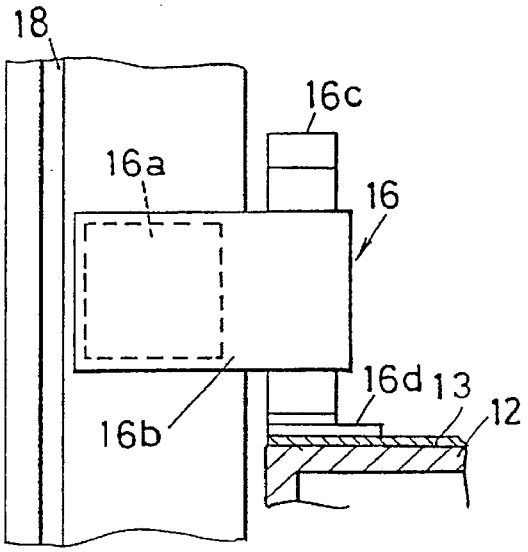
Figure 38:
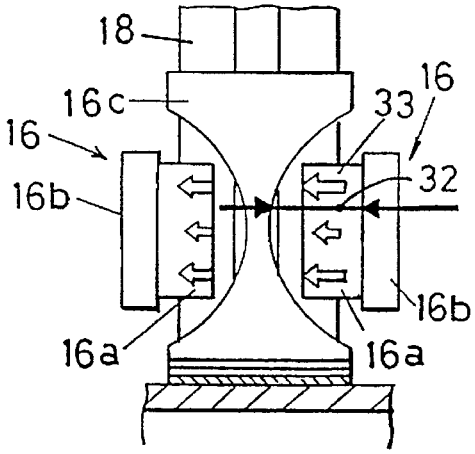
Figure 39:
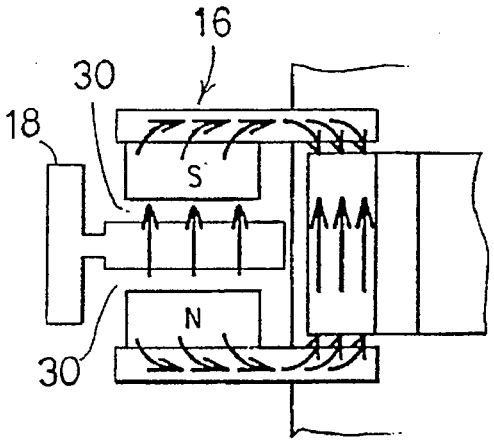
FIG. 39(1) is a plan view showing a flow of magnetic fluxes of a magnetic circuit portion of the pickup when the arm is inclined in the embodiment 19.
Figure 39:
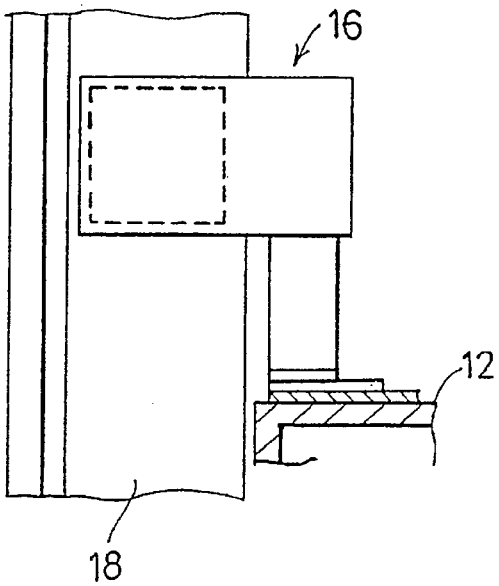
Figure 39:
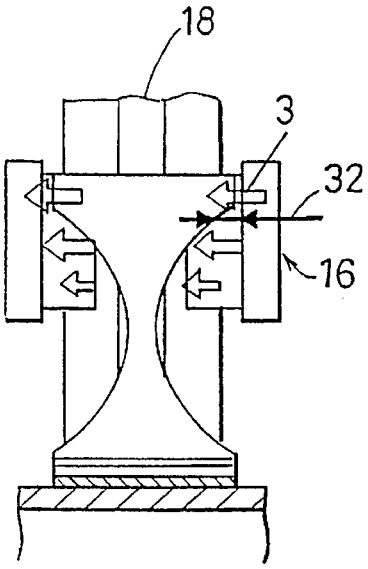

As seen in FIGS. 38(1) to 38(3) and FIGS. 39(1) to 39(3), in the embodiment 19, the pickup 16, the yokes 16*b* and 16*c* and the conductor 18 form a magnetic path along which magnetic fluxes pass via the air gaps 30. If, for the example, the lengths of the air gaps on the opposite sides of the conductor 18 or the lengths of the air gaps 32 between the yokes 16*b* and 16*c* increase, then magnetic fluxes become less easy to pass, and consequently, magnetic fluxes 33 which pass the air gaps 32 decreases and also the generated force generated in the pickup 16 by eddy currents decreases. On the contrary, if the lengths of the air gaps 32 decrease, then the amount of magnetic fluxes increases and generation of eddy currents increases, and also the generated force increases. In the embodiment 19, magnetic fluxes flow as seen in FIGS. 38(1) and 38(3) when the arm 14 is in its horizontal position (when the pickup 16 is in a stationary condition relative to the car 12), and since magnetic fluxes pass central portions of the concave faces of the yoke 16*c*, the air gaps 32 are large and the magnetic reluctance is high. Consequently, only a little amount of magnetic fluxes passes the pickup 16. When the speed of the car 12 increases so that the arm 14 is pivoted, the yokes 16*b* are raised as shown in FIG. 39(2) and such a magnetic path as seen in FIGS. 39(1) and 39(3) is formed. As this condition is entered, since the air gaps 32 between the yokes 16*b* and 16*c* is reduced and the magnetic reluctance is reduced, magnetic fluxes become easy to pass the pickup 16, and the magnetic fluxes 31 in the air gaps 30 on the opposite sides of the conductor 18 are increased. The variation of the strength B of the magnetic fluxes 31 in the air gaps 30 on the opposite sides of the conductor 18 with respect to the displacement z of the pickup 16 in the upward or downward direction is such as, for example, illustrated in FIG. 40 where the magnitude of magnetic fluxes at the position where magnetic fluxes pass in the maximum is represented by 1. Consequently, in the embodiment 19, as the arm 14 is pivoted so that the pickup 16 is moved upwardly or downwardly, the strength B of the magnetic fluxes 31 increases, and a decrease of the gradient of the generated force arising from a rise of the speed of the car 12 is corrected.

Figure 40:
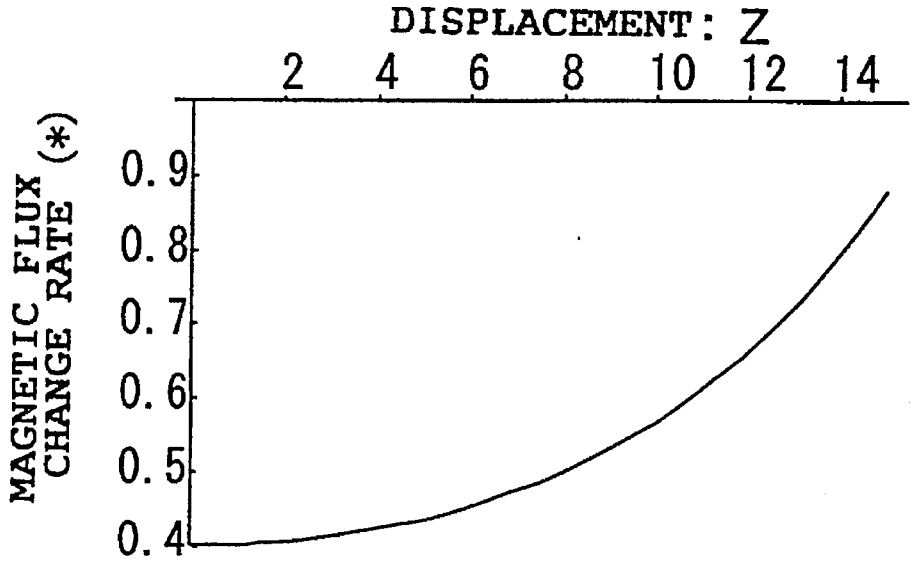
FIG. 40 is a diagram illustrating a variation of magnetic fluxes of a pickup portion with respect to a displacement of the pickup of the embodiment 19.
Figure 41:
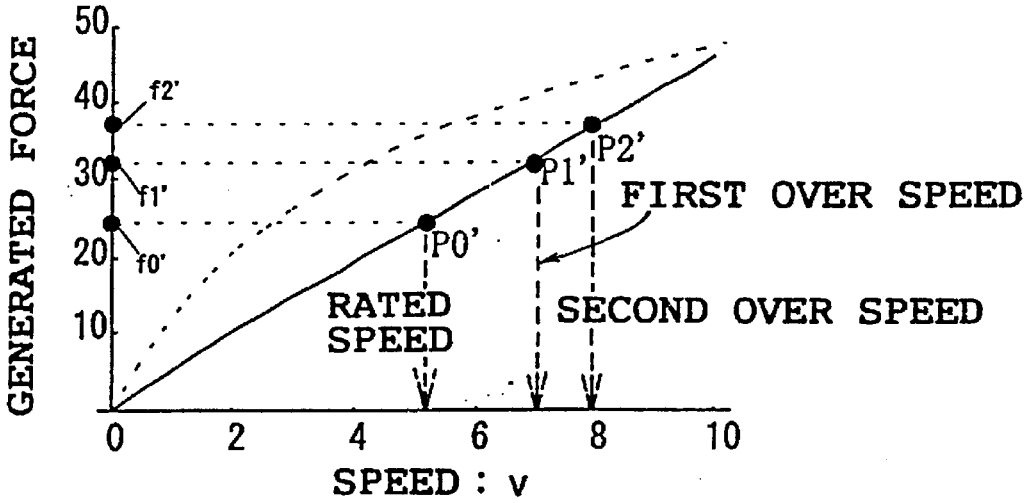
FIG. 41 is a diagram illustrating a generated force of the pickup with respect to a speed of a car of the embodiment 19.

The characteristic of the generated force when the car speed becomes high in the embodiment 19 is such as illustrated in FIG. 41 since the characteristic of FIG. 95 and the characteristic of FIG. 40 which are physical characteristics are superposed. From FIG. 41, it can be seen that, comparing with the distances between the generates forces f0, f1 and f2 of FIG. 95, the distances between the generated forces f0', f1' and f2' of FIG. 41 are greater, and the difference of the generated force at the rated speed from the generated forces at the fist and second over speeds can be made greater. Consequently, the displacement of the balance weight 17 with respect to the variation of the speed of the car 12 is improved very much also in a high speed region. As a result, the safety apparatus is easy to set a setting position and is reduced in malfunction, and the accurateness and the certainty of the operation speed are increased.

In the construction of the present embodiment, since the magnetic reluctance of the pickup 16 is varied by the magnitudes of the air gaps 32, a great variation of the magnetic reluctance can be obtained.

Figure 42:
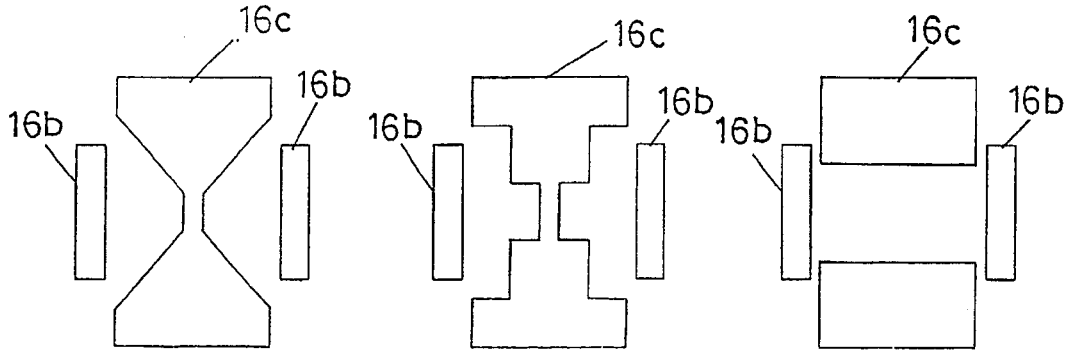
FIG. 42(1) is a right side elevational view showing another shape of a yoke of the embodiment 19.

It is to be noted that the yoke 16*c* may have any shape if it provides a great distance from the yokes 16*b* when the arm 14 is in its horizontal position but provides a small distance when the arm 14 is pivoted. For example, the yoke 16*c* may have such a construction that it is cut obliquely into a concave shape as shown in FIG. 42(1), or it has such a stepped configuration as shown in FIG. 42(2), or else it does not have, at the horizontal portion corresponding to the position of the yokes 16*b*, the yoke 16*c* but has a pair of yokes 16*c* above and below the same as shown in FIG. 42(3).

Figure 43:
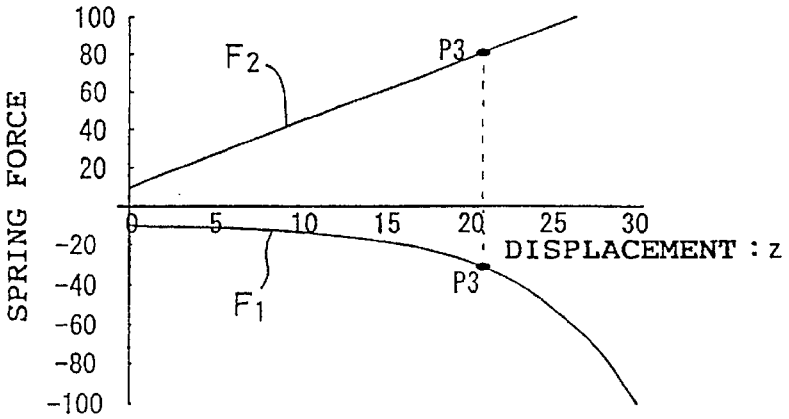
FIG. 43 is a diagram illustrating a relationship of a spring force generated in a elastic spring and a magnetic spring with respect to a displacement of a pickup of the embodiment 19.
Figure 44:
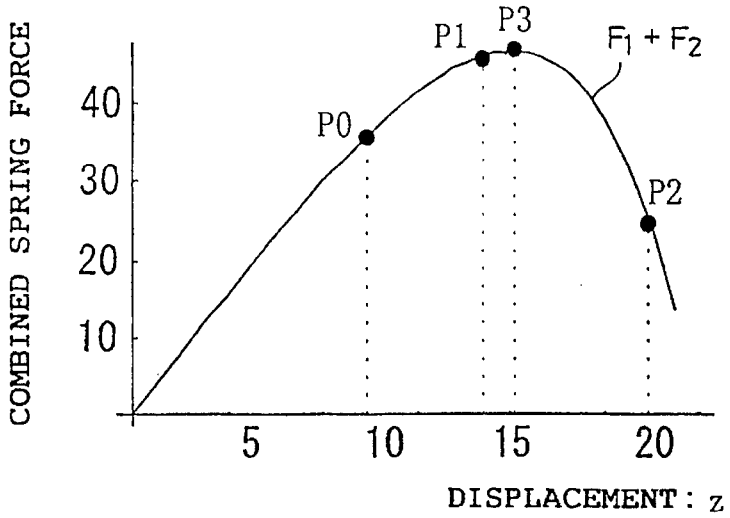
FIG. 44 is a diagram illustrating a combined spring force of the elastic spring and the magnetic spring of FIG. 43.
Figure 45:
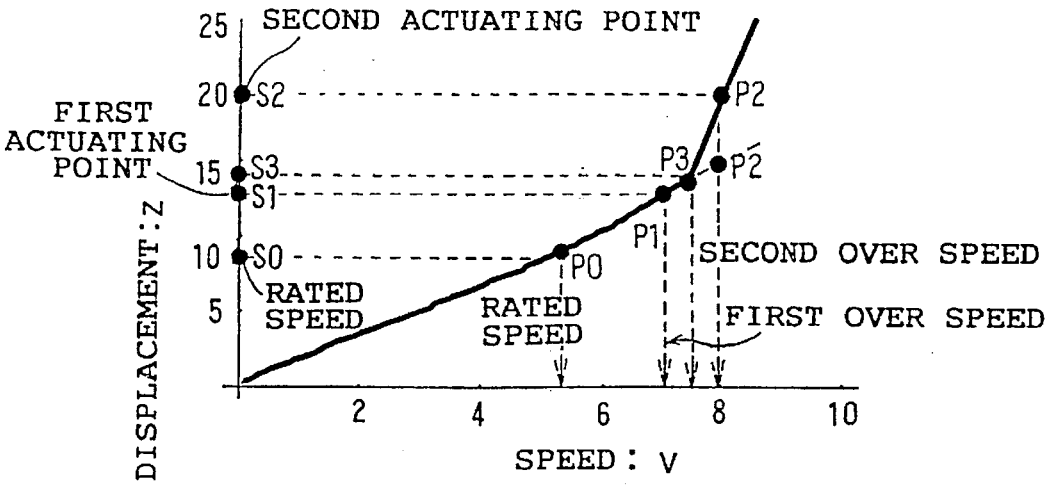
FIG. 45 is a diagram illustrating a displacement of a pickup with respect to a speed of a car of the embodiment 19.

Further, the certainty of operation can be further improved if the spring force by the holding elastic spring 19 and the variation of the magnetic reluctance is designed in such a manner as described below. In particular, the relationship between the displacement of the pickup 16 in the upward or downward direction and the spring force F1 of the magnetic spring by the variation of the magnetic reluctance of the pickup 16 is such as, for example, illustrated in FIG. 43 since, as the arm is inclined, magnetic fluxes increase and the attracting force increases. As shown in FIG. 43, since the relationship between the upward or downward displacement z of the pickup 16 and the elastic spring force F2 for holding the arm 14 normally is in a linear relationship, the elastic spring force F2 for holding the arm 14 and the magnetic spring force F1 are combined so that such a non-linear spring as illustrated in FIG. 44 is formed. This non-linear spring exhibits a high spring constant when the arm 14 is in the proximity of its horizontal position, and as the arm 14 is pivoted, the spring constant decreases (the gradient decreases). Then, at the displacement P3 at which the gradients of the magnetic spring force F1 and the elastic spring force F2 become equal to each other, the spring constant is zero (the gradients are zero), and thereafter, as the displacement increases, the spring constant exhibits a negative value (as the displacement increases, the force tending to move back decreases, that is, the gradient becomes negative in sign). Consequently, a characteristic wherein a small displacement is obtained within the rated speed but a large displacement is obtained in an over speed range is obtained, and a reduction in sensitivity to the force at a high speed caused by eddy currents described above can be corrected at the position at which the safety apparatus is rendered operative. Further, with this spring, if the speed of the car 12 continues to rise even after the spring constant is reduced to zero at the displacement P3 of FIG. 44, then since the spring constant decreases due to an increase in pulling force by the magnetic spring F1, the displacement of the pickup 16 increases suddenly as seen in FIG. 45, and the safety apparatus operates with a high degree of certainty. Here, if the displacement P3 at which the gradients of the magnetic spring force F1 and the elastic spring force F2 become equal to each other is set to a value between the first over speed and the second over speed as seen in FIG, 45, then the actuating position of the emergency stop which is the final stopping apparatus can be taken high, and a certain emergency stopping operation can be performed with a low probability of a malfunction.

Embodiment 20

Figure 46:
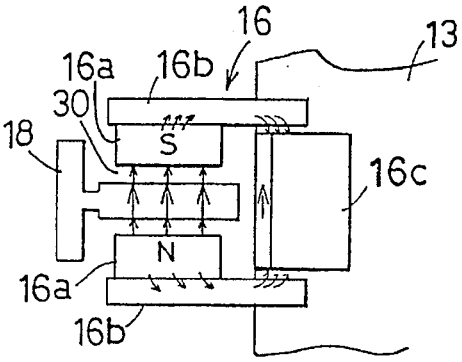
FIG. 46(1) is a plan view showing a pickup portion when an arm in an embodiment 20 of the present invention is horizontal.
Figure 46:
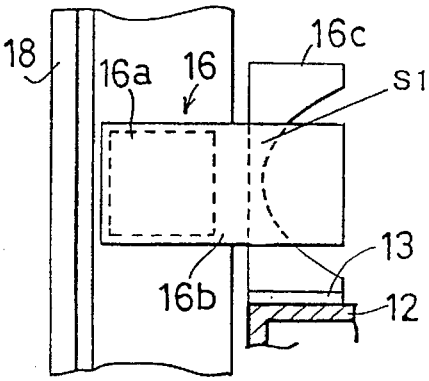
Figure 46:
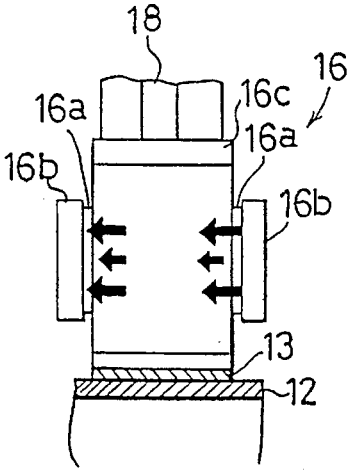

As shown in FIGS. 46(1) to 46(3) and 47(1) to 47(3), the embodiment 20 employs a different structure from that of the embodiment 19 by which the amount of magnetic fluxes in the air gaps on the opposite sides of the conductor 18 si made different whether the arm 14 is in its horizontal position or in its pivoted position. The yokes **16*b* and 16*c* are separate with gaps left therebetween, and where the longitudinal direction of the conductor 18 (the direction of movement of the car) is defined as a Z-axis, the direction perpendicular to the plane of the conductor 18 is defined as a Y-axis and the direction perpendicular to the Z- and Y-axes is defined as an X-axis, then the yoke 16*c* has a concave spherical phase along the Z-X plane. The concave spherical phase is formed such that, as shown in FIGS. 46 (1) and 46(3), the center of the concave face comes to the positions of the yokes 16*b* when the arm 14 is in its horizontal position. The magnets 16*a*, the yokes 16*b* and 16*c* and the conductor 18 form a magnetic path along which magnetic fluxes pass via the air gaps. The yoke 16*c* is connected to the base 13 so that the yoke 16*c* is not pivoted even if the car 12 moves and the yokes 16*b* are pivoted around the fulcrum 15**.

Figure 47:
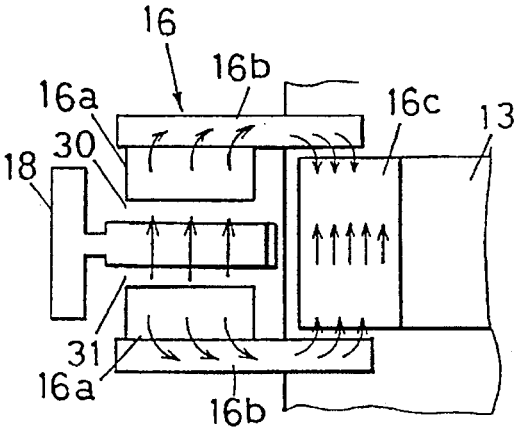
FIG. 47(1) is a plan view showing a pickup portion when the arm of the embodiment 20 is inclined.
Figure 47:
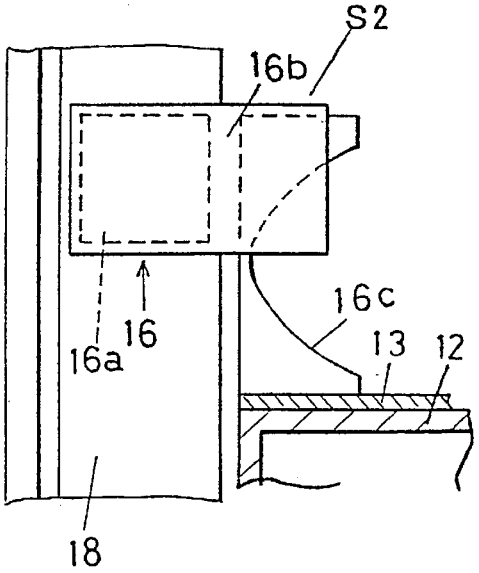
Figure 47:
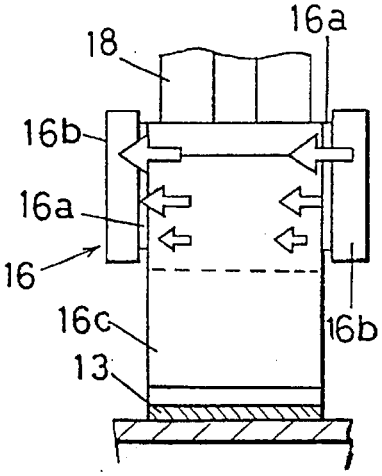

Operation will be described subsequently. As shown in FIGS. 46(1) to 46(3), when the arm 14 is in its horizontal position, the area S1 of the yoke **16*c* which is opposed to the yokes 16*b* and through which magnetic fluxes flow is small, but when the arm 14 is pivoted as shown in FIGS. 47(1) to 47(3), the area of the yoke 16*c* through which magnetic fluxes flow is increased to S2. When the area of the yoke 16*c* through which magnetic fluxes flow is small, the magnetic reluctance is high and the amount of the magnetic fluxes 31 in the air gaps 30 on the opposite sides of the conductor 18 is small. On the contrary, as the area of the yoke 16*c* through which magnetic fluxes flow increases, the magnetic fluxes 31 increase. Accordingly, a overspeed protection apparatus with which the same effects as those of the embodiment 19 are obtained and wherein the degree of certainty of an operation of the safety apparatus when the speed of the car 12 rises can be obtained. Further, in the present embodiment, since the magnetic reluctance is varied by the area through which magnetic fluxes pass, it can be designed simply comparing with the embodiment 19 described above. It is to be noted that the face of the yoke 16*c* need not necessarily be a concave spherical face, and the yoke 16*c*** may have any other shape only if it provides a variation of the area through which magnetic fluxes pass.

Embodiment 21

Figure 48:
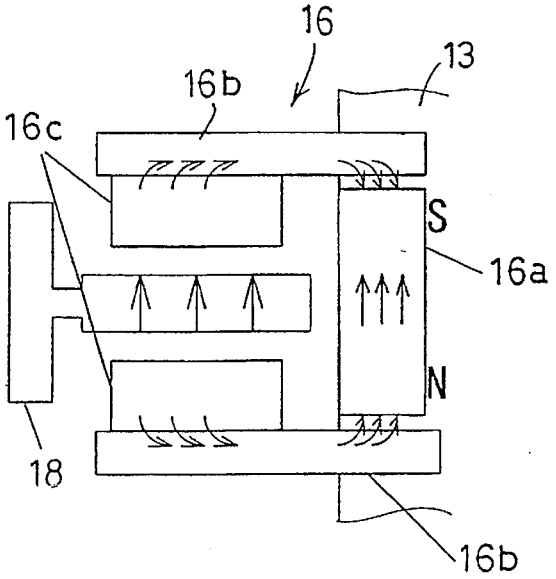
FIG. 48(1) is a plan view showing a pickup portion when an arm in the embodiment 21 of the present invention is horizontal.
Figure 48:
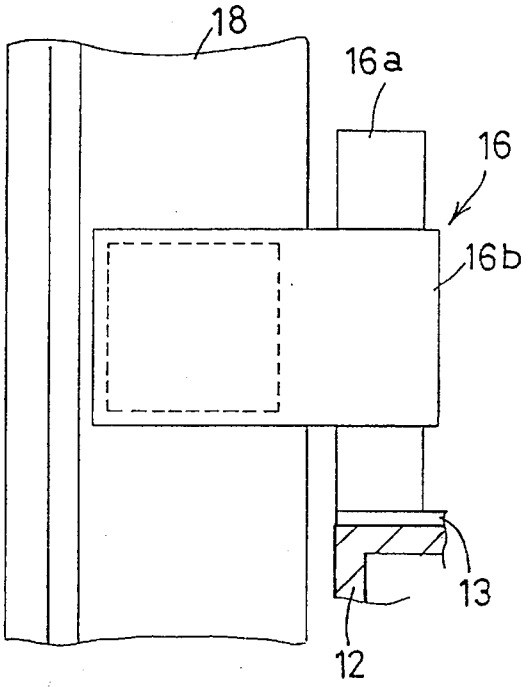
Figure 48:
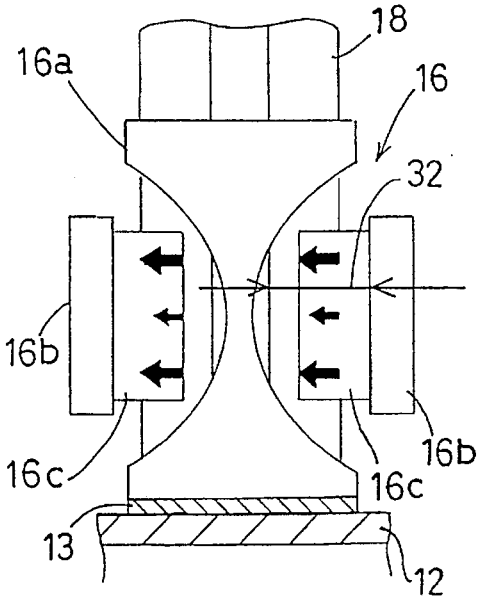

While, in the constructions of the foregoing embodiments, the magnets **16*a* are disposed on the opposite sides of the conductor 18, as shown in FIGS. 48(1) to 48(3)**, in the present embodiment *21*, a magnet **16*a* is disposed at an upper location on the base of the form described above, and a pair of yokes 16*c* are disposed on the opposite sides of the conductor 18. According to the present construction, since the magnet 16*a* is provided by one, the manufacture and the assembly are simple and reduction in cost can be achieved. Further, since the magnet 16*a* need not be placed at a location in the proximity of the conductor 18, even if the pickup 16 and the conductor 18 are contacted with each other by accident, amendment can be performed readily since such contacting portion is one of the yokes. While, in the present embodiment, the magnet 16*a* has the concave spherical faces along the Y-Z plane perpendicular to the plane which is opposed to the yokes 16*b* and through which magnetic fluxes pass, it may otherwise have the concave spherical face along the Y-Z plane which is perpendicular to the plane which is opposed to the yokes 16*b* and through which magnetic fluxes pass, or any other shape may be employed only if it increases magnetic fluxes passing through the pickup 16 when the arm 14** is pivoted.

It is to be noted that the magnetic circuit is not limited to the construction of the embodiment described above only if it has the construction wherein the magnetic reluctance is high at the horizontal position, but the magnetic reluctance is low and magnetic fluxes on the opposite sides of the conductor are great in amount at a pivoted position. Further, the arm 14 need not be parallel links and may have any construction only if it supports the magnetic circuit on the fulcrum 15.

Embodiment 22

Figure 49:
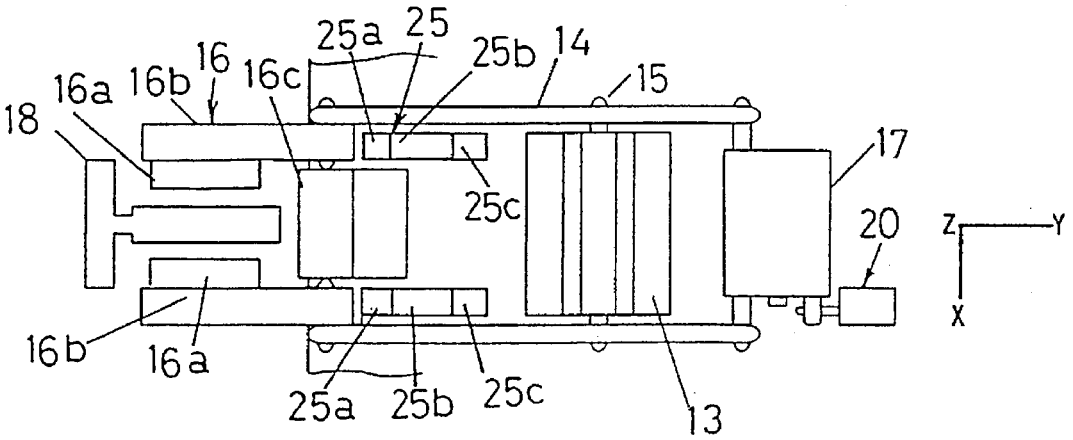
FIG. 49(1) is a plan view of an embodiment 22 of the present invention.
Figure 49:
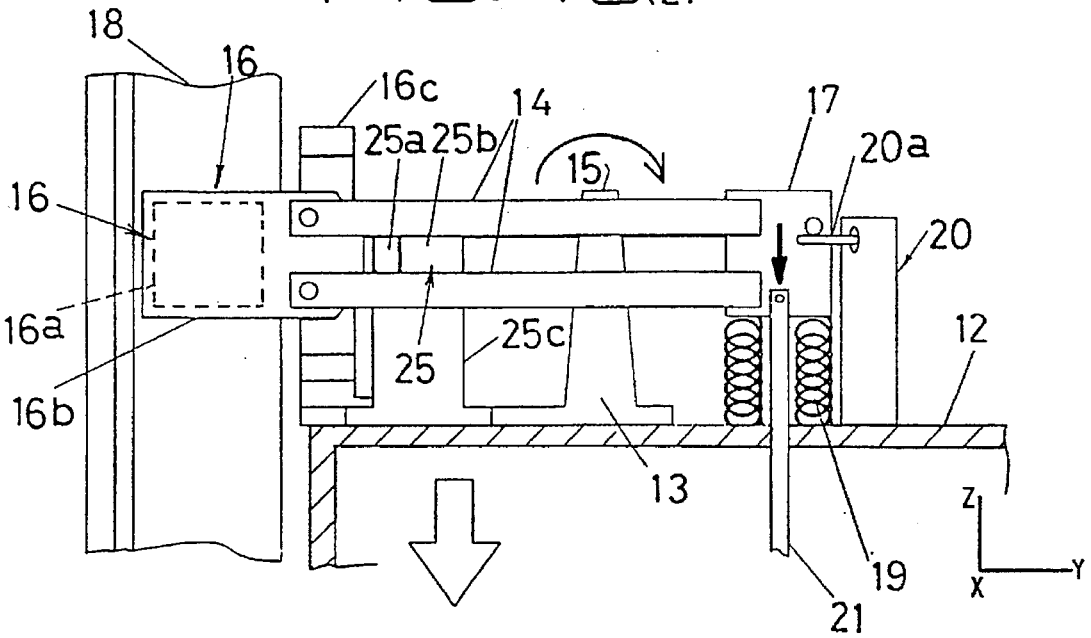

As shown in FIGS. 49(1) and 49(2), in the embodiment 22, a pair of magnetic springs 25 each including a magnet **25*a*, a yoke 25*b* and a base 25*c* are additionally provided for the yoke 16*c*** of the embodiment 19.

Operation will be described subsequently. With the construction of the present embodiment, when the car 12 runs at a low speed, the spring rigidity of the combined spring is increased with the magnetic force of the magnetic spring 25 to control the displacement of the pickup 16 to a low value. However, as the speed of the car 12 rises high, the magnetic force of the magnetic circuit of the pickup 16 increases and also the force tending to displace the pickup 16 in the upward or downward direction in which magnetic fluxes flow readily acts, and consequently, the displacement increases. Consequently, the safety can be further increased with a simple construction.

Embodiment 23

Figure 50:
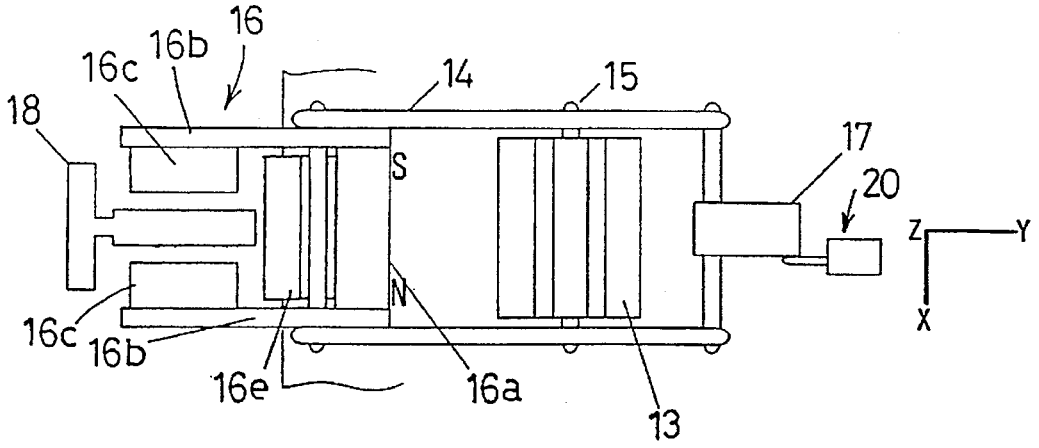
FIG. 50(1) is a plan view of an embodiment 23 of the present invention.
Figure 50:
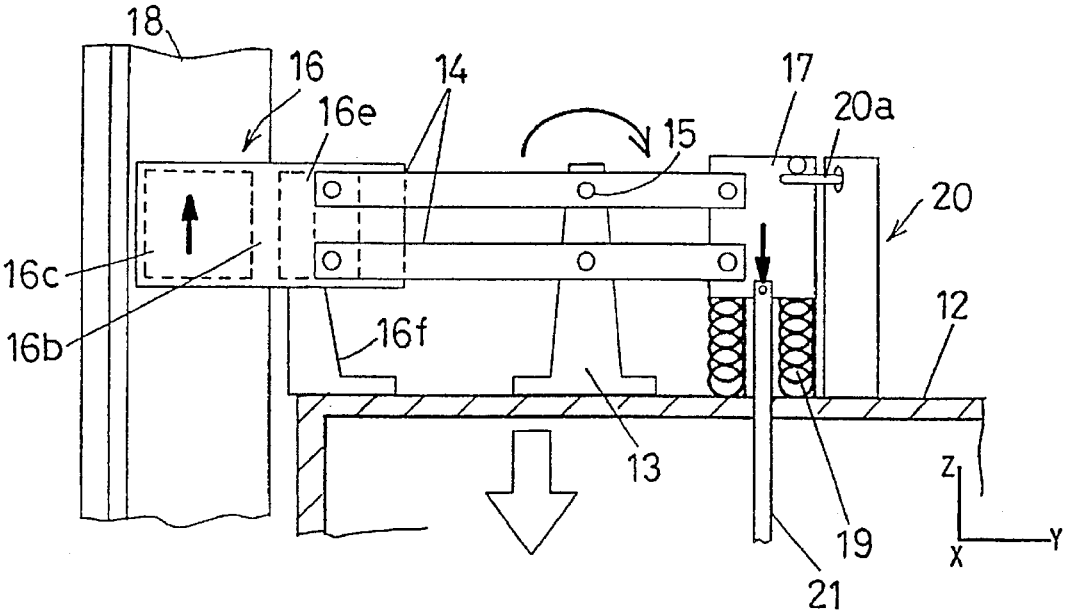
Figure 51:
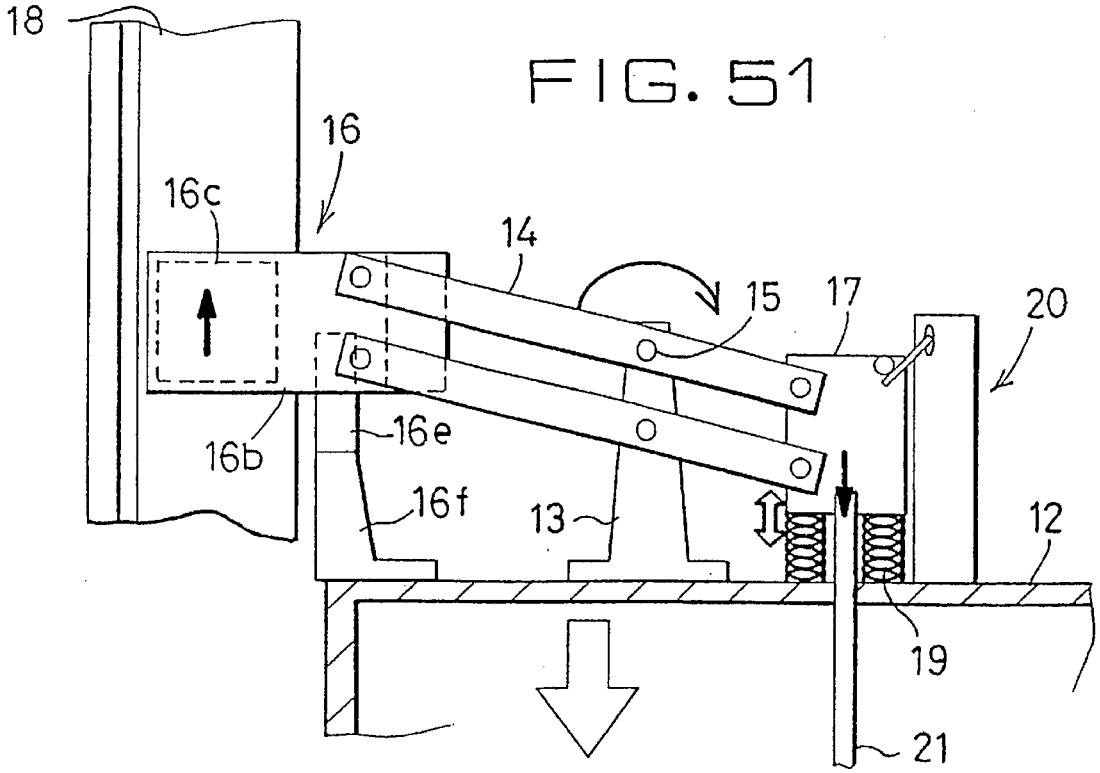
FIG. 51 is a front elevational view showing a condition in which an arm in the embodiment 23 is pivoted clockwise.

As shown in FIGS. 50(1) and 50(2), in the embodiment 23, a pair of yokes **16*c* are disposed on the opposite sides of the conductor 18 in an opposing relationship to the conductor 18, and are secured to the yokes 16*b*. The magnet 16*a* is held between end portions of the yokes 16*b* adjacent the balance weight 17. Reference character 16*e* denotes a bypass yoke for partially branching a flow of magnetic fluxes of the pickup 16 from an intermediate portion thereof. The yokes 16*b* and 16*c* and the magnet 16*a* are coupled integrally and connected to the arm 14. The bypass yoke 16*e* is separate from the yokes 16*c* with gaps left therebetween and is mounted on a base 16*f*. Even if the car 12 runs at a high speed and the yokes 16*b* and 16*c* and the magnet 16*a* are pivoted around the fulcrum 15, the bypass yoke 16*e* is not pivoted since it is secured to the base 16*f* as seen in FIG. 51**.

Figure 52:
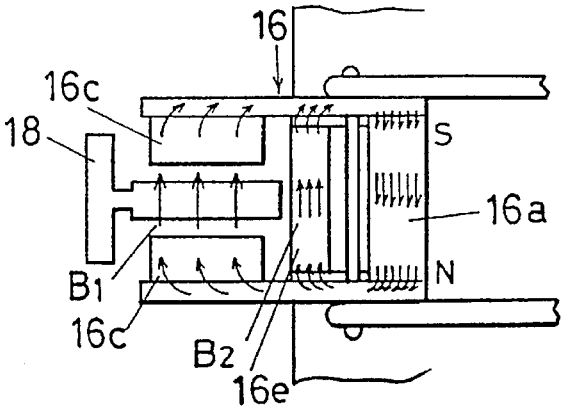
FIG. 52(1) is a plan view showing a pickup portion when the arm in the embodiment 21 of the present invention is parallel.
Figure 52:
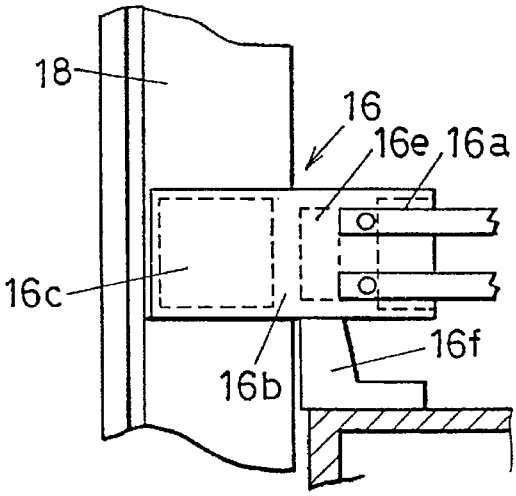
Figure 52:
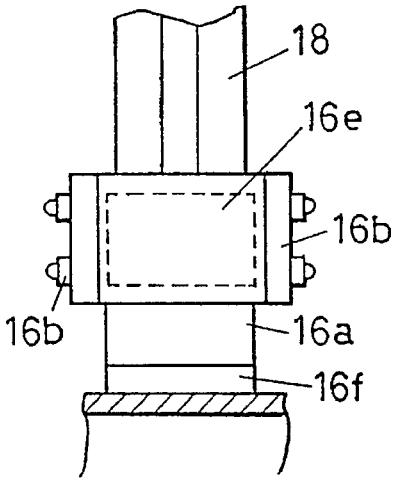

Operation will be described subsequently. As shown in FIGS. 52(1) and 52(2), in the present embodiment 23, a pair of magnetic circuits are formed including a main magnetic circuit B1 of the magnet **16*a*→yoke 16*b*→yoke 16*c*→conductor 18→yoke 16*c*→yoke 16*b*→magnet 16*a* and a sub magnetic circuit B2 of the magnet 16*a*→yoke 16*b*→bypass yoke 16*e*→yoke 16*b*→magnet 16*a*, and a route in which magnetic fluxes are to flow is changed whether the arm 14 is in its horizontal position or in its pivoted position in order to vary the amounts of magnetic fluxes in the air gaps on the opposite sides of the conductor 18 whether the arm 14** is in its horizontal position or in the pivoted position.

Figure 53:
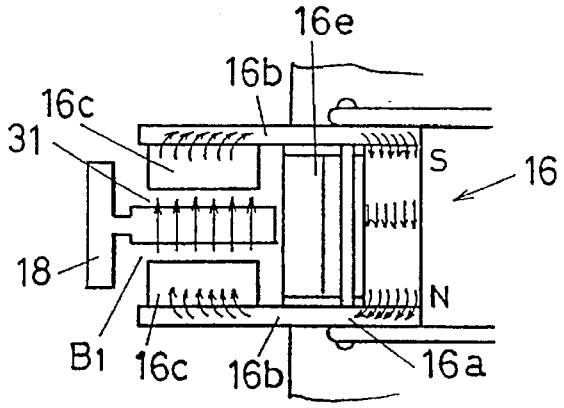
FIG. 53(1) is a plan view showing the pickup portion when the arm in the embodiment 21 of the present invention is inclined rightwardly downwards.
Figure 53:
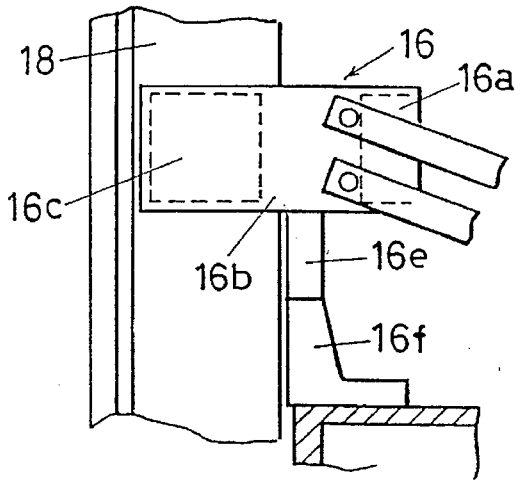
Figure 53:
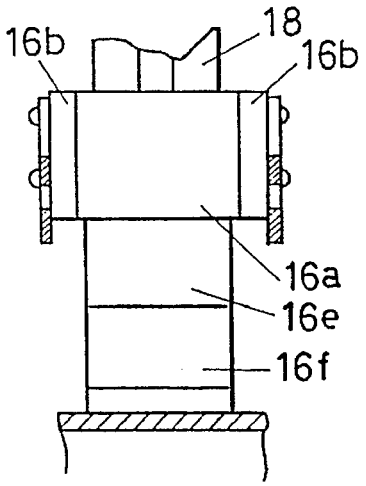

First, when the arm 14 is in its horizontal position, magnetic fluxes going out of the N pole of the magnet 16a pass a pair of magnetic paths of the main magnetic circuit B1 and the sub magnetic circuit B2 and return the S pole of the magnet **16*a*. Consequently, only part of the magnetic fluxes going out of the magnet 16*a* pass through the air gaps on the opposite sides of the conductor 18. Then, if the arm 14 is pivoted, then the bypass yoke 16*e* remains on the car 12 and the sub magnetic circuit B2 is not formed any more while only the main magnetic circuit B1 is formed as seen in FIGS. 53(1) to 53(3). In short, since magnetic fluxes going out of the magnet 16*a* all pass the main magnetic circuit B1, the magnetic fluxes 31 passing the conductor 18 increase as much. Accordingly, in the embodiment 23, when the arm 14 is in its horizontal position, the magnetic fluxes 31 passing the conductor 18 are small in amount, and if the arm 14 is pivoted, then the magnetic fluxes 31 on the opposite sides of the conductor 18 increase. Accordingly, an elevator overspeed protection apparatus wherein the certainty of an operation of the safety apparatus when the speed of the car 12** rises is high can be obtained.

It is to be noted that the bypass yoke **16*e* may be provided under the yokes 16*b* to form the sub magnetic circuit B2. The bypass yoke 16*e* is mounted on the base 16*f*, and when the arm 14 is pivoted, the magnet 16*a* and the yokes 16*b* and 16*c* are spaced away from the bypass yoke 16*e*. Consequently, as the arm 14 is pivoted, only the main magnetic circuit B1 is formed, and accordingly, similar effects to those of the embodiment 23 can be obtained. Similarly, the bypass yoke 16*e* may be provided in the rear of the magnet 16*a*. Further, part of the yokes 16*b* on the opposite sides may be formed as the magnet 16*a***.

It is to be noted that, in the construction of the present embodiment, since magnetic fluxes are easiest to pass when the arm 14 is in its horizontal position, a magnetic force tending to keep the arm 14 at the horizontal position acts upon the arm 14. Therefore, if the magnetic force is employed as a magnetic spring and the relationship of the spring forces is set in such a manner as described hereinabove in the embodiment 1, then a malfunction is further reduced and the stability is improved.

Embodiment 24

Figure 54:
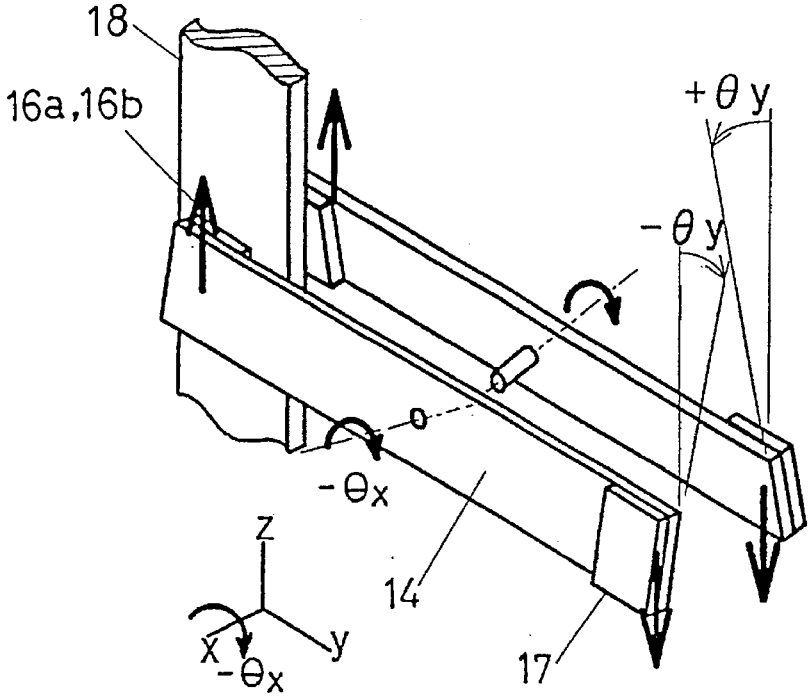
FIG. 54(1) is a perspective view showing schematically a pickup, an arm, and a balance weight when the arm in an embodiment 24 of the present invention is horizontal.
Figure 54:
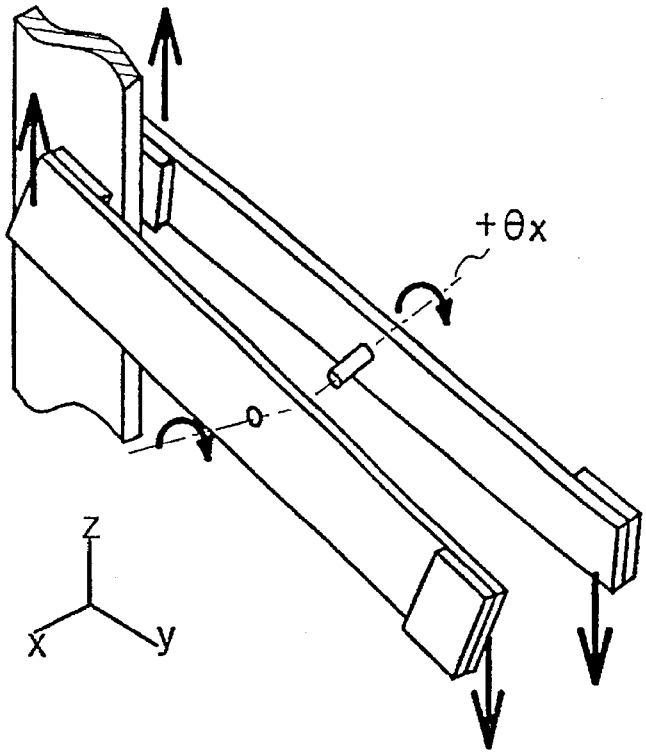

In the present embodiment 24, as shown in FIGS. 54(1) and 54(2), the pickup 16 includes a pair of magnets **16*a* disposed on the opposite sides in an opposing relationship to the conductor 18, and a pair of yokes 16*b* (which are shown, in FIGS. 54(1) and 54(2), in an integrated condition with the magnets 16*a*) having the magnets secured thereto for assuring paths for magnetic fluxes. The yokes 16*b* are connected to the arm 14 while the balance weight 17 is provided at the other end of the arm 14 such that the mass thereof and the left and right angular moments around the center of pivotal motion may be balanced with the pickup. The arm 14 is mounted on the base 13**.

Where the longitudinal direction of the conductor 18 (the direction of movement of the car 12) is defined as a Z-axis, the direction perpendicular to the plane of the conductor 18 is defined as a Y-axis and the direction perpendicular to the Z- and Y-axes is defined as an X-axis, the plane of pivotal motion of one of the links of the arm 14 is inclined at a lower end portion thereof to the outer side by an angle of $+\theta y$ with respect to the Z-X plane while the plane of pivotal motion of the other link of the arm 14 is inclined at a lower end portion thereof to the outer side by an angle $-\theta y$ with respect to the Z-X plane (as viewed from the Y direction, the planes of pivotal motion of the two links of the arm exhibit an arrangement of the non-parallel opposite sides of a trapezoid).

Subsequently, operation will be described. If the arm 14 is pivoted in the counterclockwise direction by an angle of $-\theta x$ around the X-axis as shown in FIG. 54(2), then the distance between the magnets **16*a* and the conductor 18 is decreased, but on the contrary if the arm 14 is pivoted in the clockwise direction by an angle of $+\theta x$, then the distance between the magnets 16*a* and the conductor 18 is increased. Accordingly, when the car 12 runs upwardly, the arm 14 is pivoted in the counterclockwise direction by a force obtained by eddy currents described above, and consequently, the distance between the magnets 16*a* and the conductor 18 decreases and the amount of magnetic fluxes acting upon the conductor 18 increases, resulting in increase of the drag by eddy currents. As a result, similarly as in the embodiments described above, a decrease of the gradient of the drag when the speed of the car 12** rises can be corrected.

Figure 55:
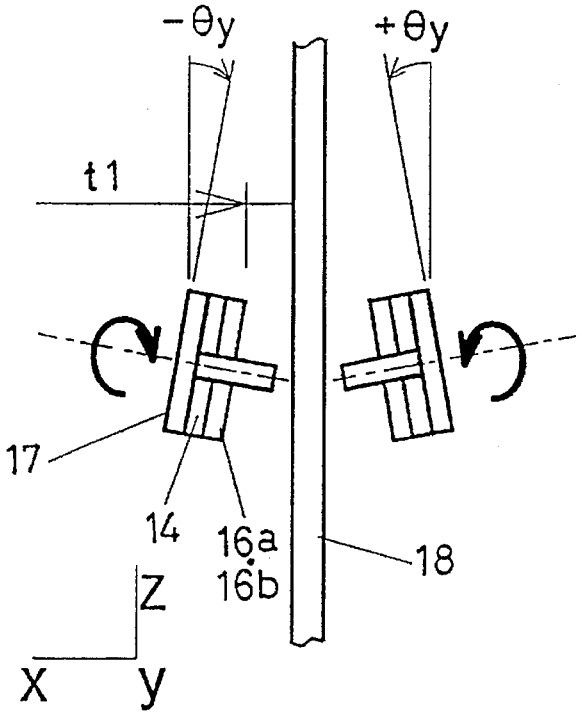
FIG. 55(1) is a right side elevational view showing a condition in which the arm in the embodiment 24 is horizontal.
Figure 55:
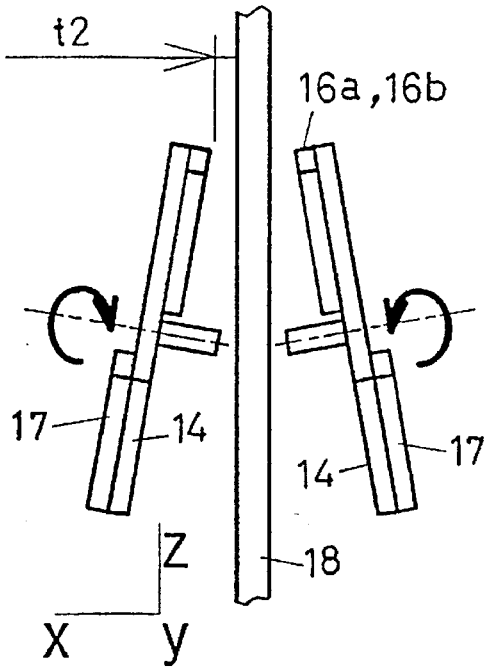
Figure 56:
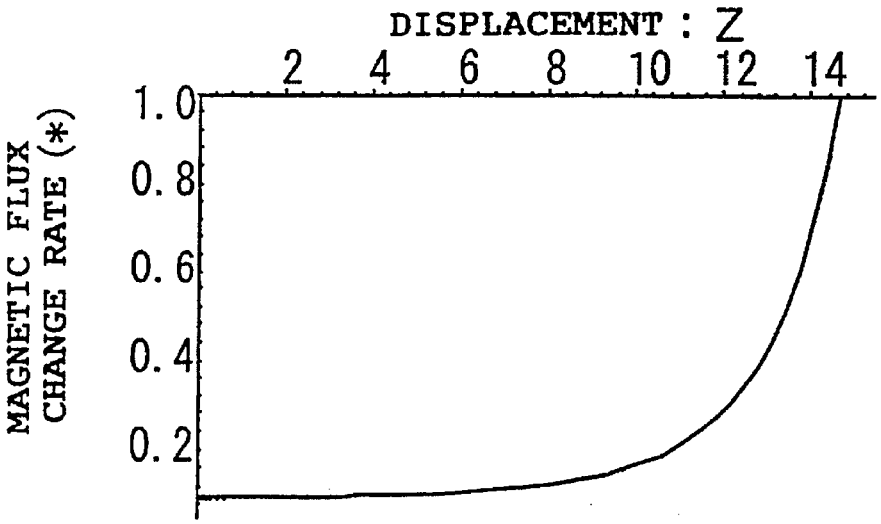
FIG. 56 is a diagram illustrating a variation of magnetic fluxes of a pickup portion with respect to a displacement of the pickup of the embodiment 24.
Figure 57:
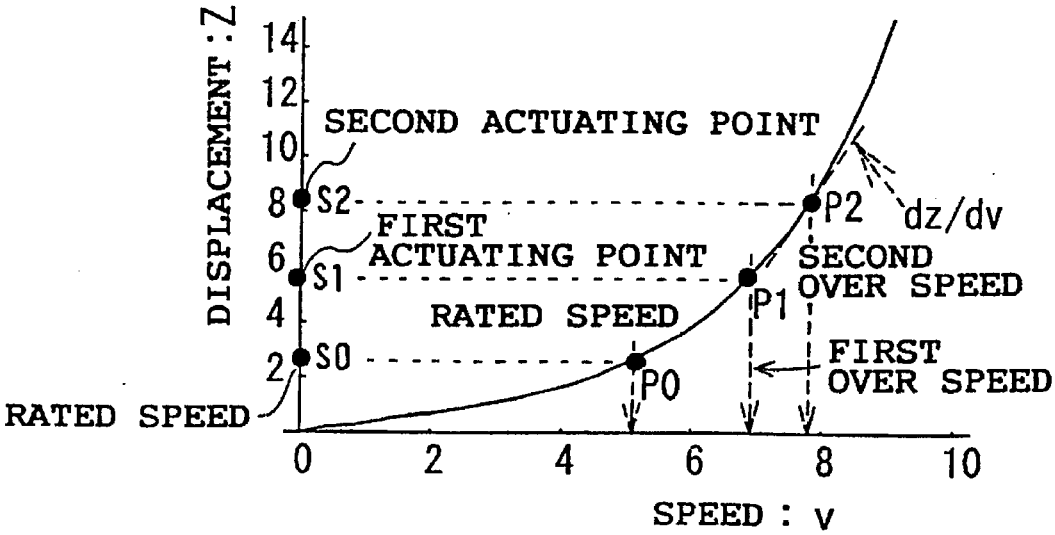
FIG. 57 is a diagram illustrating a displacement of the pickup portion with respect to a speed of a car of the embodiment 24.

The construction of the present embodiment 24 is advantageous in that, since the distance of the air gaps in which magnetic fluxes are generated varies directly, a variation of the amount of magnetic fluxes acting upon the pickup 16 can be obtained readily and that, since magnetic fluxes are easier to pass when the pickup 16 is pivoted in the upward direction, the force tending to rotate the pickup 16 upwardly as a magnetic force can be utilized as a magnetic spring. If the arm 14 is pivoted as shown in FIGS. 55(1) and 55(2) from its horizontal position shown in FIG. 55(1) and the pickup 16 is displaced in the -Z direction as shown in FIG. 55(2), then since the distance between the conductor 18 and the magnets **16*a* decreases (from the distance t1 in the horizontal position to the distance d2), the amount of magnetic fluxes acting the pickup 16 increases suddenly as seen in FIG. 56, and the relationship of the displacement of the pickup 16 when the speed of the car 12 rises to a dangerous speed is corrected by a great amount as seen in FIG. 57. Accordingly, the displacement of the pickup 16 when a dangerous speed is reached is great, and the certainty of an operation of the safety apparatus is improved. Further, in the construction of the embodiment 14, since magnetic fluxes are easier to pass where the arm 14 is pivoted in the upward direction as described above, a force tending to pivot the arm 14 upwardly as a magnetic force can be utilized as a magnetic spring, and a malfunction is further reduced and the operation is stabilized if the magnetic spring 25 is constructed such that the magnets 25*h* are disposed in the upward and downward directions of the pickup 16**.

Further, since the magnetic path is formed by the yokes **16*b* and the conductor 18, the magnetic path for magnetic fluxes from the magnets 16*a* on the opposite sides of the conductor 18 need not be formed by the yoke 16*c***, and the number of parts is reduced and the construction is simplified.

Furthermore, in the system of the present embodiment 24, since the function is achieved if a magnet **16*a*, a yoke 16*b* and a link of the arm 14 are provided on only one side of the conductor 18, the number of parts can be reduced and the construction can be simplified. It is to be noted that a yoke interconnecting the yokes 16*b* and the conductor 18 may be provided or the yoke 16*c*** for interconnecting magnetic fluxes on the opposite sides may be provided so that the magnetic force may be stronger.

Embodiment 25

Figure 58:
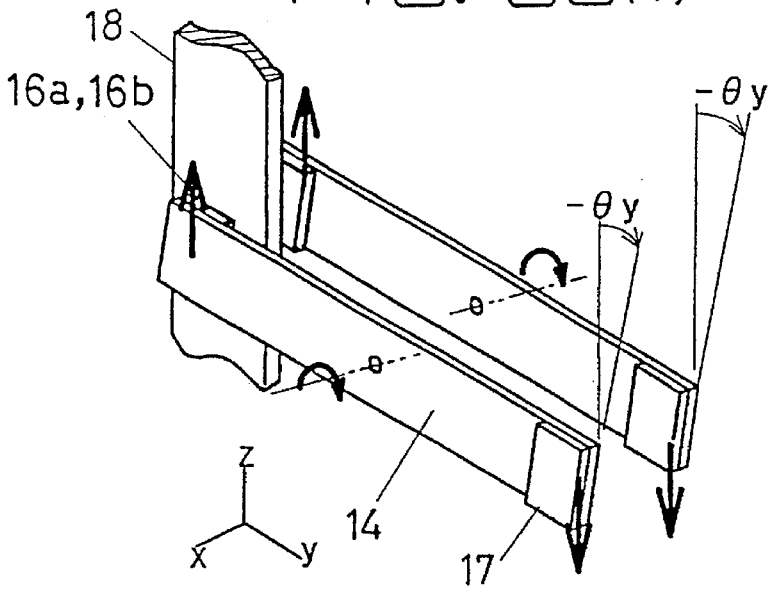
FIG. 58(1) is a perspective view showing schematically a pickup, an arm, and a balance weight when the arm in an embodiment 25 of the present invention is horizontal.
Figure 58:
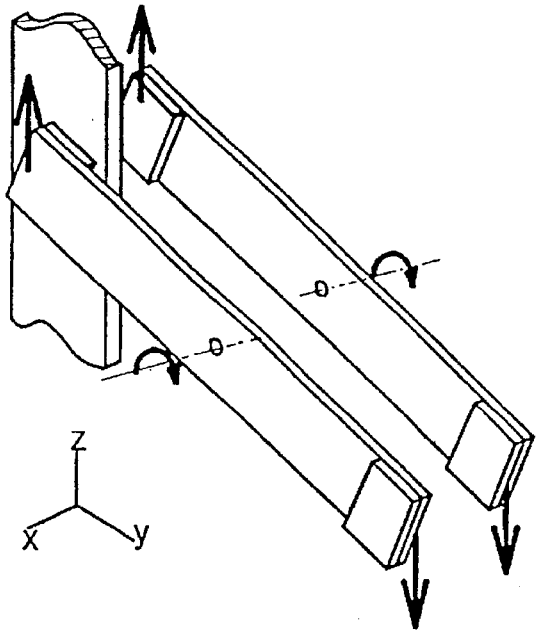

While, in the embodiment 24, an action to increase the gradient (dZ/dV) of the displacement of the pickup 16 relative to the velocity of the car 12 operates only in a direction in which the car 12 runs downwardly, in the present embodiment 25, as shown in FIGS. 58(1) and 58(2), the links of the arm 14 on the opposite sides of the conductor 18 are inclined in the same direction on the opposite sides, and when the pickup 16 is pivoted upwardly, the magnet 16*a* on the positive side of the X-axis approaches the conductor 18, but when the pickup 16 is pivoted downwardly, the magnet 16*a* on the negative side of the X-axis approaches the conductor 18. Consequently, similar effects to those of the embodiment 24 are obtained. Accordingly, an effect that the gradient (dZ/dV) of the displacement of the pickup 16 relative to the speed of the car 12 described above is increased can be obtained whether the car 12 runs in the upward direction or in the downward direction.

Embodiment 26

Figure 59:
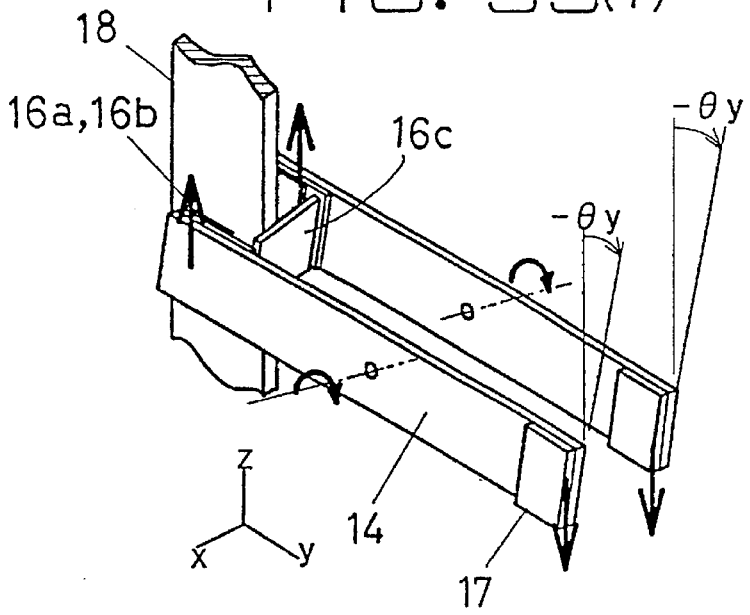
FIG. 59(1) is a perspective view showing schematically a pickup, an arm, and a balance weight when the arm in an embodiment 26 of the present invention is horizontal.
Figure 59:
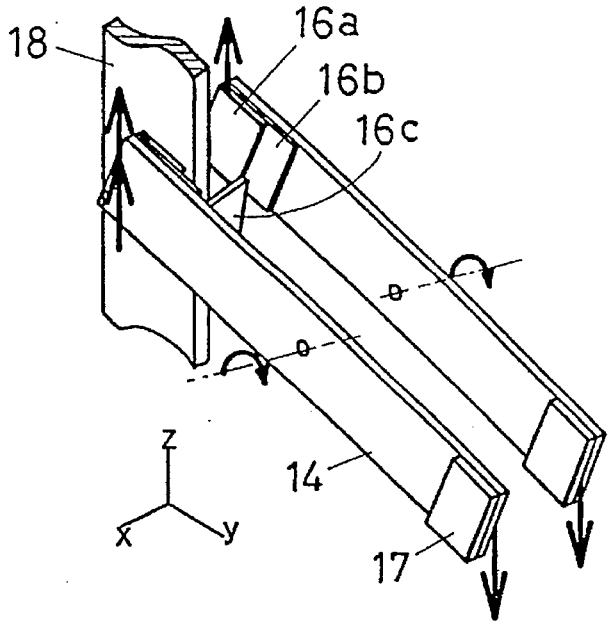

In the present embodiment 26, as shown in FIGS. 59(1) and 59(2), the links of the arm 14 are mounted obliquely similarly as in the embodiment 25, and besides, a yoke 16*c* which magnetically couples the magnets 16*a* on the opposite sides of the conductor 18 to each other is provided. The yoke 16*c* is removably provided such that, when one of the links of the arm 14 is spaced away from the conductor 18, the yoke 16*c* is spaced away from the thus moving away arm 14 as seen in FIG. 59(2). Due to the construction, magnetic fluxes of the magnetic circuit of the pickup 16 become easier to pass.

Further, while, in the present embodiment 26, the links of the arm 14 are mounted obliquely to vary the distances of the air gaps 30 on the opposite sides of the conductor 18, a guide or a link mechanism which causes the distances of the air gaps 30 to vary along the route of movement of the magnets 16*a* may be provided instead.

Embodiment 27

When the stroke required to render a safety apparatus operative is taken long in order to further stabilize operation of the safety apparatus, it is sometimes desired, from, for example, a strength of a magnetic circuit or a limitation in spring force, to set the rated speed or the first over speed to a value, for example, higher than the displacement P3 of FIG. 44 (desired to move the displacement P3 in the rightward direction in FIG. 44). In this instance, the requirement can be realized by providing a force adjustment mechanism for correcting the operating force on the arm 14 side to perform correction of the force. The embodiment 27 is an embodiment which realizes the force adjustment mechanism.

Figure 60:
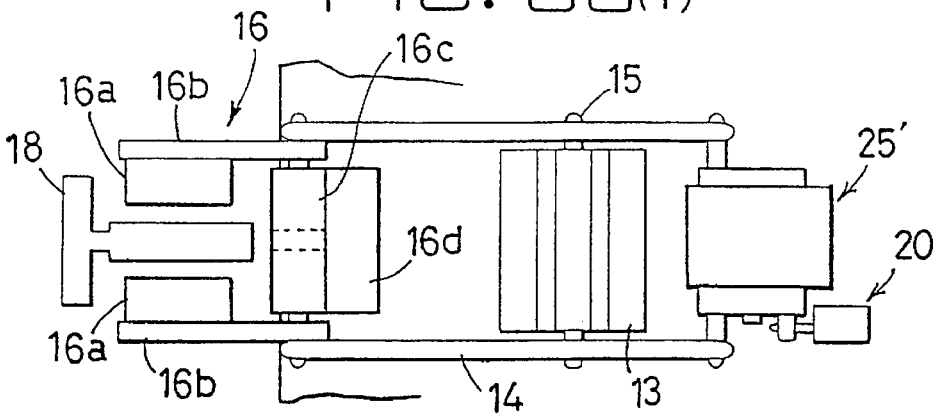
FIG. 60(1) is a plan view showing a construction of an embodiment 27 of the present invention.
Figure 60:
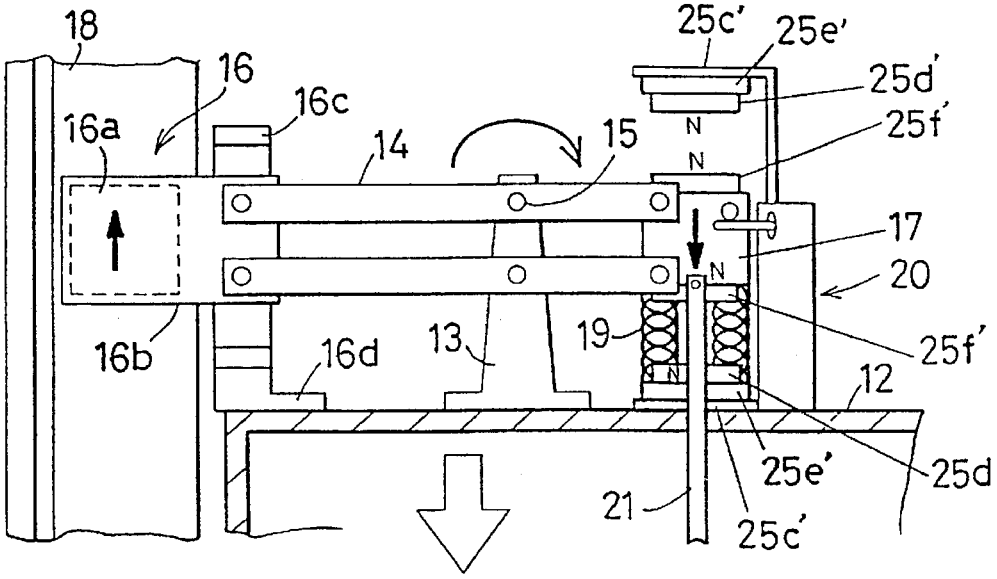
Figure 61:
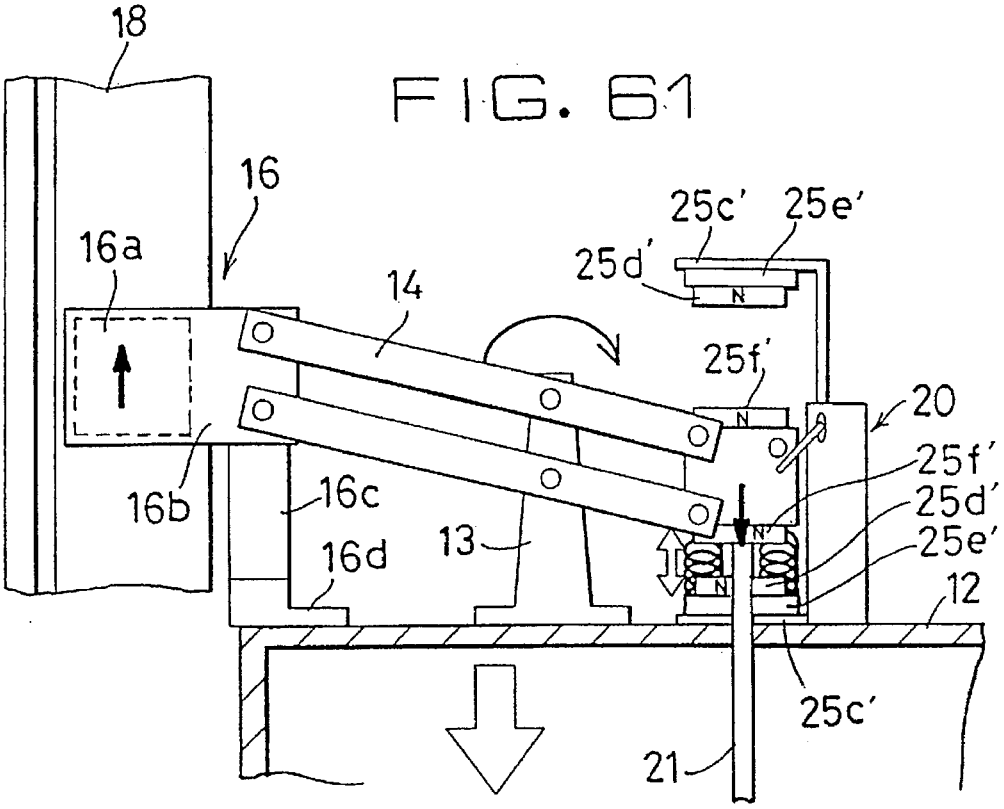
FIG. 61 is a front elevational view showing a condition in which an arm in the embodiment 27 is pivoted clockwise.
Figure 62:
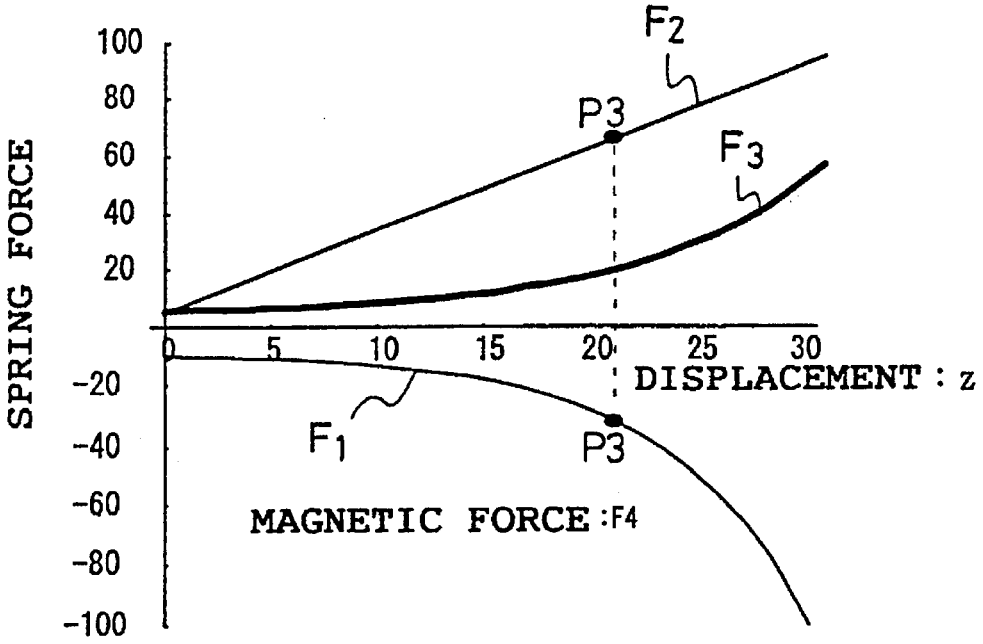
FIG. 62 is a diagram illustrating a relationship of a spring force generated in a elastic spring and a magnetic spring with respect to a displacement of a pickup of the embodiment 27.
Figure 63:
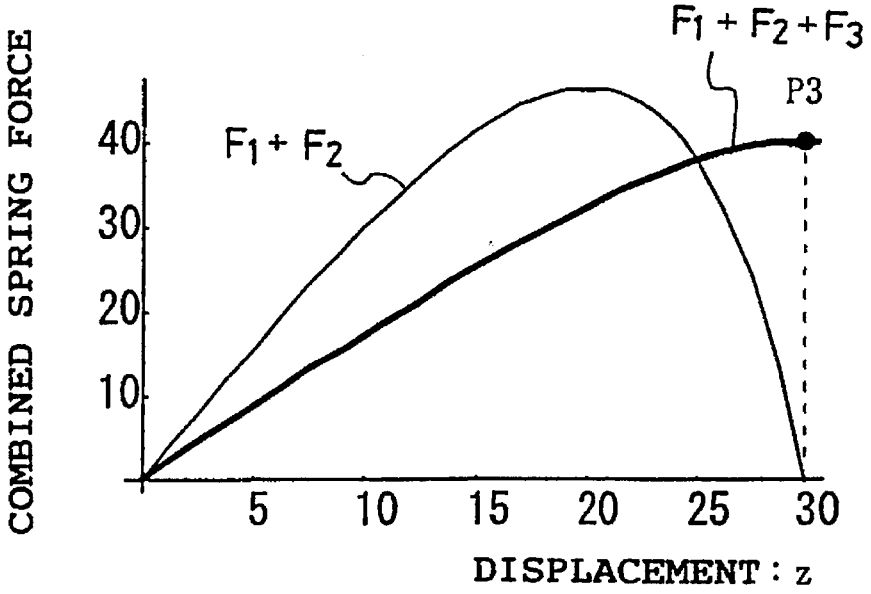
FIG. 63 is a diagram illustrating a combined spring force of the elastic spring and the magnetic spring of FIG. 62.
Figure 64:
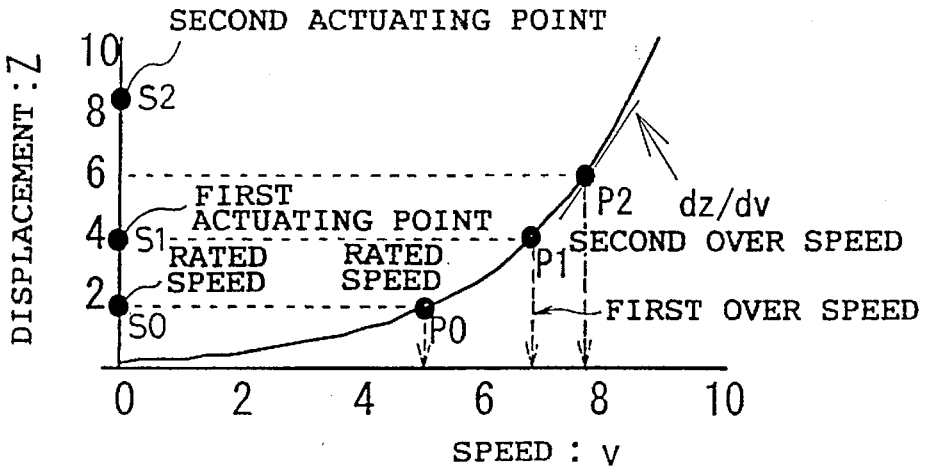
FIG. 64 is a diagram illustrating a displacement of a pickup with respect to a speed of a car of the embodiment 27.

As shown in FIGS. 60(1) and 60(2), the yoke 16*c* of the pickup 16 of the present embodiment 27 has the same configuration as the yoke 16*c* of the embodiment 19 shown in FIGS. 35(1) and 35(2) and has a magnetic force illustrated as the magnetic spring force F1 in FIG. 43. When the magnetic spring force F1 is strong, the displacement P3 of FIG. 44 is positioned leftwardly in FIG. 44, and therefore, a magnetic spring 25' for cancelling the magnetic spring force F1 is provided on the balance weight 17 side. The magnetic spring 25' includes a pair of magnets 25*f* disposed on the upper face and the lower face of the balance weight 17, and a pair of counter magnets 25*d'* and a pair of counter yokes 25*e'* provided at positions at an upper end portion and a lower end portion between which the balance weight 17 can move and having polarities which exert repulsive forces to the magnets 25*f'*. The repulsive force F3 by a magnetic circuit on the balance weight 17 side is such as, for example, illustrated in FIG. 62. If the repulsive force F3 is combined with the magnetic spring force F1 and the elastic spring force F2, then the displacement at which the combined force F1+F2+F3 assumes a peak value can be raised as seen in FIG. 63, and the operation distance of the safety apparatus can be taken long. Consequently, the rated speed, the first over speed and the second over speed can be set to values before the displacement of the pickup 16 reaches the displacement P3 as seen in FIG. 64.

In this manner, the relationship between the displacement of the pickup 16 and the combined spring force can be designed arbitrarily using, in addition to the force produced by eddy currents corresponding to the speed of movement of the car 12, the elastic spring force F2 for holding the arm 14, the magnetic spring force F1 caused by a variation of the amount of magnetic fluxes of the magnets 16*a* on the opposite sides of the conductor 18 and the magnetic spring force F3 produced from the magnetic spring 25' on the balance weight 17 side.

Embodiment 28

While, in the embodiments described above, a non-linear spring is formed by a magnetic spring and a elastic spring, in the present embodiment 28, a non-linear spring is formed by a combination of elastic springs.

Figure 65:
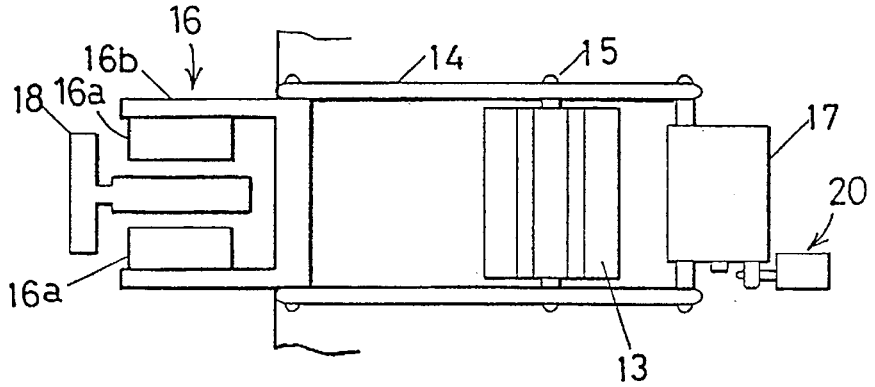
Figure 65:
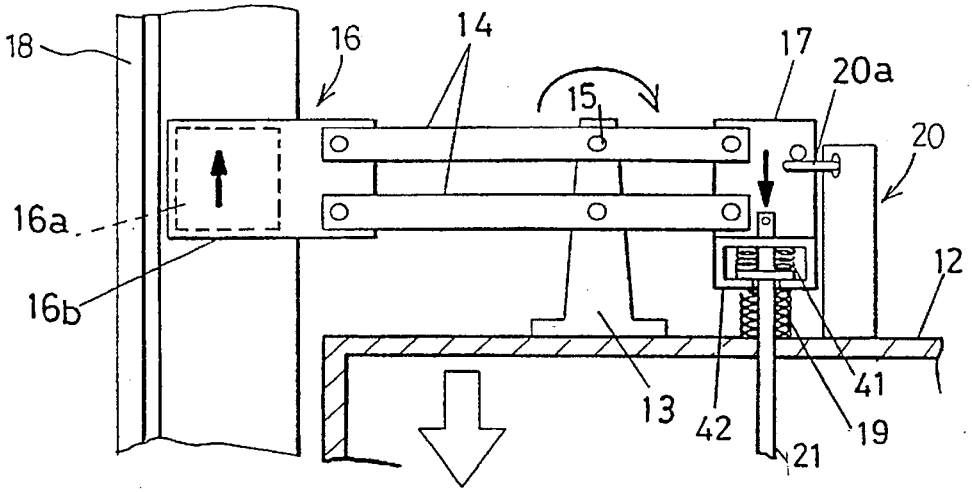

Referring to FIGS. 65(1) and 65(2), reference numeral 41 denotes a elastic spring having a spring constant lower than that of the elastic spring 19, and 42 a holder for accommodating the elastic spring 41 therein. The elastic spring 41 is accommodated in a compressed condition in advance in the holder 42. As shown in FIG. 66(3), the characteristic of the combined spring first exhibits a characteristic of a high spring constant in accordance with the characteristic of the elastic spring 19, but as the displacement increases, the characteristic of the elastic spring 19 appears significantly so that the spring constant decreases, and a characteristic similar to that of the non-linear springs described hereinabove is obtained. The relationship between the speed of the car 12 and the displacement of the pickup 16 where this spring is used is illustrated in FIG. 67. Thus, a characteristic wherein the displacement is small at a low speed and, as the speed rises, the displacement increases suddenly is obtained, and a stabilized elevator overspeed protection apparatus which suffers less likely from a malfunction is obtained.

In the present embodiment 28, since the non-linear spring is formed using only inexpensive elastic springs, the apparatus can be produced at a low cost, and since the resiliency characteristic is stable, an apparatus having a high degree of reliability can be constructed.

Embodiment 29

In the embodiment 29, the non-linearity of the non-linear spring is realized by electric control. Referring to FIGS. 68(1) and 68(2), reference character 43 denotes an actuator for controlling the displacement of the balance weight 17, and 43*a* an actuator spring provided under the balance weight 17 and capable of detecting the magnitude of the force from the balance weight 17 and displacing the balance weight 17 in the upward or downward direction. Further, reference character 43*b* denotes a control apparatus for electrically controlling the actuator spring 43*a*.

Operation will be described subsequently. A displacement controlling operation of the balance weight 17 will be described with reference to the flow chart of FIG. 69.

First, the actuator spring 43*a* detects the force by the displacement of the balance weight 17 (step ST1).

Then, the control apparatus 43*b* converts the force detected by the actuator spring 43*a* into a displacement amount by which the balance weight 17 is to be displaced (step ST2). In this instance, the control apparatus 43*b* converts the force detected by the actuator spring 43*a* into a displacement of the balance weight 17 such that, as seen in the graph at step ST2, when the force detected by the actuator spring 43*a* is lower than a dangerous speed, the displacement is small, but as the detected force approaches the dangerous speed, the displacement increases rapidly and, when the detected force reaches the dangerous speed, a switch of the brake apparatus or the emergency stop operates, to obtain a control variable for controlling the actuator spring 43*a*.

Thereafter, the actuator spring 43*a* displaces the balance weight 17 in accordance with the control variable outputted from the control apparatus 43*b* (step ST3).

By displacing the balance weight 17 by means of the actuator 43 in this manner, when the speed of the car 12 is low, the displacement of the balance weight 17 (and hence the pickup 16) is small, but when the speed of the car 12 reaches the dangerous speed, the displacement exhibits a large displacement. Consequently, an elevator overspeed protection apparatus which is low in danger of a malfunction and operates with certainty is obtained.

Further, with the construction of the present embodiment 29, since electric control is involved, conversion into a displacement in accordance with a force can be performed simply, and a stabilized apparatus having a high degree of reliability can be obtained.

Embodiment 30

In the embodiment 30, the subject to be solved in that the pickup 16 exhibits a large pivotal angle at a low speed of the car 12 or the displacement exhibits a low variation rate in a high speed region of the car 12 due to a drop of the generated force of the pickup 16 is corrected by means of a mechanical system so that the displacement of an element which operates the safety apparatus may be increased in the high speed region.

Referring to FIGS. 70(1) and 70(2), reference numeral 50 denotes a connection rod for actuating the emergency stopping mechanism, 51 a cam for driving the connection rod 50, and 52 a compression spring for resiliently urging the connection rod 50 into engagement with the cam 51, and other components are similar to those of the foregoing embodiments. FIG. 71 illustrates a condition wherein the cam 51 is rotated to project the connection rod 50 downwardly. The cam 51 is designed so that, as shown in FIG. 72, the rate of the displacement varies as it rotates such that, as the rotation proceeds, the displacement increases. Consequently, the displacement of the connection rod 50 for actuating the emergency stopping mechanism is given as a combination of the displacement of the pickup 16 shown in FIG. 97, that is, the arm 14, and the displacement of the cam 51 shown in FIG. 72, and exhibits such a variation as shown in FIG. 73. Consequently, a large displacement of the connection rod 50 is assured in a high speed region of the car 12, and a malfunction is reduced and the certainty in operation is improved.

Embodiment 31

In the present embodiment 31, the cam 51 has such a profile that, as seen in FIGS. 74(1), 74(2) and 76, when it starts its rotation, it provides no displacement of the connection rod 50, but when the speed of the car 12 reaches a dangerous speed and the arm 14 is pivoted to a condition shown in FIG. 75, it provides a large displacement of the connection rod 50. By this construction, a large difference in displacement in a high speed region can be obtained simply.

With the systems of the embodiments 30 and 31, since the magnetic circuit remains as it is while the relationship of the amount of displacement of the pickup 16 to the speed of the car 12 can be corrected only by means of the mechanical system employing the cam, the construction is simple and inexpensive.

It is to be noted that, while, in the embodiments 30 and 31, the correction mechanical system includes a cam, it need not be a cam only if it is a mechanical system by which the variation rate of the displacement is increased as the rotation proceeds, and a link mechanism or some other mechanism may be employed.

Further, while, in the embodiments 30 and 31, the magnetic circuit section is same as that of the conventional apparatus, the magnetic circuit section may be any of the constructions of the embodiments 1 to 27 described hereinabove, and a higher correction effect can be obtained and the reliability is improved by combining any of the constructions of the embodiments 1 to 27 with the cam construction of the embodiments 30 and 31 described above.

Embodiment 32

In the present embodiment 32, the subject to be solved in that, when the car 12 is swung in a horizontal direction by a one-sided load or the like when the car 12 moves or when passengers enter the car 12, the distance of a gap (air gap portion) through which magnetic fluxes of the pickup 16 pass is varied to vary the generated force to make the displacement of the balance weight 17 unstable or cause a malfunction is solved by the construction wherein an air gap keeping mechanism for keeping the distance of an air gap fixed is provided to improve the stability of the generated force.

Referring to FIGS. 77(1) and 77(2), reference numeral 35 denotes a keeping mechanism in the form of a roller guide for keeping fixed the distances between the conductor 18 and the magnets 16*a* which generate magnetic fluxes. Reference character 35*a* denotes a pair of holders securely mounted on the inner side of the yokes 16*b*, and 35*b* a roller held in each of the holders 35*a*. Reference numeral 36 denote a displacement absorption mechanism for absorbing a positional displacement between the position of the car 12 and the position of the pickup 16 caused by a displacement of the car 12, and the displacement absorption mechanism 36 is formed by a elastic member such as, for example, a spring or a rubber member, a slide mechanism or the like.

Operation will be described subsequently. In the construction of the present embodiment 31, also when the car 12 is rocked in a horizontal direction by a one-side load or the like when the car 12 moves or when passengers enter the car 12, the distance between the pickup 16 and the conductor 18 is kept fixed by means of the keeping mechanism 35, and a positional displacement between the pickup 16 and the car 12 caused thereby is absorbed, for example, by elastic deformation of the displacement absorption mechanism 36 so that the elevator overspeed protection apparatus of the present embodiment can operate similarly as in ordinary operation.

Embodiment 33

In the present embodiment 33, as shown in FIGS. 78(1) and 78(2), the bottom side of the base 13 is extended to the conductor 18 side, and the keeping mechanism 35 formed by the holders 35*a* and the rollers 35*b* is provided at an end portion of the thus extended bottom side such that it holds the conductor 18 from the opposite sides.

Operation will be described subsequently. In the embodiment 33, even if the car 12 is rocked, the entire elevator overspeed protection apparatus of the present embodiment is not varied with respect to the base 13 due to an action of the keeping mechanism 35, and the air gaps between the magnets 16*a* and the conductor 18 are kept to a fixed magnitude. In this instance, the positional displacement of the car 12 from the pickup 16 caused by the displacement of the car 12 is absorbed by the displacement absorption mechanism 36 formed form a elastic member, a slide mechanism or the like provided at a lower portion of the base 13. With the construction of the present embodiment 33, since the magnetic force generation section is not influenced by a frictional force or the like as in the case where the rollers 35*b* are provided and no load is applied to the rotary member such as the pickup 16, and the pickup 16 can move smoothly while keeping a predetermined air gap from the conductor 18 and can detect the speed of the car 12 accurately. Consequently, the safety is improved. It is to be noted that the displacement absorption mechanism need not be a slide mechanism of a elastic member, and any member may be employed only if it is displaced in response to a displacement of the car.

Embodiment 34

Referring to FIGS. 79(1) and 79(2), reference numeral 37 denotes a pair of box-shaped sliding guides each of which is securely mounted at an end thereof to an inner wall of a yoke **16*b* and slides, at the other end thereof, on the opposite surfaces of the conductor 18. Also where the sliding guides 37 are employed, similar effects to those where the keeping mechanism 35** are employed can be obtained. There is an effect in that the slide guide is inexpensive and the construction can be simplified.

Embodiment 35

Referring to FIGS. 80(1) and 80(2), reference numeral 38 denotes a slide element secured to the car 12, and the slide element 38 includes a pair of support members **38*a* on which the arm 14 is securely mounted and a bar member 38*b* held between the two opposing support members 38*a*. The yokes 16*b* of the pickup 16 are mounted for sliding movement on the bar member 38*b***.

Operation will be described subsequently. When the car 12 is displaced in the direction indicated by an arrow mark in FIG. 80(2) with respect to the conductor 18, the yokes **16*b* slidably move on the bar member 38*b* thereby absorbing the positional displacement between the pickup 16 and the car 12**.

Embodiment 36

Referring to FIGS. 81(1) and 81(2), reference characters 38' and 38" denote each a slide element securely mounted on the car 12. Each of the slide element 38' and 38" includes a pair of support members **38*a*' or 38*a*" on which the arm 14 is securely mounted, and a bar member 38*b*' or 38*b*" held between the opposing support members 38*a*' or 38*a*". The slide element 38' supports the base 13 for sliding movement thereon, and the slide element 38" supports the balance weight 17** for sliding movement thereon.

Operation will be described subsequently. When the car 12 is displaced in the direction indicated by an arrow mark in FIG. 81(1) with respect to the conductor 18, the base 13 and the balance weight 17 are slidably moved on the bar member **38*b*' and 38*b*", respectively, thereby absorbing the positional displacement between the pickup 16 and the car 12**.

Embodiment 37

Referring to FIGS. 82(1) and 82(2), reference character **16*g* denotes a recessed groove provided at a terminal portion of each of the yokes 16*b*, and 14*a* a fitting portion provided in a T shape at an end portion of the arm 14 adjacent the pickup 16 and fitted for sliding movement in the recessed groove 16*g***.

Operation will be described subsequently. When the car 12 moves in the direction indicated by an arrow mark in FIG. 82(2) with respect to the conductor 18, the fitting portion **14*a* of the arm 14 is slidably moved in the recessed groove 16*g* thereby absorbing the positional displacement between the pickup 16 and the car 12**.

Embodiment 38

In the present embodiment 38, as shown in FIGS. 83(1) and 83(2), the arm 14 is formed as a spring which can be resiliently deformed in a lateral direction and also operates as a displacement absorption mechanism. Two parallel leaf springs are formed by the left and right links of the arm 14, and even if a positional displacement is produced between the pickup 16 and the car 12 as seen in FIG. 83(2), the arm 14 is resiliently deformed to absorb the positional displacement.

Embodiment 39

Referring to FIGS. 84(1) and 84(2), reference numeral 39 denotes a guide shoe connected to the magnets **16*a* and adapted to slide on the opposite faces of the conductor 18 so as to keep the pickup 16 at a predetermined distance from the conductor 18. In the present embodiment 38, the guide shoe 39 is provided as an air gap keeping mechanism and the gaps are kept by means of the guide shoe 39**.

It is to be noted that, in the embodiments 32 to 39 described above, the position at which the air gap keeping mechanism is mounted may be an upper or lower location or any other location of the pickup 16, and the air gap keeping mechanism may be provided by a plural number or by one.

Embodiment 40

In the present embodiment 40, as shown in FIGS. 85(1) and 85(2), a force sensor 44 such as, for example, a load cell is provided for a generated force detection apparatus section which receives a force generated by the magnetic circuit section to construct an elevator speed generator which can detects the speed of movement or vibrations of or a disturbance to the car 12.

Operation will be described subsequently. In the embodiment 40 shown in FIGS. 85(1) and 85(2), the force sensor 44 which can detect in X, Y and X directions such as, for example, a load cell is provided at the location of the fulcrum 15 for the arm 14 in the detection apparatus section which receives a force generated by the magnetic circuit section. Consequently, a force or vibrations corresponding to the speed of movement of the car 12 can be detected from the outputs of the force sensor 44 for the X, Y and Z directions. The outputs can be utilized, for example, for a speed sensor signal for controlling the speed of the car 12 or for a signal for cancellation of an error of the speed in the Z direction caused by vibrations of the car 12, and further, if the car 12 is swung in the X direction and/or the Y direction, since a force generated by such vibrations can be detected by means of the force sensor 44, the force sensor 44 can be utilized as a sensor for controlling the vibrations or for improving the comfort in running.

Consequently, speed control, error correction or improvement in comfortability in running can be achieved without the provision of a special sensor for detecting vibrations, and an apparatus which is small in size and in expensive and has a high performance can be constructed.

Embodiment 41

In the present embodiment 41, as shown in FIGS. 86(1) and 86(2), eddy magnetic fluxes by eddy currents generated in the conductor 18 are detected by a magnetic flux detection element such as, for example, a Hall effect element 45 so that a speed or vibrations can be detected simply with a high sensitivity, and same effects as those described above can be achieved. Further, since the Hall effect element 45 is inexpensive and small in size and has a high sensitivity, the apparatus can detect a speed or vibrations with a further reduced size and at a further reduced cost.

Further, similar effects are obtained even where another method such as to detect a temperature by eddy currents or to detect an electric current is employed.

Embodiment 42

In the present embodiment 42, an elevator overspeed protection apparatus which is small in size, inexpensive and reliable is constructed by rendering the emergency stop operative directly by means of the elevator speed generator.

In the construction of the present embodiment 42, the safety apparatus is not operated by the connection rod 21, but the pickup 16 is mounted directly on a pair of emergency stopping shoes 46 as shown in FIGS. 87(1) to 87(3). Referring to FIGS. 87(1) to 87(3), reference numeral 46 denotes the emergency stopping shoes formed integrally with the yokes **16*b* of the pickup 16 so as to hold the conductor 18 from the opposite sides, and 47 a fastener for the emergency stopping shoes 46 securely mounted on the car 12**.

Operation will be described subsequently. When the car 12 is in a stationary condition or is running at a speed lower than the rated speed and the arm 14 is in its horizontal condition shown in FIG. 87(1) or in a condition inclined by a small angle near to the inclined condition, the emergency stopping shoes 46 and the fastener 47 are held with air gaps left therebetween, and the emergency stop for the car 12 does not operate. If the car 12 runs downwardly at a high speed and reaches a dangerous speed, then the pickup 16 is moved upwardly so that the arm 14 is inclined to leftwardly upwards as seen in FIG. 87(1). Consequently, also the emergency stopping shoes 46 securely mounted at upper portions of the yokes **16*b* are moved upwardly together with the pickup 16 and engaged with the faster 47, whereupon they are pushed inwardly by the inclined face of the fastener 47 to press the conductor 18 from the opposite sides to stop the car 12 immediately. With the construction of the present embodiment 42, since the connection rod 21** is unnecessary, the operation becomes sure and can be produced at a reduced cost and in a reduced size.

Further, since the elevator speed generator is provided on the lower side of the car 12, it is easy to carry It on the car 12, and also the safety is improved. Meanwhile, the present construction may be provided at an upper portion of the car. In this instance, there is an advantage in that adjustment upon assembly and maintenance can be performed simply.

Embodiment 43

In the present embodiment 43, at least part of the emergency stopping shoes 46 is formed as a magnet and forms a magnetic circuit. In FIGS. 88(1) and 88(2), reference numeral 48 denotes a pair of elastic springs for resiliently supporting the emergency stopping shoes 46, and 49 a holder securely mounted on the car 12 for holding the elastic springs 48 thereon. With the construction of the present embodiment 43, since the emergency stopping mechanism serves also as the magnetic force generation mechanism, the configuration can be further reduced in size and also the number of parts can be reduced, and the apparatus can be constructed at a reduced cost.

Embodiment 44

In the present embodiment 44, in order to improve the safety of the top section and the pit section, an emergency stopping compulsory operation apparatus for compulsorily displacing the elevator overspeed protection apparatus to operate the emergency stop is provided in an elevator path. Referring to FIG. 89, reference character 53 denotes a pair of guide rails for the car 12 which also have a function as the conductor 18, 54 a pair of gripping units secured to lower corners of the car 12 and operating as an emergency stopping mechanism which grips the guide rails 53 strongly upon emergency stopping operation, **55*a* an emergency stop compulsory operation apparatus securely mounted at a lower portion of one of the guide rails 53 such that, when the car 12 moves to the pit section by accident although the speed of the car 12 does not reach a dangerous speed, it disturbs movement of part of a magnetic force generation apparatus provided in an opposing relationship to the guide rail 53, and 55*b* another emergency stop compulsory operation apparatus securely mounted at an upper end portion of the other guide rail 53 such that it disturbs movement of part of the magnetic force generation apparatus when the car 12 similarly moves up to the top portion. Reference numeral 56 denotes a link mechanism connected to the connection rod 21 for moving, upon emergency stopping, the gripping units 54 upwardly so as to grip the guide rails 53. The link mechanism 56 is a displacement enlargement mechanism by which the distance of lifting movement of the gripping units 54 is increased higher than 1 with respect to the movement by the distance of 1 of the pickup 16** in the upward direction.

Operation will be described subsequently. In the present embodiment 44, the emergency stop is formed with the same construction and the same quantity as in the conventional example. As shown in FIG. 90(1), when the car 12 moves down to the pit, the emergency stop compulsory operation apparatus **55*a* hits the pickup 16, which is a magnetic force generation apparatus section moving along the opposing guide rail 53, to pivot the arm 14 so that the gripping units 54 are lifted to hold the guide rails 53 strongly to stop the car 12. Then, when the car 12 moves up to the top section, as shown in FIG. 90(2), the emergency stop compulsory operation apparatus 55*b* is contacted with the upper end portion of the balance weight 17 of the elevator speed controller, and similarly, the balance weight 17 is moved down and the connection rod 21 moves downwardly to lift the gripping units 54 to grip the guide rails 53 strongly to stop the car 12**.

In this manner, in the present embodiment, a collision prevention mechanism which operates in the upward and downward directions with a same construction of the emergency stop as that of the conventional example and is higher in safety can be constructed at a reduced cost.

Embodiment 45

Referring to FIG. 91, reference 57 denotes a balance weight for the car 12. In the embodiment 45, the elevator overspeed protection apparatus is provided on the balance weight 57. Where the elevator overspeed protection apparatus is provided on the balance weight 57 in this manner, when the car 12 moves at an abnormal speed in the upward direction or is in an uncontrollable condition, an emergency stopping operation can be performed by the conventional emergency stop which operates in the downward direction. Further, since a governor rope which is conventionally required for the balance weight 57 side is unnecessary, the space efficiency is improved. It is to be noted that the location at which the elevator overspeed protection apparatus is provided may be anywhere on the balance weight 57.

Embodiment 46

Referring to FIG. 92, reference numeral 58 denotes a support table for the elevator overspeed protection apparatus securely mounted on a bottom side or a side wall of an upper portion of the car 12. In the embodiment 46, the elevator overspeed protection apparatus is provided on a side wall of the car 12, and the constructions of the emergency stopping shoes 46, the fastener 47 and so forth are same as those in the embodiment 42 except that the actuator 43 is mounted not on the pickup 16 but alongside the pickup 16. Accordingly, the connection rod 21 is unnecessary, and the same effects as those of the embodiment 42 that the operation becomes sure, that the apparatus can be produced at a reduced cost and in a reduced size, that the elevator overspeed protection apparatus can be carried readily on the car 12 and also that the safety is improved are achieved.

In all of the embodiments described above, any of the magnets **16*a*** may be a permanent magnet, a electromagnet or any apparatus which can generate a magnetic force.

Meanwhile, for the conductor 18, the guide rails 53 may be used as in the embodiment 44 or some other element than the guide rails 53 may be used, or a wire may be employed or any element may be employed only if an electric current can be obtained from the same.

Further, for the elastic spring 19, a elastic member or a magnetic member may be employed, or an apparatus which employs liquid such as an oil damper, an oil spring or the like or employs air such as an air compression spring may be employed only if it can convert a force into a displacement.

Furthermore, some other system which converts the generated force of the pickup 16 not into a displacement but into electric energy, thermal energy or magnetic energy may be employed. For example, when the generated force increases, electric energy may be stored by means of an element such as, for example, a piezoelectric element or a capacitor and used to operate a switch or an emergency stop, or the temperature may be raised by a rise of the generated force and used to operate a switch or an emergency stop.

As described above, according to a first aspect of the present invention, a conversion apparatus is constructed such that a first magnetic circuit is provided with a small or no displacement when the speed of a car is low but is provided with a large displacement when the speed of the car rises higher. Therefore, since the first magnetic circuit moves in a long distance at the dangerous speed and the safety device performs surely, the controller acts securely without error.

According to a second aspect of the present invention, since a conversion apparatus is constructed such that a first magnetic circuit is provided with a large displacement when the elevator speed becomes to be over the rated speed and lower than the first over speed, a running speed is accurately detected when the elevator speed goes near the first over speed as the dangerous speed.

According to a third aspect of the present invention, a convertor apparatus is constructed such that the apparatus exerts a magnetic force in a direction to reduce a displacement of the first magnetic circuit when the displacement of the first magnetic circuit is small or zero. Therefore, since the displacement of the first magnetic circuit is not variable when the displacement is small and it becomes to be variable easily when it is large, the running speed of the elevator is accurately detected. Further, the cost of the controller becomes small and the age of the controller becomes long since the magnetic force is utilized.

According to a fourth aspect of the present invention, since a york and a magnet are included into the first magnetic circuit so as to absorb other elements each other when the displacement of the first magnetic circuit is small or zero, a large resistance power is given to a rotation of the pivotal member. Less resistant power is given to the rotation when the displacement of the magnetic circuit is large because the york or the magnet is separated from the magnetic circuit so as not to influence to other elements. Therefore, the pivotal member is not rotatable when the elevator speed is small and it becomes to be rotatable when the elevator speed is large. As a result, the elevator speed is accurately detected in the domain near a dangerous speed.

According to a fifth aspect of the present invention, a second magnetic circuit, which of part is located on the pivotal member and another part is located on a car or a balance weight, suppresses rotation of the pivotal member. The rotation is suppressed by the second magnetic circuit when less rotation of the pivotal member occurs while the pivotal member can rotate sufficiently, when larger rotation of the pivotal member occurs, since the part of the second magnetic circuit located on the pivotal member is separated from the part on the car or the balance weight so as to reduce the suppressing force. Therefore, the elevator speed is accurately detected when the speed is large since the displacement of the first magnetic circuit becomes to be large.

According to a sixth aspect of the present invention, the forth magnetic circuit enlarges the displacement of the first magnetic circuit when the elevator speed becomes to be over a predetermined speed so that the displacement of the first magnetic circuit becomes to be large. A brake apparatus functions stably so that the elevator runs more safely since the displacement of the first magnetic circuit is large at near and over a dangerous speed.

According to a seventh aspect of the present invention, a magnet or a york is formed such that fluxes of the first magnetic circuit may not pass through when the displacement of the first magnetic circuit is small or zero while the fluxes may pass through when the displacement of the first magnetic circuit becomes larger so that the displacement is enlarged. Therefore, the displacement varies largely when the elevator speed is brought close a dangerous speed. As a result, a functioning point of the brake apparatus is easily set, less error occurs and the dangerous speed is detected accurately so that the safety apparatus functions stably.

According to an eighth aspect of the present invention, a pivotal member rotates in a plane inclining to the running direction of the car. Therefore, a magnet or a york of the first magnet circuit fixed to the end portion of the pivotal member is brought close the conductor so that magnetic fluxes may pass through. As a result, the same effect as described above is obtained.

According to a ninth aspect of the present invention, a spring is provided at the one end where is the opposite side of the first magnetic circuit and the spring includes a series combination of a spring having a high spring constant and an initially compressed spring having a low spring constant for limiting the displacement. Therefore, the cost of controller becomes to be low since an inexpensive spring is utilized. Further, the controller functions in high reliability since the characteristic of the spring is stable.

According to a tenth aspect of the present invention, a displacement conversion mechanism functions to activate a brake apparatus when rotation of the pivotal member is over a predetermined value. Therefore, a displacement of the connecting bar may be large so as to function stably without error.

According to an eleventh aspect of the present invention, since the brake apparatus is formed integrally with the first magnetic circuit, the small brake apparatus is realized by low cost.

According to a twelfth aspect of the present invention, since the controller comprises a keeping mechanism for keeping magnitudes of air gap portions of a first magnetic circuit on the opposite side faces of a conductor fixed, and a displacement absorption mechanism for absorbing a displacement of the first magnetic circuit in a horizontal direction with respect to a car or a balance weight on which the first magnetic circuit is provided, the elevator speed can be detected accurately even if a car rolls based on overload which is generated when the car runs or passengers get on.

According to a thirteenth aspect of the present invention, since the keeping mechanism consists of a roller guide, the mechanism is realized by very low cost.

According to a fourteenth aspect of the present invention, since the displacement absorption mechanism is formed by a elastic member, a slide mechanism, or the combination of them, the mechanism which functions stably is realized by very low cost.

According to a fifteenth aspect of the present invention, since the conversion apparatus comprises an element for detecting physical quantity such as forth, displacement, or magnetic flux, which may be changed in response to the movement of the car, a error correction and comfort in the elevator are improved without special vibration detecting sensors.

Having now fully described the invention, it will be apparent to one of ordinary skill in the art that many changes and modifications can be made thereto without departing from the spirit and scope of the invention as set forth herein.

What is claimed is:

1. An elevator overspeed protection apparatus comprising:

a conductor arranged and fixed along a running direction of a car in an elevator path;

a first magnetic circuit being movable in the proximity of said conductor and having a magnetic path passing through said conductor;

a conversion apparatus for converting a force which functions to said first magnetic circuit by eddy currents generated in said conductor when said car runs into a displacement of said first magnetic circuit in the running direction of said car; and a brake apparatus for stopping said car in response to the displacement of said first magnetic circuit in the running direction of said car obtained by conversion by said conversion apparatus, wherein said conversion apparatus displaces said first magnetic circuit in a small distance or does not displace said first magnetic circuit when the speed of said car is low and displaces said first magnetic circuit in a large distance when the speed of said car rises higher than a predetermined speed.

2. An elevator overspeed protection apparatus according to claim 1, wherein the predetermined speed is higher than a rated speed of said elevator but lower than a first over speed.

3. An elevator overspeed protection apparatus according to claim 1, wherein said conversion apparatus includes a second magnetic circuit provided on said car or a balance weight in the proximity of said first magnetic circuit for exerting a magnetic force in a direction to suppress the displacement of said first magnetic circuit when the displacement of said first magnetic circuit is small or zero.

4. An elevator overspeed protection apparatus according to claim 1, wherein said conversion apparatus includes a pivotal member holding at an end thereof a magnet or a yoke, which forms said first magnetic circuit, and supported on a fulcrum provided on said car or a balance weight for pivotal motion in the running direction of said car, and a yoke or a magnet provided on said car or said balance weight in the proximity of said first magnetic circuit such that said yoke or said magnet forms a component of said first magnetic circuit when the displacement of said first magnetic circuit is small or zero, and when the displacement of said first magnetic circuit is large, said yoke or said magnet is removed from said first magnetic circuit.

5. An elevator overspeed protection apparatus according to claim 1, wherein said conversion apparatus includes a pivotal member holding at an end thereof a magnet and/or a yoke, which forms said first magnetic circuit, and supported on a fulcrum provided on said car or a balance weight for pivotal motion in the running direction of said car, and a second magnetic circuit having a portion located at another portion of said pivotal member and having another portion located on said car or said balance weight for exerting a magnetic force in a direction to control the pivotal motion of said pivotal member.

6. An elevator overspeed protection apparatus according to claim 1, wherein said conversion apparatus includes a fourth magnetic circuit provided on said car or a balance weight in the proximity of said first magnetic circuit for exerting, when the displacement of said first magnetic circuit becomes greater than a displacement of said first magnetic circuit exhibited when the running speed of said car reaches the predetermined speed, a magnetic force so as to promote the displacement.

7. An elevator overspeed protection apparatus according to claim 1, wherein said conversion apparatus includes a magnet or a yoke provided in said first magnetic circuit and so shaped that, when the displacement of said first magnetic circuit in the running direction of said car is small or zero, magnetic fluxes of said first magnetic circuit are less easy to pass, and as the displacement of said first magnetic circuit in the running direction of said car increases, magnetic fluxes of said first magnetic path pass easily.

8. An elevator overspeed protection apparatus according to claim 1, wherein said conversion apparatus includes a pivotal member for holding at an end thereof a magnet and/or a yoke, which forms said first magnetic circuit, and supported on a fulcrum provided on said car or a balance weight for pivotal motion in the running direction of said car, and a plane of the pivotal motion of said pivotal member is inclined relative to the running direction of said car.

9. An elevator overspeed protection apparatus according to claim 1, wherein said conversion apparatus includes a pivotal member for holding at an end thereof a magnet and/or a yoke, which forms said first magnetic circuit, and supported on a fulcrum provided on said car or a balance weight for pivotal motion in the running direction of said car, and said pivotal member includes a spring provided at the other end thereof and including a series combination of a spring having a high spring constant and an initially compressed spring having a low spring constant for limiting the displacement of the other end of said pivotal member.

10. An elevator overspeed protection apparatus according to claim 1, wherein said conversion apparatus includes a pivotal member holding at an end thereof a magnet and/or a yoke, which forms said first magnetic circuit, and supported on a fulcrum provided on said car or a balance weight for pivotal motion in the running direction of said car, and a displacement conversion mechanism for displacing said brake apparatus in a small distance when an amount of the pivotal motion of said pivotal member is small and displacing said brake apparatus in a large distance so that said brake apparatus is excited when the amount of pivotal motion of said pivotal member becomes greater than an amount of a pivotal motion exhibited in case the speed of said car reaches the predetermined speed.

11. An elevator overspeed protection apparatus according to claim 1, further comprising, a conductor arranged and fixed along a running direction of a car in an elevator path;

a first magnetic circuit movable in the proximity of said conductor and having a magnetic path passing said conductor;

a conversion apparatus for converting a force which functions to said first magnetic circuit by eddy currents generated in said conductor when said car runs into a displacement of said first magnetic circuit in the running direction of said car; and a brake apparatus for stopping said car in response to the displacement of said first magnetic circuit in the running direction of said car obtained by conversion by said conversion apparatus, wherein said brake apparatus is formed integrally with said first magnetic circuit.

12. An elevator overspeed protection apparatus comprising, a conductor arranged and fixed along a running direction of a car in an elevator path;

a first magnetic circuit movable in the proximity of said conductor and having a magnetic path passing through said conductor;

a conversion apparatus for converting a force which functions to said first magnetic circuit by eddy currents generated in said conductor when said car runs into a displacement of said first magnetic circuit in the running direction of said car;

a brake apparatus for stopping said car in response to the displacement of said first magnetic circuit in the running direction of said car obtained by conversion by said conversion apparatus;

a keeping mechanism for keeping magnitudes of air gap portions of said first magnetic circuit on the opposite side faces of said conductor fixed; and a displacement absorption mechanism for absorbing a displacement of said first magnetic circuit in a horizontal direction with respect to said car or a balance weight on which said first magnetic circuit is provided.

13. An elevator overspeed protection apparatus according to claim 12, wherein said keeping mechanism includes a roller guide or sliding guide.

14. An elevator overspeed protection apparatus according to claim 12, wherein said displacement absorption mechanism is formed by a elastic member, a slide guide or the combination of them.

15. An elevator overspeed protection apparatus comprising, a conductor arranged and fixed along a running direction of a car in an elevator path;

a first magnetic circuit movable in the proximity of said conductor and having a magnetic path passing through said conductor;

a conversion apparatus for converting a force which functions to said first magnetic circuit by eddy currents generated in said conductor when said car runs into a displacement of said first magnetic circuit in the running direction of said car; and a brake apparatus for stopping said car in response to the displacement of said first magnetic circuit in the running direction of said car obtained by conversion by said conversion apparatus, wherein said conversion apparatus includes an element for detecting physical quantity such as a force, a displacement, or a magnetic flux, which may be changed in response to the movement of the car.

* * * * *